US010794137B2

(12) United States Patent
Kibler et al.

(10) Patent No.: US 10,794,137 B2
(45) Date of Patent: Oct. 6, 2020

(54) REMOTE OPERATOR INTERFACE AND CONTROL UNIT FOR FLUID CONNECTIONS

(71) Applicant: FHE USA LLC, Fruita, CO (US)

(72) Inventors: Matthew E. Kibler, Grand Junction, CO (US); Kyle Scholl, Dunlap, IL (US); Nicolas G. Snoke, Grand Junction, CO (US); Steven M. Hutchinson, Fruita, CO (US)

(73) Assignee: FHE USA LLC, Fruita, CO (US)

( * ) Notice: Subject to any disclaimer, the term of this patent is extended or adjusted under 35 U.S.C. 154(b) by 0 days.

(21) Appl. No.: 16/512,323

(22) Filed: Jul. 15, 2019

(65) Prior Publication Data

US 2019/0338613 A1 Nov. 7, 2019

Related U.S. Application Data

(60) Provisional application No. 62/698,393, filed on Jul. 16, 2018.

(51) Int. Cl.
*E21B 33/03* (2006.01)
*E21B 47/06* (2012.01)
*E21B 33/035* (2006.01)

(52) U.S. Cl.
CPC ..... *E21B 33/03* (2013.01); *E21B 33/0355* (2013.01); *E21B 47/06* (2013.01)

(58) Field of Classification Search
CPC ..... E21B 33/0355; E21B 33/03
See application file for complete search history.

(56) References Cited

U.S. PATENT DOCUMENTS 3,071,188 A * 1/1963 Raulins ..... E21B 33/038 285/23
3,325,190 A * 6/1967 Eckert ..... E21B 33/038 285/18
3,516,491 A * 6/1970 Lewis ..... E21B 33/0355 166/336
3,841,665 A 10/1974 Capot
4,169,507 A * 10/1979 Szymczak ..... E21B 33/0355 166/340
4,413,642 A * 11/1983 Smith ..... E21B 34/16 137/102
4,496,172 A * 1/1985 Walker ..... F16L 37/002 285/18

(Continued)

OTHER PUBLICATIONS

International Search Report and the Written Opinion of the International Searching Authority in PCT/US2019/042039 dated Oct. 10, 2019 (10 pages).

*Primary Examiner* — Robert E Fuller
(74) *Attorney, Agent, or Firm* — Zeman-Mullen & Ford, LLP

(57) ABSTRACT

A remote operator interface and control unit configured to monitor status of, and control over, fluid connections at wellheads. Independent and concurrent status monitoring and control communication with fluid connections is provided at each of a plurality of wells. The operator interface and control unit allows a remote operator to lock and unlock fluid connection assemblies on wellheads, while at the same time viewing wellhead conditions accompanying such actions.

25 Claims, 30 Drawing Sheets

(56) References Cited

U.S. PATENT DOCUMENTS 4,607,701 A * 8/1986 Gundersen ..... E21B 33/0355 137/594
4,636,934 A * 1/1987 Schwendemann ..... E21B 33/0355 137/624.18
7,219,740 B2 5/2007 Saucier
7,283,060 B2 * 10/2007 Robison ..... E21B 23/00 340/853.1
8,776,897 B2 * 7/2014 Vaghi ..... E21B 34/16 166/373
9,644,443 B1 5/2017 Johansen et al.
9,670,745 B1 6/2017 Johansen et al.
9,828,824 B2 * 11/2017 McAuley ..... E21B 34/16
9,879,496 B2 1/2018 Johansen et al.
9,976,362 B2 5/2018 Rahim et al.
10,030,461 B2 7/2018 Johansen et al.
10,072,474 B2 9/2018 Johansen et al.
2011/0240303 A1 10/2011 Hallundbaek
2012/0125598 A1 * 5/2012 Godfrey ..... E21B 33/085 166/84.3
2012/0292035 A1 11/2012 Fenwick
2013/0048309 A1 2/2013 Young
2013/0075103 A1 3/2013 Herbel
2013/0206419 A1 8/2013 Hallundbaek et al.
2015/0184505 A1 * 7/2015 Panicker-Shah .... E21B 33/0355 702/9
2015/0345272 A1 12/2015 Kajaria et al.
2016/0215592 A1 7/2016 Helms et al.
2016/0362956 A1 * 12/2016 Older ..... E21B 43/013
2017/0226846 A1 8/2017 Gray et al.
2019/0145213 A1 5/2019 Kibler et al.
2019/0301249 A1 10/2019 Kibler et al.
2019/0301260 A1 10/2019 Kibler et al.

* cited by examiner

REMOTE OPERATOR INTERFACE AND CONTROL UNIT FOR FLUID CONNECTIONS

RELATED APPLICATIONS AND PRIORITY CLAIMS

This application claims the benefit of and priority to commonly-owned U.S. Provisional Patent Application Ser. No. 62/698,393 filed Jul. 16, 2018.

The disclosure of U.S. Provisional Patent Application 62/698,393 is incorporated herein by reference in its entirety.

FIELD OF THE DISCLOSURE

This disclosure relates generally to remote status monitoring and control over fluid delivery from surface-deployed equipment to wells drilled through subsurface formations. More particularly, in some embodiments, this disclosure relates to a remote operator interface and control unit providing independent and concurrent communication with fluid connections at each of a plurality of wells.

BACKGROUND

Co-pending and commonly-owned U.S. patent application Ser. No. 16/221,279 (the "'279 Application") is entitled "Remotely Operated Fluid Connection and Seal" and describes a fluid connection assembly in which embodiments may be remotely actuated. See, for example, Paragraphs 0016 and 0058. Paragraph 0016 states that a technical advantage of the fluid connection assembly is that it may be remotely operable. According to illustrated embodiments, a locking ring may be brought onto locking elements in order to lock a fluid connection adapter inside a fluid connection housing assembly and provide a pressure seal. The locking may be brought onto the locking elements via remotely-actuated retraction of the locking ring.

From time to time, this disclosure will refer more conveniently to fluid control housing assembly 300 in the '279 Application and in the instant application by its acronym, FCHA. FCHA and fluid connection housing assembly are synonymous in this disclosure.

Paragraph 0058 of the '279 Application describes embodiments of the disclosed fluid connection assembly in which at least one actuator assembly energizes retraction of the locking ring. In some embodiments, the actuator assemblies are hydraulically-actuated piston assemblies in which pistons extend and retract the locking ring away from and towards the locking elements. Hydraulic actuation of the piston assemblies may be remote.

Co-pending and commonly-owned U.S. patent application Ser. No. 16/426,990 (the "'990 Application") is entitled "Pressure Retaining Seals Useful on Wellheads" and describes a pressure control assembly in which cam-locking embodiments may be actuated. Paragraph 0005 states that the disclosed embodiments are hydraulically-actuated and -deactuated systems that may lock pressure control equipment to the wellhead via a remote control station. Referring now to Paragraph 0045 and FIG. 1, a cam lock sealing mechanism may be remotely engaged. First, remote hydraulic actuation causes cam lock pistons to extend, which causes rotation of the cam locks. Rotation of the cam locks moves them into an engaged position to lock an adapter into an internal receptacle and provide a pressure seal. Then, again by remote hydraulic actuation, retraction of locking ring pistons causes a locking ring to move into position over the cam locks and retain them in the engaged position.

Co-pending and commonly-owned U.S. patent application Ser. No. 16/188,795 (the "'795 Application") discloses sensor embodiments useful for remote monitoring the connection status of fluid connection assemblies such as, for example, pressure control assemblies described in the '990 Application. FIGS. 1 through 9 of the '795 Application depict pressure control assembly embodiments also described in the '990 Application. Paragraph 0059 and FIG. 10 of the '795 Application states that a disk shaped head (hereafter "cam rod puck") may be disposed on the bottom of selected cam lock pistons deployed on a pressure control assembly embodiment from the '990 Application, such that the proximity of the cam rod puck may be detected by a sensor when the cam lock piston is fully extended and the cam lock is in a fully engaged position (see FIG. 9 of the '795 Application). The sensor may be, for example, a limit switch that closes or opens when the cam rod puck contacts the sensor. Paragraph 0061 of the '795 Application further describes a "ring rod puck" and sensor disposed on the bottom of selected locking ring pistons on the pressure control assembly. The ring rod pucks and sensors are advantageously in a similar configuration to the cam rod pucks and sensors. In the case of ring rod pucks and sensors, however, the proximity of a ring rod puck may be detected by a sensor when the locking ring piston is fully extended and the locking ring is fully disengaged from the cam locks (see FIGS. 7 and 8 of the '795 Application).

A remote operator interface and control unit is needed to provide remote actuation of fluid connection devices, including those described in the '279 Application and the '990 Application. Advantageously the operator interface and control unit will further allow a remote operator also to monitor associated conditions of the fluid connection devices, such as the actuation/deactuation status of the fluid connections during remote control operations. In some embodiments, puck and sensor arrangements such as described in the '795 Application will advantageously assist the operator interface and control unit in monitoring some conditions of the fluid connections.

SUMMARY AND TECHNICAL ADVANTAGES

This application describes a remote operator interface and control unit configured to monitor status of, and control over, fluid connections at wellheads. Disclosed embodiments describe independent and concurrent status monitoring and control communication with fluid connections at each of a plurality of wells. In some exemplary embodiments, the operator interface and control unit described in the instant application allows a remote operator to retract and extend the locking ring on fluid connection assemblies such as are described in the '279 Application. The control unit enables such remote locking ring retraction/extension via remote hydraulic actuation of the piston assemblies in the actuation assemblies on the fluid connection assembly.

The control unit further allows a remote operator to monitor a retraction/extension status of the locking ring. According to embodiments described in the instant application, the fluid connection assembly provides sensors on guide rods on the actuation assemblies where the sensed position of the guide rods corresponds to a retraction/extension of the locking ring. The sensors are in electrical communication with the control unit.

Some embodiments of the control unit further allow a remote operator to pressurize and depressurize a quick test connection provided on the fluid connection assembly.

Further exemplary embodiments of the operator interface and control unit described in the instant application allow a remote operator to extend the cam lock pistons on cam-locking pressure control assemblies such as are described in the '990 Application. Extension of the cam lock pistons causes rotation of the cam locks into an engaged position, which engagement locks a fluid delivery adapter into the pressure control assembly. Embodiments of the operator interface and control unit then, again by remote hydraulic actuation, allow a remote operator to move a locking ring into position over the cam locks in an engaged position, wherein the locking ring retains the cam locks in their engaged position.

The control unit further allows a remote operator to monitor a positional status of the cam locks and the locking ring to determine when the locking ring is in position to retain the cam locks in an engaged position. According to embodiments described in the instant application, the pressure control assembly provides sensors on a crown attached to the locking ring where a sensed proximity of cam activator surfaces corresponds to a positional status in which the locking ring is retaining the cam locks in an engaged position. The sensors are in electrical communication with the control unit.

Some embodiments of the control unit further allow a remote operator to pressurize and depressurize a quick test connection provided on the pressure control assembly.

Further embodiments of the operator interface and control unit described in the instant application allow, for example, a remote operator to monitor conditions or status of fluid connections via puck and sensor arrangements such as are described in the '795 Application. For example, in control unit embodiments in communication with pressure control assemblies described in the '990 Application, puck and sensor arrangements may be deployed on pressure control assemblies such that the sensors may detect the proximity of corresponding cam rod pucks connected to cam lock pistons. Such detected proximity signifies that a cam lock piston is fully extended and the corresponding cam lock is in the engaged position. In such embodiments, the sensor is in electrical communication with the control unit.

In other pressure control assembly embodiments according to the '990 Patent, ring rod pucks may be provided on locking ring pistons. In such embodiments, sensors may detect the proximity of ring rod pucks connected to locking ring pistons. Such detected proximity signifies that a locking ring piston is fully extended and the locking ring is in a disengaged position over the cam locks. In such embodiments, the sensor is in electrical communication with the control unit.

It is therefore a technical advantage of the disclosed operator interface and control unit to enable a remote operator to monitor status of, and control over, multiple fluid connections at a plurality of wellheads, each independently and concurrently. Illustrated embodiments described in this disclosure allow a remote operator to monitor status and exercise control over four (4) fluid connections independently and concurrently. The scope of this disclosure is not limited in this regard, however. The disclosed technology is scalable in this regard.

A further technical advantage of the disclosed operator interface and control unit technology is to promote operator safety. First, as previously noted, the technology allows an operator to control fluid connections remotely. The safety risks presented to personnel working nearby wellheads are well understood, especially during high pressure/high volume fluid transfers into or out of the wellhead. The remote hydraulic and electrical communication technology disclosed in the instant application allows the operator to actuate fluid connections and monitor related sensors from a safe distance.

Second, the operator interface and control unit technology promotes operator safety by including alerts and fail-safe measures. The fail-safe measures reduce (if not eliminate the chance of operator error allowing unintentional pressurization of a fluid connection that is not ready to be pressurized. In currently preferred embodiments, positional sensors on the fluid connection advantageously detect and alert the remote operator when the fluid connection is in a mechanical condition to be pressurized internally (e.g. connection closed and locked). In other embodiments, pressure sensors on the fluid connection may detect and alert the remote operator of the presence of internal pressure. Unintentional unlocking or opening of the connection will be prevented in such pressure conditions.

A further technical advantage of the disclosed operator interface and control unit technology is its user-friendliness. Such user-friendliness is at least partially attributable to the technology's user-intuitive design. A goal of simplicity in design facilitates operator training and discourages operator error. In particular, the user-intuitive fail-safe measures described in the previous paragraph includes easily-recognizable alerts and warning conditions on the operator interface.

A further technical advantage of the disclosed operator interface and control unit technology is to allow management oversight at locations yet further remote from the control unit's current location. In currently preferred embodiments, the control unit may broadcast information regarding its current status to, e.g., an offsite computer via a cellular network connection. The cellular network connection enables, for example, an offsite operations center to monitor multiple concurrent well operations and well status potentially far away from the control unit. Alternatively, the operations center may accumulate control unit status data for later analysis. In other embodiments, a GPS location module and satellite antenna on the control unit may also concurrently broadcast the control unit's location to the offsite operations center. In other embodiments, a satellite antenna may broadcast information regarding the control unit's status to, for example, an offsite computer or operations center when cellular network coverage is poor (or non-existent), or when cellular transmission is prohibited.

In accordance with a first aspect, therefore, this disclosure describes embodiments of a control unit, comprising: a first hydraulic hose, the first hydraulic hose disposed to be connected to a fluid connection housing assembly (FCHA) such that pressurization of the first hydraulic hose retracts at least one actuator piston to lock the FCHA; a second hydraulic hose, the second hydraulic hose disposed to be connected to the FCHA such that pressurization of the second hydraulic hose extends the at least one actuator piston to unlock the FCHA; a lock switch, the lock switch disposed to selectively energize pressurization of either the first hydraulic hose or the second hydraulic hose; and an indicator light, the indicator light disposed to be addressed by first and second sensors on the FCHA such that the first sensor activates when the FCHA is in a locked condition and the second sensor activates when the FCHA is in an unlocked condition; wherein the indicator light illuminates differently according to a sensed condition detected by the first and second sensors, wherein the sensed condition is from among at least two conditions selected from the group consisting of: (a) the FCHA is in the unlocked condition; (b) the FCHA is in the locked condition; (c) the FCHA is in transition from (1) the locked condition to the unlocked condition, or (2) the unlocked condition to the locked condition; and (d) the FCHA is in a fault condition during transition from (1) the locked condition to the unlocked condition, or (2) the unlocked condition to the locked condition.

In some embodiments according to the first aspect, the control unit further comprises a well pressure display, the well pressure display disposed to be addressed by a well pressure sensor on the FCHA, wherein the well pressure display displays a current well pressure sensed by the well pressure sensor.

In some embodiments according to the first aspect, the control unit is disposed to issue at least one user-perceptible alert selected from the group consisting of: (a) while the first and second sensors detect that the FCHA is in the locked condition, an alert that the FCHA is available to be pressurized; (b) while the first and second sensors detect that the FCHA is in the unlocked condition, an alert that the FCHA is unavailable to be pressurized; and (c) while the first and second sensors detect that the FCHA is in transition from (1) the locked condition to the unlocked condition, or (2) the unlocked condition to the locked condition, an alert that the FCHA is in transition.

In some embodiments according to the first aspect, the control unit is disposed to prevent pressurization of the second hydraulic hose if the first and second sensors detect that the FCHA is in the locked condition and the well pressure sensor senses a current non-zero well pressure.

In some embodiments according to the first aspect, the control unit further comprises a third hydraulic hose, the third hydraulic hose disposed to be connected to a quick test fitting on the FCHA such that pressurization of the third hydraulic hose tests whether a pressure-tight connection has been established between sealing rings inside the FCHA; a quick test pressure display, the quick test pressure display disposed to communicate current pressure in the third hydraulic hose; and a quick test operation switch, the quick test operation switch disposed to selectively energize a quick test function selected from the group consisting of: (a) energizing pressurization of the third hydraulic hose; (b) holding current pressure in the third hydraulic hose; and (c) energizing depressurization of the third hydraulic hose.

In some embodiments according to the first aspect, the control unit further comprises an interactive touch display, the interactive touch display disposed to communicate information regarding control unit status, wherein the information regarding control unit status includes user-perceptible alerts; and wherein the interactive touch display is further disposed to communicate user instructions given to the control unit via screen touch.

In some embodiments according to the first aspect, the control unit further comprises a cellular/location broadcast module operatively connected to at least one broadcast antenna, wherein the cellular/location broadcast module is disposed to transmit information regarding control unit status via the at least one broadcast antenna, wherein the at least one broadcast antenna includes at least one antenna selected from the group consisting of (a) a cellular antenna and (b) a satellite antenna.

In some embodiments according to the first aspect, the at least one antenna includes a satellite antenna, and wherein the cellular/location module is disposed to transmit a current location of the control unit via the satellite antenna.

In accordance with a second aspect, this disclosure describes embodiments of a control unit, comprising: a first hydraulic hose, the first hydraulic hose disposed to be connected to a fluid connection housing assembly (FCHA) such that pressurization of the first hydraulic hose retracts at least one actuator piston to lock the FCHA; a second hydraulic hose, the second hydraulic hose disposed to be connected to the FCHA such that pressurization of the second hydraulic hose extends the at least one actuator piston to unlock the FCHA; a lock switch, the lock switch disposed to selectively energize pressurization of either the first hydraulic hose or the second hydraulic hose; and an indicator light, the indicator light disposed to be addressed by first and second sensors on the FCHA such that the first sensor activates when the FCHA is in a locked condition and the second sensor activates when the FCHA is in an unlocked condition; wherein the indicator light illuminates differently according whether the first and second sensors detect that (a) the FCHA is in the unlocked condition, or (b) the FCHA is in the locked condition.

In some embodiments according to the second aspect, the control unit further comprises a well pressure display, the well pressure display disposed to be addressed by a well pressure sensor on the FCHA, wherein the well pressure display displays a current well pressure sensed by the well pressure sensor.

In some embodiments according to the second aspect, the control unit is disposed to issue at least one user-perceptible alert selected from the group consisting of: (a) while the first and second sensors detect that the FCHA is in the locked condition, an alert that the FCHA is available to be pressurized; and (b) while the first and second sensors detect that the FCHA is in the unlocked condition, an alert that the FCHA is unavailable to be pressurized.

In some embodiments according to the second aspect, the control unit is disposed to prevent pressurization of the second hydraulic hose if the first and second sensors detect that the FCHA is in the locked condition and the well pressure sensor senses a current non-zero well pressure.

In some embodiments according to the second aspect, the control unit further comprises a third hydraulic hose, the third hydraulic hose disposed to be connected to a quick test fitting on the FCHA such that pressurization of the third hydraulic hose tests whether a pressure-tight connection has been established between sealing rings inside the FCHA; a quick test pressure display, the quick test pressure display disposed to communicate current pressure in the third hydraulic hose; and a quick test operation switch, the quick test operation switch disposed to selectively energize a quick test function selected from the group consisting of: (a) energizing pressurization of the third hydraulic hose; (b) holding current pressure in the third hydraulic hose; and (c) energizing depressurization of the third hydraulic hose.

In some embodiments according to the second aspect, the control unit further comprises an interactive touch display, the interactive touch display disposed to communicate information regarding control unit status, wherein the information regarding control unit status includes user-perceptible alerts; and wherein the interactive touch display is further disposed to communicate user instructions given to the control unit via screen touch.

In some embodiments according to the second aspect, the control unit further comprises a cellular/location broadcast module operatively connected to at least one broadcast antenna, wherein the cellular/location broadcast module is disposed to transmit information regarding control unit status via the at least one broadcast antenna, wherein the at least one broadcast antenna includes at least one antenna selected from the group consisting of (a) a cellular antenna and (b) a satellite antenna.

In some embodiments according to the second aspect, the at least one antenna includes a satellite antenna, and wherein the cellular/location module is disposed to transmit a current location of the control unit via the satellite antenna.

In accordance with a third aspect, this disclosure describes embodiments of a control unit, comprising: a first hydraulic hose, the first hydraulic hose disposed to be connected to a fluid connection device such that pressurization of the first hydraulic hose energizes an actuator to lock the fluid connection device; a second hydraulic hose, the second hydraulic hose disposed to be connected to the fluid connection device such that pressurization of the second hydraulic hose energizes the actuator to unlock the fluid connection device; wherein the control unit is disposed to selectively energize pressurization of the first hydraulic hose and the second hydraulic hose; and wherein an indicator alerts differently according to whether (a) the fluid connection device is in the unlocked condition, or (b) the fluid connection device is in the locked condition.

In some embodiments according to the third aspect, the indicator is disposed to be addressed by first and second sensors on the fluid connection device such that the first sensor activates when the fluid connection device is in a locked condition and the second sensor activates when the fluid connection device is in an unlocked condition.

In some embodiments according to the third aspect, the indicator alerts differently according to a sensed condition detected by the first and second sensors, wherein the sensed condition is from among at least two conditions selected from the group consisting of: (a) the fluid connection device is in the unlocked condition; (b) the fluid connection device is in the locked condition; and (c) the fluid connection device is in transition from (1) the locked condition to the unlocked condition, or (2) the unlocked condition to the locked condition.

In some embodiments according to the third aspect, the control unit is disposed to issue a user-perceptible alert when a well pressure sensor senses a current well pressure in excess of a predetermined maximum pressure value.

In some embodiments according to the third aspect, the control unit is disposed to prevent pressurization of the second hydraulic hose if the fluid connection device is in the locked condition and a well pressure sensor senses a current non-zero well pressure.

In some embodiments according to the third aspect, the control unit further comprises: a third hydraulic hose, the third hydraulic hose disposed to be connected to a quick test fitting on the fluid connection device such that pressurization of the third hydraulic hose tests whether a pressure-tight connection has been established between sealing rings inside the fluid connection device; a quick test pressure display, the quick test pressure display disposed to communicate current pressure in the third hydraulic hose; and a quick test operation switch, the quick test operation switch disposed to selectively energize a quick test function selected from the group consisting of: (a) energizing pressurization of the third hydraulic hose; (b) holding current pressure in the third hydraulic hose; and (c) energizing depressurization of the third hydraulic hose.

In some embodiments according to the third aspect, the control unit further comprises a cellular/location broadcast module operatively connected to at least one broadcast antenna, wherein the cellular/location broadcast module is disposed to transmit information regarding control unit status via the at least one broadcast antenna, wherein the at least one broadcast antenna includes at least one antenna selected from the group consisting of (a) a cellular antenna and (b) a satellite antenna.

In accordance with a fourth aspect, this disclosure describes embodiments of a control unit, comprising: a first hydraulic hose, the first hydraulic hose disposed to be connected to a fluid connection housing assembly (FCHA) such that pressurization of the first hydraulic hose retracts at least one actuator piston to lock the FCHA; a second hydraulic hose, the second hydraulic hose disposed to be connected to the FCHA such that pressurization of the second hydraulic hose extends the at least one actuator piston to unlock the FCHA; a lock switch, the lock switch disposed to selectively energize pressurization of either the first hydraulic hose or the second hydraulic hose; an indicator light, the indicator light disposed to be addressed by first and second sensors on the FCHA such that the first sensor activates when the FCHA is in a locked condition and the second sensor activates when the FCHA is in an unlocked condition; wherein the indicator light illuminates differently according to a sensed condition detected by the first and second sensors, wherein the sensed condition is from among at least two conditions selected from the group consisting of: (a) the FCHA is in the unlocked condition; (b) the FCHA is in the locked condition; (c) the FCHA is in transition from (1) the locked condition to the unlocked condition, or (2) the unlocked condition to the locked condition; and (d) the FCHA is in a fault condition during transition from (1) the locked condition to the unlocked condition, or (2) the unlocked condition to the locked condition; and a well pressure display, the well pressure display disposed to be addressed by a well pressure sensor on the FCHA, wherein the well pressure display displays a current well pressure sensed by the well pressure sensor.

In some embodiments according to the fourth aspect, the control unit is disposed to issue at least one user-perceptible alert selected from the group consisting of: (a) while the first and second sensors detect that the FCHA is in the locked condition, an alert that the FCHA is available to be pressurized; (b) while the first and second sensors detect that the FCHA is in the unlocked condition, an alert that the FCHA is unavailable to be pressurized; (c) while the well pressure sensor senses a current well pressure in excess of a predetermined maximum pressure value, an alert that the predetermined maximum pressure value has been exceeded; and (d) while the first and second sensors detect that the FCHA is in transition from (1) the locked condition to the unlocked condition, or (2) the unlocked condition to the locked condition, an alert that the FCHA is in transition.

In some embodiments according to the fourth aspect, the control unit is disposed to prevent pressurization of the second hydraulic hose if the first and second sensors detect that the FCHA is in the locked condition and the well pressure sensor senses a current non-zero well pressure.

In some embodiments according to the fourth aspect, the control unit further comprises: a third hydraulic hose, the third hydraulic hose disposed to be connected to a quick test fitting on the FCHA such that pressurization of the third hydraulic hose tests whether a pressure-tight connection has been established between sealing rings inside the FCHA; a quick test pressure display, the quick test pressure display disposed to communicate current pressure in the third hydraulic hose; and a quick test operation switch, the quick test operation switch disposed to selectively energize a quick test function selected from the group consisting of: (a) energizing pressurization of the third hydraulic hose; (b) holding current pressure in the third hydraulic hose; and (c) energizing depressurization of the third hydraulic hose.

In some embodiments according to the fourth aspect, the control unit further comprises an interactive touch display, the interactive touch display disposed to communicate information regarding control unit status, wherein the information regarding control unit status includes user-perceptible alerts; and wherein the interactive touch display is further disposed to communicate user instructions given to the control unit via screen touch.

In some embodiments according to the fourth aspect, the control unit further comprises a cellular/location broadcast module operatively connected to at least one broadcast antenna, wherein the cellular/location broadcast module is disposed to transmit information regarding control unit status via the at least one broadcast antenna, wherein the at least one broadcast antenna includes at least one antenna selected from the group consisting of (a) a cellular antenna and (b) a satellite antenna.

In some embodiments according to the fourth aspect, the at least one antenna includes a satellite antenna, and wherein the cellular/location module is disposed to transmit a current location of the control unit via the satellite antenna.

The foregoing has outlined rather broadly some of the features and technical advantages of the technology embodied in the disclosed operator interface technology, in order that the detailed description that follows may be better understood. Additional features and advantages of the disclosed technology may be described. It should be appreciated by those skilled in the art that the conception and the specific embodiments disclosed may be readily utilized as a basis for modifying or designing other structures for carrying out the same inventive purposes of the disclosed technology, and that these equivalent constructions do not depart from the spirit and scope of the technology as described and as set forth in the appended claims.

BRIEF DESCRIPTION OF THE DRAWINGS

For a more complete understanding of embodiments described in detail below, and the advantages thereof, reference is now made to the following drawings, in which:

FIGS. 6F and 6G are enlarged insets as shown on FIG. 6E, in which FIG. 6F depicts ring rod puck and sensor embodiments 287, 285 with ring 240 down, and in which FIG. 6G depicts ring rod puck and sensor embodiments 287, 285 with ring 240 up.

DETAILED DESCRIPTION

Figure 1A:
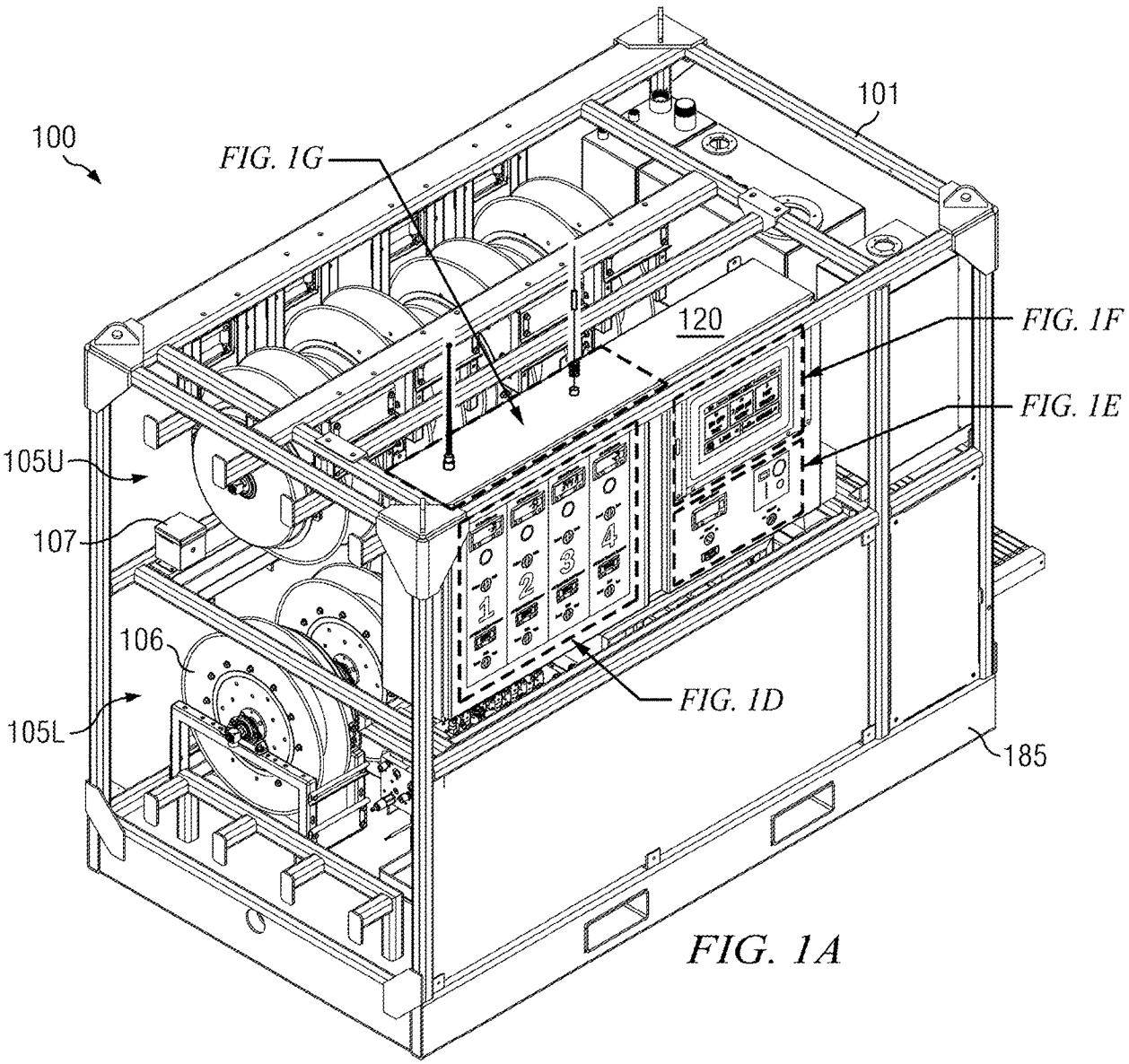
FIG. 1A is a front perspective view of an embodiment of control unit 100.

The following description of embodiments provides non-limiting representative examples using Figures and schematics with part numbers and other notation to describe features and teachings of different aspects of the disclosed technology in more detail. The embodiments described should be recognized as capable of implementation separately, or in combination, with other embodiments from the description of the embodiments. A person of ordinary skill in the art reviewing the description of embodiments will be capable of learning and understanding the different described aspects of the technology. The description of embodiments should facilitate understanding of the technology to such an extent that other implementations and embodiments, although not specifically covered but within the understanding of a person of skill in the art having read the description of embodiments, would be understood to be consistent with an application of the disclosed technology.

FIGS. 1A through 6G of this disclosure illustrate currently preferred embodiments of the disclosed operator interface and control unit technology. For the purposes of the following disclosure, FIGS. 1A through 2F should be viewed together as one currently preferred embodiment of a control unit and an associated remote-controlled fluid connection. FIGS. 3A through 6G describe exemplary alternative embodiments of remote-controlled fluid connections with which further embodiments of the control unit of FIGS. 1A through 1G may be associated. Any part, item, or feature that is identified by part number on one of FIGS. 1A through 6G will have the same part number when illustrated on another of FIGS. 1A through 6G in the instant application, or when illustrated or described in the '279 Application or the '990 Application (both incorporated herein by reference). It will be understood that the embodiments as illustrated and described with respect to FIGS. 1A through 6G are exemplary only and serve to illustrate the larger concept of the technology. The inventive material set forth in this disclosure is not limited to such illustrated and described embodiments.

FIGS. 1A through 1G illustrate features and aspects of a currently preferred embodiment of an operator interface and control unit 100 (hereafter "control unit 100") in accordance with this disclosure. Control unit 100 is configured to allow a remote operator to exercise a variety of controls over one or more separate fluid connections at distant wellheads. The operator may exercise such control over each separate fluid connection independently and concurrently.

In preferred embodiments in fracking deployments, control unit 100 allows the remote operator to engage and disengage a wellhead fluid connection assembly safely during fracking operations. It will be understood that fracking operations include delivery of fracking fluid into the well at high pressures and flow rates. In preferred fracking implementations of control unit 100, fracking fluid delivery is via a fluid connection adapter ultimately connected to a source of fracking fluid. Control unit 100 allows the remote operator to connect and lock the fluid connection adapter into a fluid connection housing assembly on the wellhead prior to fracking fluid delivery into the well. Control unit 100 further allows the remote operator to unlock and disconnect the fluid connection adapter from the fluid connection housing assembly once fluid delivery is complete. Embodiments of control unit 100 further provide safety features to assist the remote operator in safe engagement and disengagement of the fluid connection adapter into the fluid connection housing assembly during initiation and termination of fluid flow. Such safety features include alerting the operator when the fluid connection housing assembly is correctly engaged and locked before fluid flow begins, and when the fluid connection housing assembly is fully depressurized after fluid flow has ended (before unlocking and disengaging the fluid connection adapter from the fluid connection housing assembly). Embodiments of control unit 100 further provide other alerts and fail-safe features as described below.

Currently preferred implementations of control unit 100 are in association with embodiments of the fluid connection housing assemblies 300 described in the '279 Application. The '279 Application is incorporated by reference into the instant application in its entirety. FIGS. 2A through 2G, as further described in detail below, illustrate control and monitoring features on fluid connection housing assembly 300 as connected to control unit 100, via which a remote operator may, for example, unlock and lock a fluid connection adapter 200 received into fluid connection housing assembly 300.

Other implementations of control unit 100 may be in association with an alternative embodiment of fluid connection housing assembly 300 described below with reference to FIGS. 3A through 3D. Control unit 100 offers comparable control and monitoring over this alternative embodiment to the embodiments described with reference to FIGS. 2A through 2G.

Other implementations of control unit 100 may be in association with various embodiments of pressure control assembly 200 described in the '990 Application. The '990 Application is incorporated by reference into the instant application in its entirety. Such embodiments of pressure control assembly 200 are described below with reference to FIGS. 4A through 4H, FIGS. 5A and 5B, and FIGS. 6A through 6G. Control unit 100 offers comparable control and monitoring over such pressure control assembly 200 embodiments to the embodiments described with reference to FIGS. 2A through 2G. Some embodiments illustrated on FIGS. 6A through 6G are also based on disclosure in the '795 Application. The '795 Application is incorporated by reference into the instant application in its entirety.

It will nonetheless be appreciated that the scope of the instant application is not limited to the exemplary embodiments of fluid connection housing assembly 300 and pressure control assembly 200 described herein and with which control unit 100 may be associated.

Looking now at control unit 100 in more detail, FIG. 1A is a front perspective of a currently preferred embodiment thereof. Control unit 100 includes frame 101 and skid 185. The control unit 100 embodiment of FIG. 1A is portable. Other embodiments (not illustrated) may be provided on wheels or on vehicles. Other embodiments (not illustrated) may be more permanently affixed to structures. The scope of this disclosure is not limited in this regard.

As noted above in the Summary section, the embodiment of control unit 100 on FIG. 1A enables a remote operator to monitor status and exercise control over four (4) fluid connections independently and concurrently, although the scope of this disclosure is scalable in this regard. FIG. 1A depicts control unit 100 generally including upper and lower banks 105U, 105L of hydraulic hose reels 106. Control unit 100 on FIG. 1A provides four (4) reels 106 on each of upper and lower banks 105U, 105L so that one reel 106 in each bank 105U, 105L is allocated to serve a corresponding fluid connection and wellhead.

Control unit on FIG. 1A further provides control enclosure 120. Control enclosure 120 includes an operator interface panel with operator displays, features and controls as described below in more detail with reference to FIGS. 1D through 1F. Control enclosure 120 also serves as a container to house electrical connections and electronic components enabling the displays, features and controls on the operator interface panel.

Figure 1B:
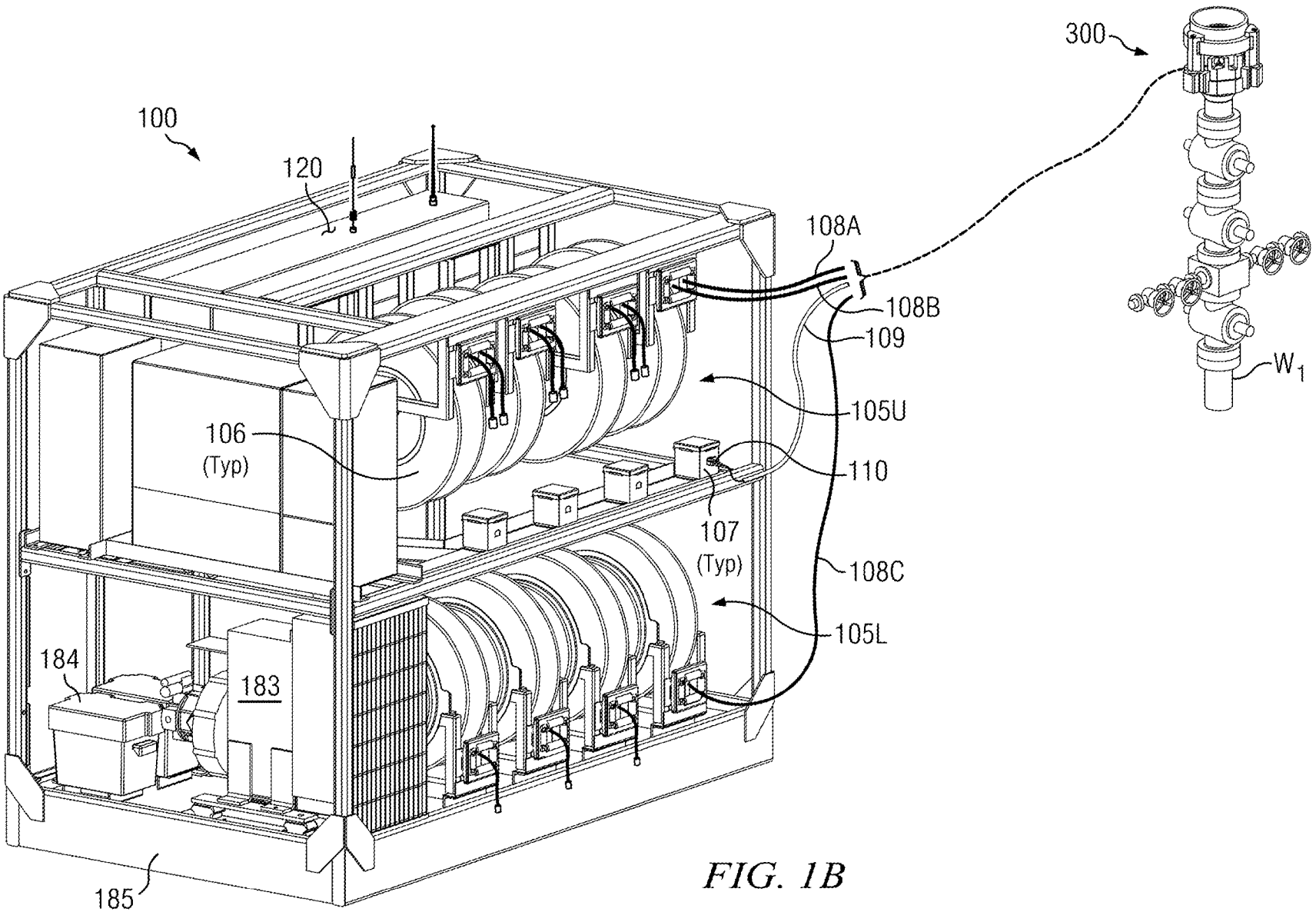
FIG. 1B illustrates the control unit 100 of FIG. 1A from behind.

FIG. 1B illustrates the control unit 100 of FIG. 1A from behind. FIG. 1B shows motor 183 for powering control unit 100. Motor 183 is a diesel engine in preferred embodiments, and as such is suitable for powering the portable embodiment of control unit 100 illustrated. Batteries 184 are provided to start motor 183, and in some embodiments may also be a source of auxiliary low voltage DC power.

FIG. 1B further illustrates reels 106 and bulkhead boxes 107 in detail. Control unit 100 allocates one reel 106 of four in each bank 105U, 105L, and one bulkhead box 107 of four, to serve a corresponding fluid connection and wellhead. FIG. 1B depicts such an allocation for wellhead W1. Although not illustrated for greater overall clarity, it will be understood that the remaining reels 106 and bulkhead boxes 107 may serve three additional wellheads independently and concurrently.

As noted above, currently preferred implementations of control unit 100 are in association with embodiments of the fluid connection housing assemblies 300 described in the '279 Application and illustrated with reference to FIGS. 2A through 2G. FIG. 1B shows hydraulic hoses 108A, 108B and 108C allocated to serve fluid connection housing assembly 300 embodiments per FIGS. 2A through 2G. With momentary reference to FIG. 2D, fluid connection housing assembly 300 provides actuator pistons 382 on actuator assemblies 380 to raise and lower locking ring 318. As described in more detail in the '279 Application, raising and lowering locking ring 318 enables disengagement and engagement of fluid connection adapter 200A inside fluid connection housing assembly 300. Referring back now to FIG. 1B, hydraulic hoses 108A and 108B on upper bank 105U of reels 106 are connected to actuator pistons 382 on fluid connection housing assembly 300. In this way, an operator at control unit 100 may pressurize and depressurize actuator pistons 382 via hydraulic hoses 108A and 108B so as to remotely raise and lower locking ring 318, thereby remotely disengaging (unlocking) and engaging (locking) fluid connection adapter 200A inside fluid connection housing assembly 300. In preferred embodiments, pressurization of hydraulic hose 108A and depressurization of hydraulic hose 108B raises locking ring 318. Conversely, pressurization of hydraulic hose 108B and depressurization of hydraulic hose 108A lowers locking ring 318. The scope of this disclosure is not limited to this convention, however.

Referring again momentarily to FIG. 2D, and again as described in more detail in the '279 Application, wellhead adapter 312 on fluid connection housing assembly 300 provides quick test fitting 401 via quick test port 402. Quick test fitting 401 may be pressurized with hydraulic fluid after fluid connection adapter 200A is engaged and locked into wellhead adapter 312 on fluid connection adapter assembly 300. In this way, pressure in the space between sealing rings may be equalized after the introduction of operational fluid flow. Conversely, quick test fitting 401 enables fluid trapped at pressure in the space between the sealing rings to be relieved after fluid flow has ended and fluid connection housing assembly 300 has been generally depressurized. In other applications, fluid delivered at pressure through quick test fitting 401 enables the integrity of the sealing rings to be checked prior to introducing operational fluid flow into the connection between fluid connection adapter 200A and wellhead adapter 312 on fluid connection housing assembly 300.

Looking now at FIG. 1B, hydraulic hose 108C on lower bank 105L of reels 106 is connected to quick test fitting 401 on fluid connection housing assembly 300. In this way, an operator at control unit 100 may deliver pressurized hydraulic fluid to quick test fitting 401 so as to remotely perform the actions described in the previous paragraph.

FIG. 1B further illustrates multi-core control cable 109 connected to bulkhead box 107 via multi-pin connector 110. Although not specifically illustrated, it will be understood that the displays, features and controls in and on control enclosure 120 are wired electrically to bulkhead box 107. In this way, connection of multi-pin connector 110 to bulkhead box 107 allows the various individual cores of multi-core control cable 109 to address corresponding displays, features and controls in and on control enclosure 120.

Figure 2A:
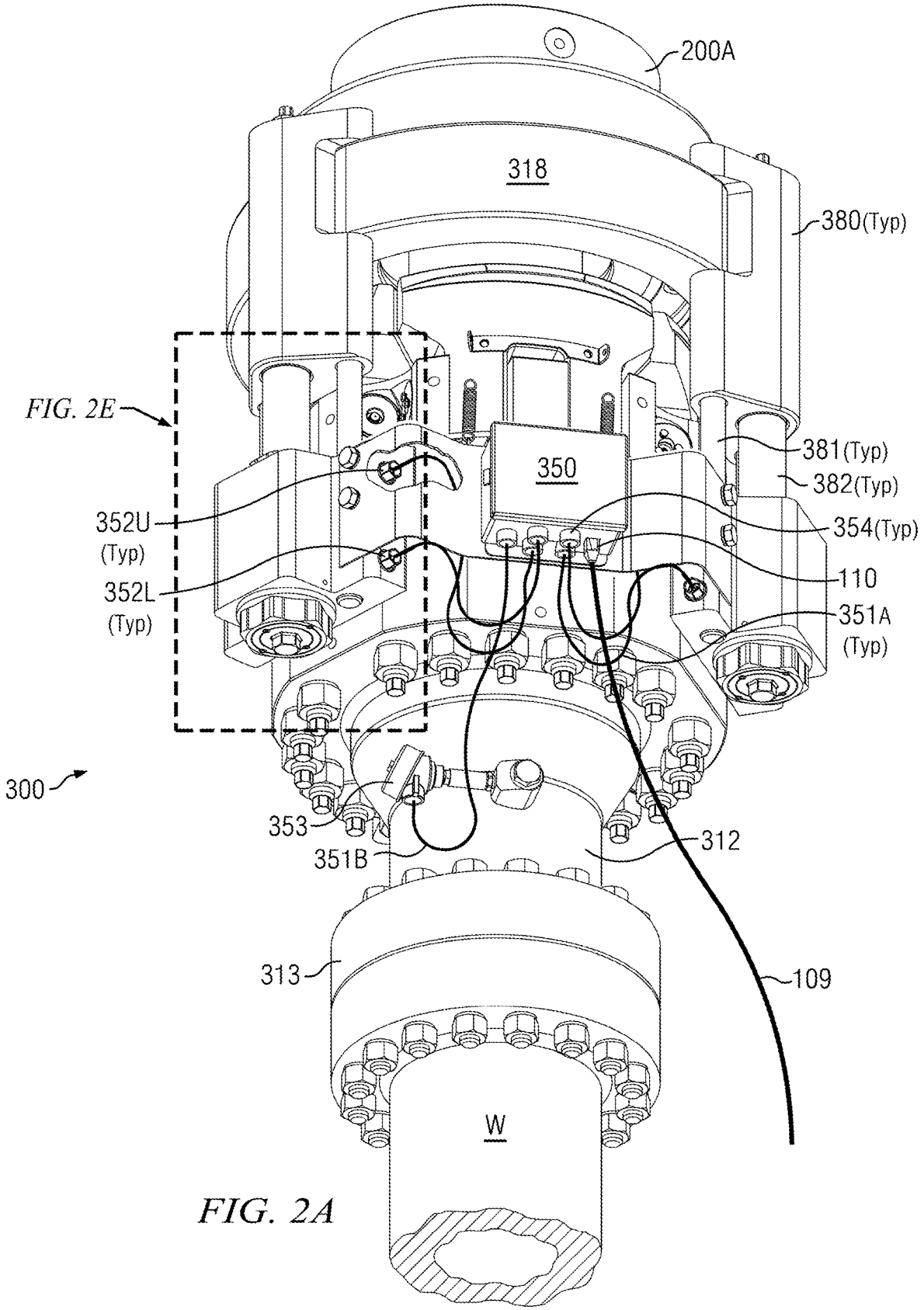
FIGS. 2A and 2B illustrate an embodiment of fluid connection housing assembly 300 generally disclosed in the '279 Application deployed with side sensor embodiments 352U, 352L from the instant application.

Referring now to FIG. 2A, for example, fluid connection housing assembly 300 provides junction box 350 for receiving multi-core control cable 109 via a further multi-pin connector 110. Junction box 350 enables the various individual cores of multi-core control cable 109 to address upper and lower side sensors 352U, 352L via sensor cables 351A. Grommets 354 seal the openings injunction box 350 for sensor cables 351A. Upper and lower side sensors 352U, 352L are described in more detail below, but are generally configured to activate when locking ring 318 is fully raised and lowered respectively. In this way, looking at FIGS. 1B and 2A together, multi-core control cable 109 connects upper and lower side sensors 352U, 352L to corresponding displays and features on control enclosure 120 on control unit 100. An operator at control unit 100 may thus monitor the positional status of locking ring 318 remotely.

FIG. 2A further depicts sensor cable 351B connecting junction box 350 to well pressure sensor 353. Well pressure sensor 353 is configured to sense the current pressure in wellhead adapter 312 on fluid connection housing assembly 300. In preferred embodiments, well pressure sensor 353 is a pressure transducer, although the scope of this disclosure is not limited in this regard. Junction box 350 allows multi-core control cable 109 to address well pressure sensor 353 via sensor cable 351B. In this way, looking at FIGS. 1B and 2A again together, multi-core control cable 109 connects well pressure sensor 353 to corresponding displays and features on control enclosure 120 on control unit 100. An operator at control unit 100 may thus monitor the current pressure in fluid connection housing assembly 300 remotely.

Figure 1C:
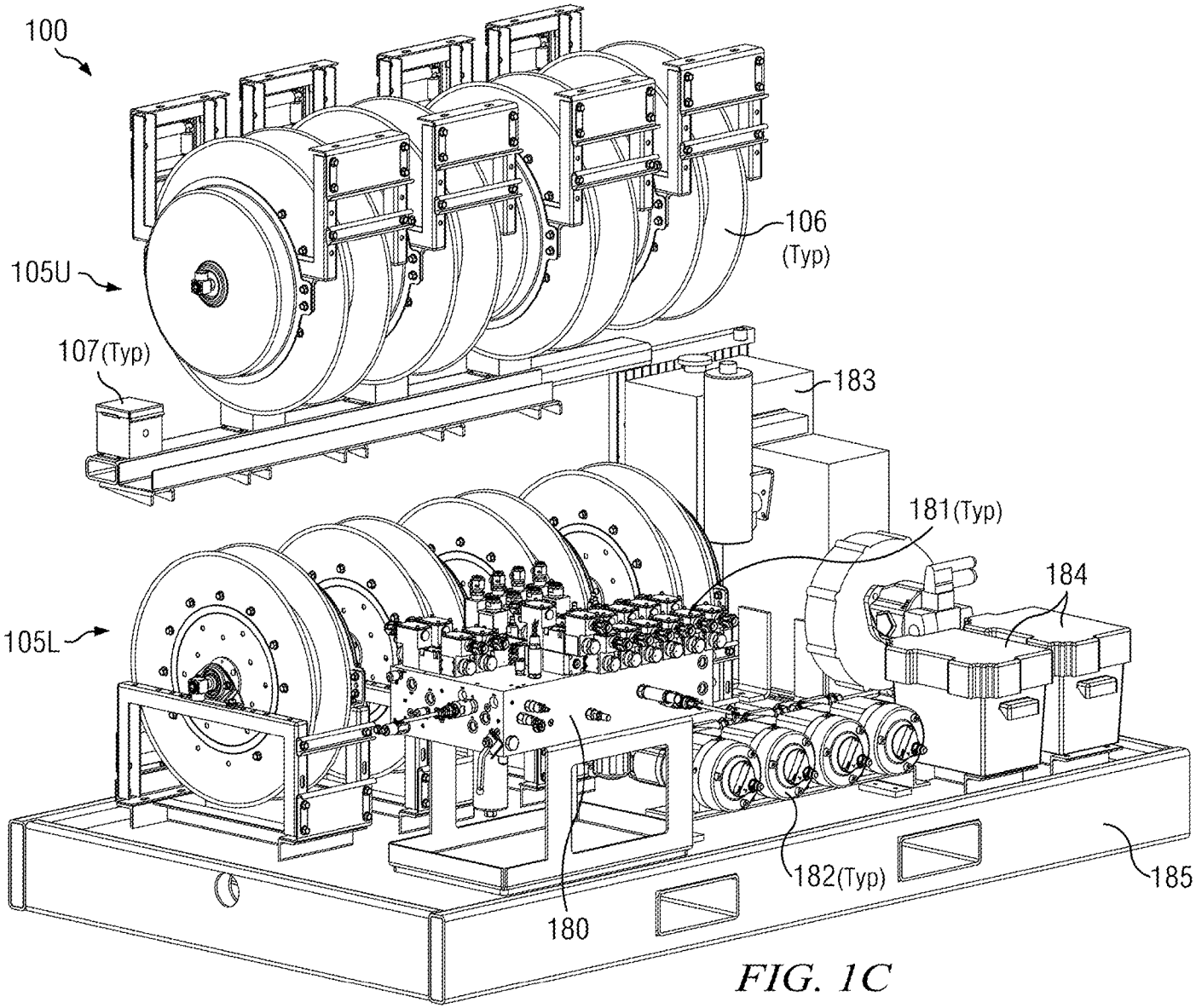
FIG. 1C illustrates the control unit 100 of FIG. 1A with frame 101 and control enclosure 120 removed for clarity.

FIG. 1C illustrates the control unit 100 of FIG. 1A with frame 101 and control enclosure 120 removed for clarity. FIG. 1C depicts skid 185, motor 183, batteries 184, bulkhead boxes 107 and reels 106 on upper and lower banks 105U, 105L as previously described. FIG. 1C further depicts electro-hydraulic module 180 with hydraulic valves 181 and hydraulic pumps 182. Although not specifically illustrated, it will be understood that electro-hydraulic control module 180 is in electrical communication with control enclosure 120 such that controls, features and displays in and on control enclosure 120 may address electro-hydraulic control module 180. In this way, an operator at the operator interface of control unit 100 may accomplish desired remote hydraulic operations by simply actuating a control on the operator interface. For example, per earlier description, the operator may actuate an operator interface control that in turn actuates selected ones of hydraulic pumps 182 and hydraulic valves 181 to pressurize hydraulic hose 108A and depressurize hydraulic hose 108B, which in turn raises locking ring 318 on a fluid connection housing assembly 300 remotely.

Figure 1D:
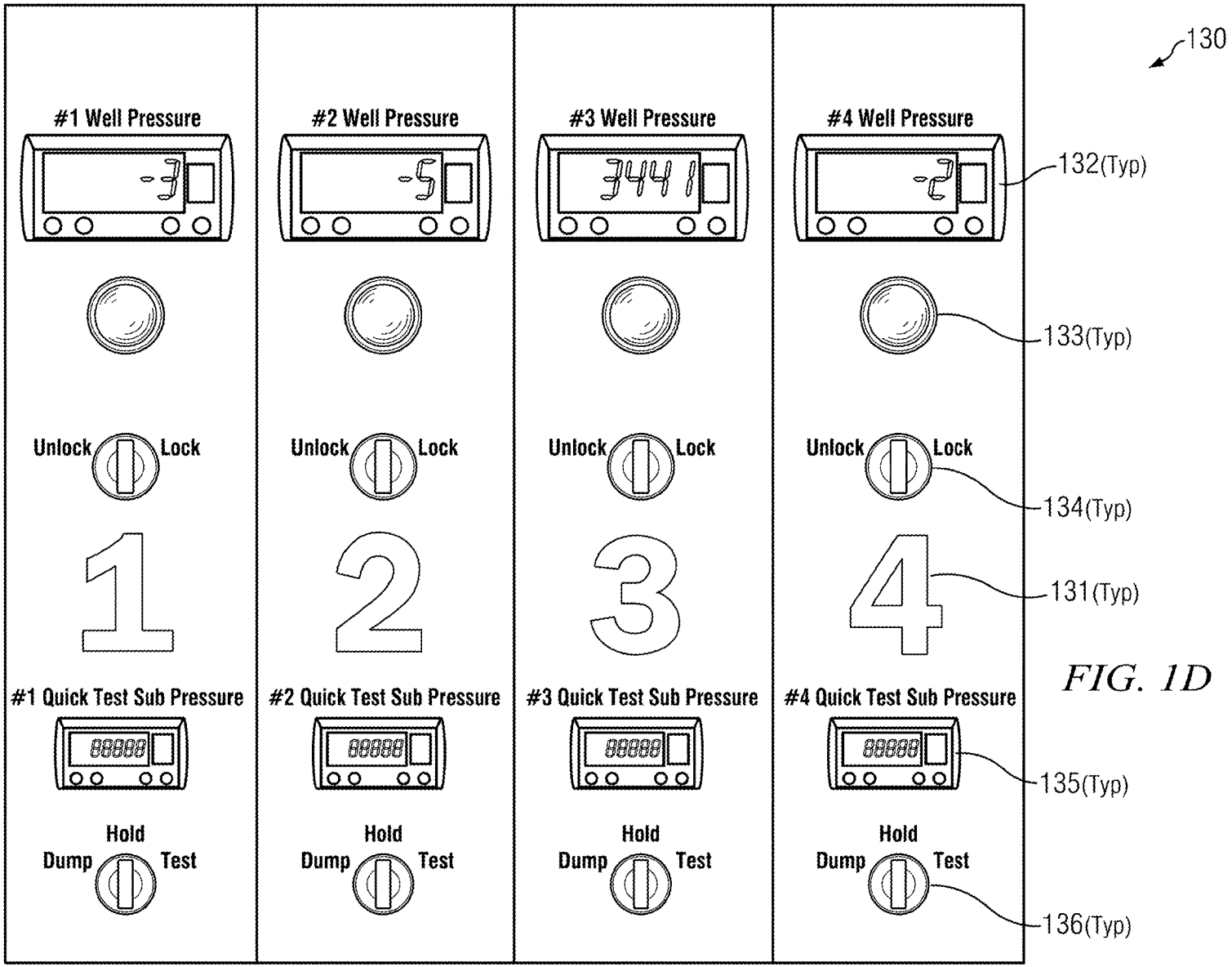
FIG. 1D is a first enlarged inset as shown on FIG. 1A.

FIG. 1D is a first enlarged inset as shown on FIG. 1A, and illustrates well control module 130 on control enclosure 120. As noted above, the embodiment of control unit 100 on FIG. 1A enables a remote operator to monitor status and exercise control over four (4) fluid connections independently and concurrently. Well number 131 on well control module 130 identifies to the operator which displays, features and controls on well control module 130 pertain to a corresponding remote fluid connection (and associated wellhead).

Well control module 130 further provides a well pressure display 132 for each well number 131. As previously described with reference to FIGS. 1B and 2A, in currently preferred embodiments well pressure display 132 is addressed by well pressure sensor 353 at the remote fluid connection housing assembly 300, and allows an operator at control unit 100 to monitor the current pressure in fluid connection housing assembly 300 remotely.

Well control module 130 on FIG. 1D further provides indicator light 133 and lock switch 134 for each well number 131. In some embodiments, lock switch 134 may be a spring-loaded switch. In some embodiments, lock switch 134 is disposed to selectively energize pressurization of either hydraulic hose 108A or hydraulic hose 108B. Turning lock switch 134 to the "lock" position (and keeping lock switch 134 turned to "lock") lowers the locking ring 318 on fluid connection housing assembly 300 via hydraulic actuation as previously described. Lowering locking ring 318 engages and locks fluid connection adapter 200A into fluid connection housing assembly. Conversely, turning lock switch 134 to the "unlock" position (and keeping lock switch 134 turned to "unlock") raises the locking ring 318 on fluid connection housing assembly 300, again via hydraulic actuation as previously described. Raising locking ring 318 unlocks fluid connection adapter 200A from fluid connection housing assembly and allows fluid connection adapter 200A to be disengaged.

It will be recalled from prior description that side sensors 352U, 352L are generally configured to activate when locking ring 318 on fluid connection housing assembly 300 is fully raised and lowered respectively. In some embodiments, indicator light 133 is disposed to be addressed by side sensors 352U, 352L such that lower side sensor 352L activates when the fluid connection housing assembly 300 is in a locked condition and upper side sensor 352U activates when fluid connection housing assembly 300 is in an unlocked condition. Generally, indicator light 133 illuminates differently according to a sensed condition detected by side sensors 352U, 352L wherein the sensed condition is from among at least two conditions selected from the group consisting of: (a) fluid connection housing assembly 300 is in the unlocked condition; (b) fluid connection housing assembly 300 is in the locked condition; (c) fluid connection housing assembly 300 is in transition from the locked condition to the unlocked condition or vice versa; and (d) the FCHA is in a fault condition during transition from the locked condition to the unlocked condition or vice versa.

More specifically in preferred embodiments, processing logic in control enclosure 120 is configured to cause indicator light 133 to illuminate according to a detected positional status of locking ring 318. In preferred embodiments, indicator light 133 illuminates green when side sensors 352U, 352L detect that ring 318 on fluid connection housing assembly 300 is fully lowered (retracted) such that fluid connection adapter 200A is engaged and locked into fluid connection housing assembly 300. It is safe to conduct operational fluid flow (or otherwise pressurize fluid connection housing assembly 300) in this "green" condition.

Conversely, indicator light 133 illuminates red when side sensors 352U, 352L detect that ring 318 on fluid connection housing assembly 300 is fully raised (extended) such that fluid connection adapter 200A is free to disengage from fluid connection housing assembly 300. It is not safe to commence operational fluid flow (or otherwise pressurize fluid connection housing assembly 300) in this "red" condition.

Additionally, indicator light 133 illuminates yellow (constant) when side sensors 352U, 352L detect that ring 318 on fluid connection housing assembly 300 is in transition from a fully raised (extended) position to a fully lowered (retracted) position and vice versa. Additionally, indicator light 133 illuminates yellow (flashing) when side sensors 352U, 352L detect a fault condition, such as when ring 318 on fluid connection housing assembly 300 is stuck (not moving) in transition from a fully raised (extended) position to a fully lowered (retracted) position and vice versa. It is not safe to commence operational fluid flow (or otherwise pressurize fluid connection housing assembly 300) in either of these "yellow" conditions.

It will be appreciated that although currently preferred embodiments of well module 130 on FIG. 1D illuminate indicator light 133 according to the above-described color-coded conditions, the scope of this disclosure is not limited in this regard. Other embodiments may illuminate indicator light 133 according to different color schemes driven by different processing logic.

Embodiments of control unit 100 described in this disclosure, including with reference to FIG. 1D, further provide alerts and fail-safe measures to promote jobsite safety. For example, in some embodiments control unit 100 is disposed to issue at least one user-perceptible alert selected from the group consisting of: (a) while side sensors 352U, 352L detect that FCHA 300 is in the locked condition, an alert that FCHA 300 is available to be pressurized; (b) while side sensors 352U, 352L detect that FCHA 300 is in the unlocked condition, an alert that FCHA 300 is unavailable to be pressurized; (c) while well pressure sensor 353 senses a current well pressure in excess of a predetermined maximum pressure value, an alert that the predetermined maximum pressure value has been exceeded; and (d) while side sensors 352U, 352L detect that FCHA 300 is in transition from (1) the locked condition to the unlocked condition, or (2) the unlocked condition to the locked condition, an alert that FCHA 300 is in transition. In preferred embodiments, the predetermined maximum pressure value is 15,000 psi, although the scope of this disclosure is not limited in this regard.

Embodiments of control unit 100 described in this disclosure, including with reference to FIG. 1D, further provide fail-safe measures including preventing pressurization of the hydraulic hose 108A (and raising locking ring 318) if side sensors 352U, 352L detect that FCHA 300 is in the locked condition and well pressure sensor 353 senses a current non-zero well pressure in FCHA 300.

Well control module 130 on FIG. 1D further provides quick test pressure display 135 and quick test operation switch 136 for each well number 131. It will be recalled from prior disclosure with reference to FIGS. 1B and 2D that quick test fitting 401 on fluid connection housing assembly 300 may be pressurized with hydraulic fluid after fluid connection adapter 200A is engaged and locked into wellhead adapter 312 in order to equalize pressure in the space between sealing rings. Pressurization of hydraulic hose 108C tests whether a pressure-tight connection has been established between sealing rings inside FCHA 300. Conversely, quick test fitting 401 enables fluid trapped at pressure in the space between the sealing rings to be relieved after fluid connection housing assembly 300 has been generally depressurized. Fluid delivered at pressure through quick test fitting 401 further enables the integrity of the sealing rings to be checked prior to introducing operational fluid flow into the connection between fluid connection adapter 200A and wellhead adapter 312. Generally stated, therefore, control unit 100 provides hydraulic hose 108C disposed to be connected to quick test fitting 401 such that pressurization of hydraulic hose 108C tests whether a pressure-tight connection has been established between sealing rings inside the fluid connection housing assembly 300. Control unit 100 further provides quick test pressure display 135 disposed to communicate current pressure in hydraulic hose 108C. Control unit 100 further provides quick test operation switch 136 disposed to selectively energize a quick test function selected from the group consisting of: (a) energizing pressurization of hydraulic hose 108C; (b) holding current pressure in hydraulic hose 108C; and (c) energizing depressurization of hydraulic hose 108C.

More specifically with reference to currently preferred embodiments illustrated on FIG. 1D, turning quick test operation switch 136 to the "test" position (and keeping switch 136 in the "test" position) delivers hydraulic fluid to quick test connect fitting 401 via hydraulic hose 108C as previously described, and causes pressure to increase gradually in the space between sealing rings inside fluid connection housing assembly 300. Quick test pressure display 135 on FIG. 1D allows the operator to monitor the pressure as it increases. When a desired pressure between sealing rings is reached, turning quick test operation switch 136 to the "hold" position halts the increase in pressure while the operator watches quick test pressure display 136 for any pressure decay. If there is decay, the operator knows that fluid connection adapter 200A may not be seated properly inside fluid connection housing assembly 300 and that corrective action must be taken before operational fluid flow can commence. If there is no decay, the operator knows that the space between sealing rings inside fluid connection housing assembly is pressure-tight and ready to receive operational fluid flow. Once fluid flow has ended, turning quick test operation switch 136 to the "dump" position (and keeping switch 136 in the "dump" position) allows the operator to relieve hydraulic fluid pressure in the space between sealing rings.

Figure 1E:
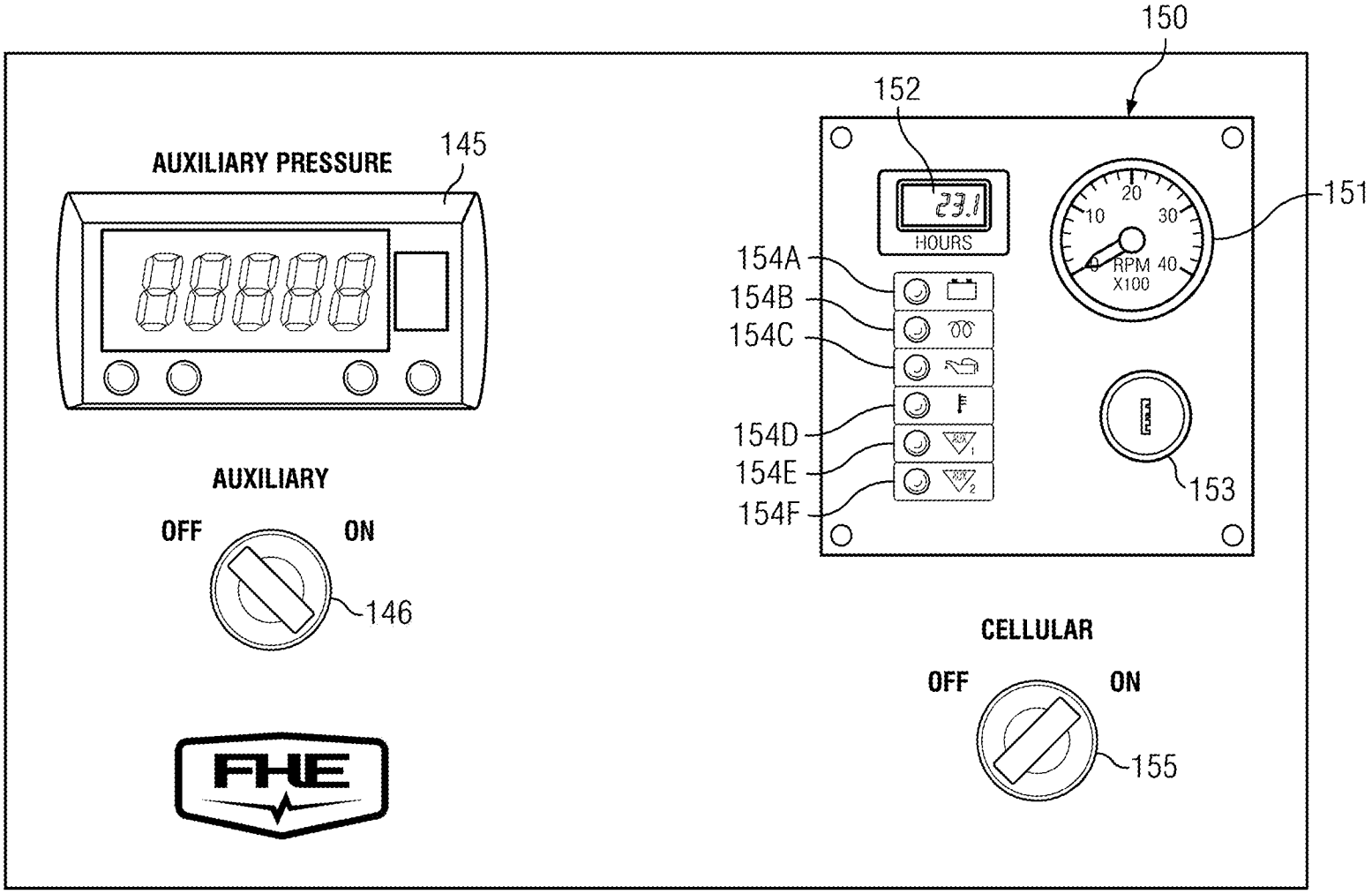
FIG. 1E is a second enlarged inset as shown on FIG. 1A.

FIG. 1E is a second enlarged inset as shown on FIG. 1A, and illustrates auxiliary pressure display 145, auxiliary pressure switch 146, motor status display 150 and cellular broadcast switch 155 on control enclosure 120. Some embodiments of control unit 100 provide an auxiliary pressurized hydraulic fluid "take-off" option via a separate hydraulic hose connection. In such embodiments, an operator at control unit 100 may actuate such auxiliary fluid delivery by actuating auxiliary pressure switch 146. When such auxiliary fluid delivery is enabled, the operator may monitor the pressure of such auxiliary fluid delivery via auxiliary pressure display 146.

Motor status display 150 on FIG. 1E allows an operator at control unit 100 to monitor the status of motor 183 on FIGS. 1B and 1C. As noted in earlier description, motor 183 is preferably a diesel engine in illustrated portable embodiments of control unit 100. Accordingly, motor display 150 on FIG. 1E provides features allowing an operator to monitor the status of a diesel engine. Motor display 150 comprises tachometer 151, hours display 152 (indicating total hours run by the diesel engine), electrical power and starter key lock 153 and engine indicator lights 154A though 154F. In the illustrated embodiment of motor display 150 on FIG. 1E, engine indicator lights comprise battery status 154A, glow plug status 154B, oil pressure status 154C, coolant temperature status 154D, auxiliary 1 status 154E and auxiliary 2 status 154F.

Cellular broadcast switch 155 on FIG. 1E allows the operator to activate and deactivate broadcast of control unit 100's current status over a cellular network connection. The cellular network connection enables, for example, an offsite operations center to monitor multiple concurrent well operations and well status potentially far away from control unit 100. This cellular broadcast function is described in more detail below with reference to FIG. 1G.

Figure 1F:
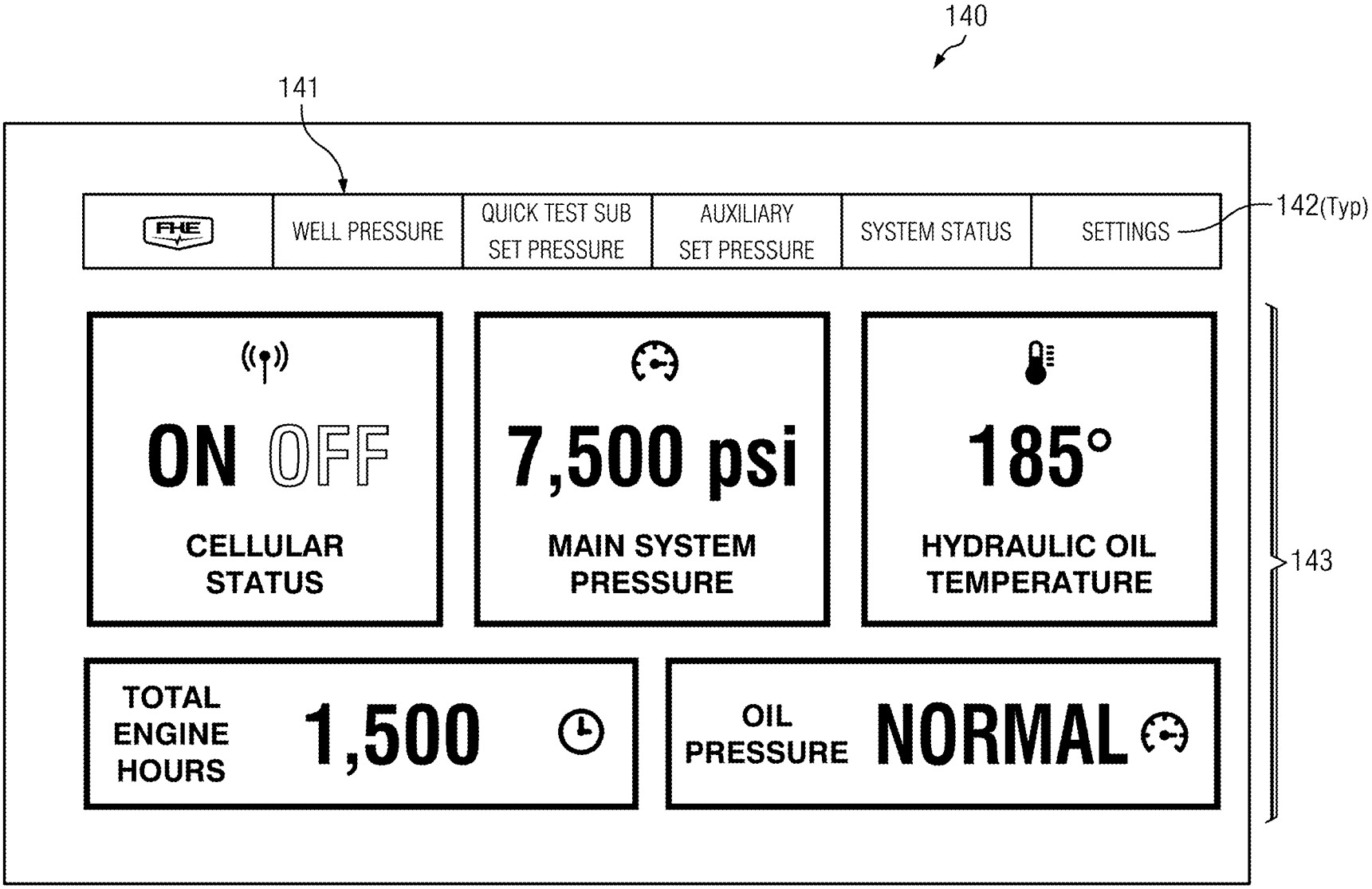
FIG. 1F is a third enlarged inset as shown on FIG. 1A.

FIG. 1F is a third enlarged inset as shown on FIG. 1A, and illustrates interactive touch display 140 on control unit 100. In some embodiments, interactive touch display 140 may also be referred to as a "Human Machine Interface" or "HMI". In currently preferred embodiments, interactive touch display 140 provides a touch-enabled menu bar 141. An operator may select menu items 142 on menu bar 141 by touch. Information and data relating to the selected menu item 142 is then displayed on display region 143. In the example illustrated on FIG. 1F, an operator has selected "System Status" menu item 142 from menu bar 141. In response, display region 143 shows system status information and data. The system status information and data shown on display region 143 on FIG. 1F is self-explanatory. If the operator selects a different menu item 142 from menu bar 141, display region 143 refreshes to display different information and data pertinent to the menu item 142 selected. It will be appreciated that illustrated embodiments of interactive touch display 140 on FIG. 1F are exemplary only, and that the scope of this disclosure is not limited to the specific menu items 142 shown on menu bar 141, or the information and data that display region 143 will display responsive to selection of any particular menu item 142.

Figure 1G:
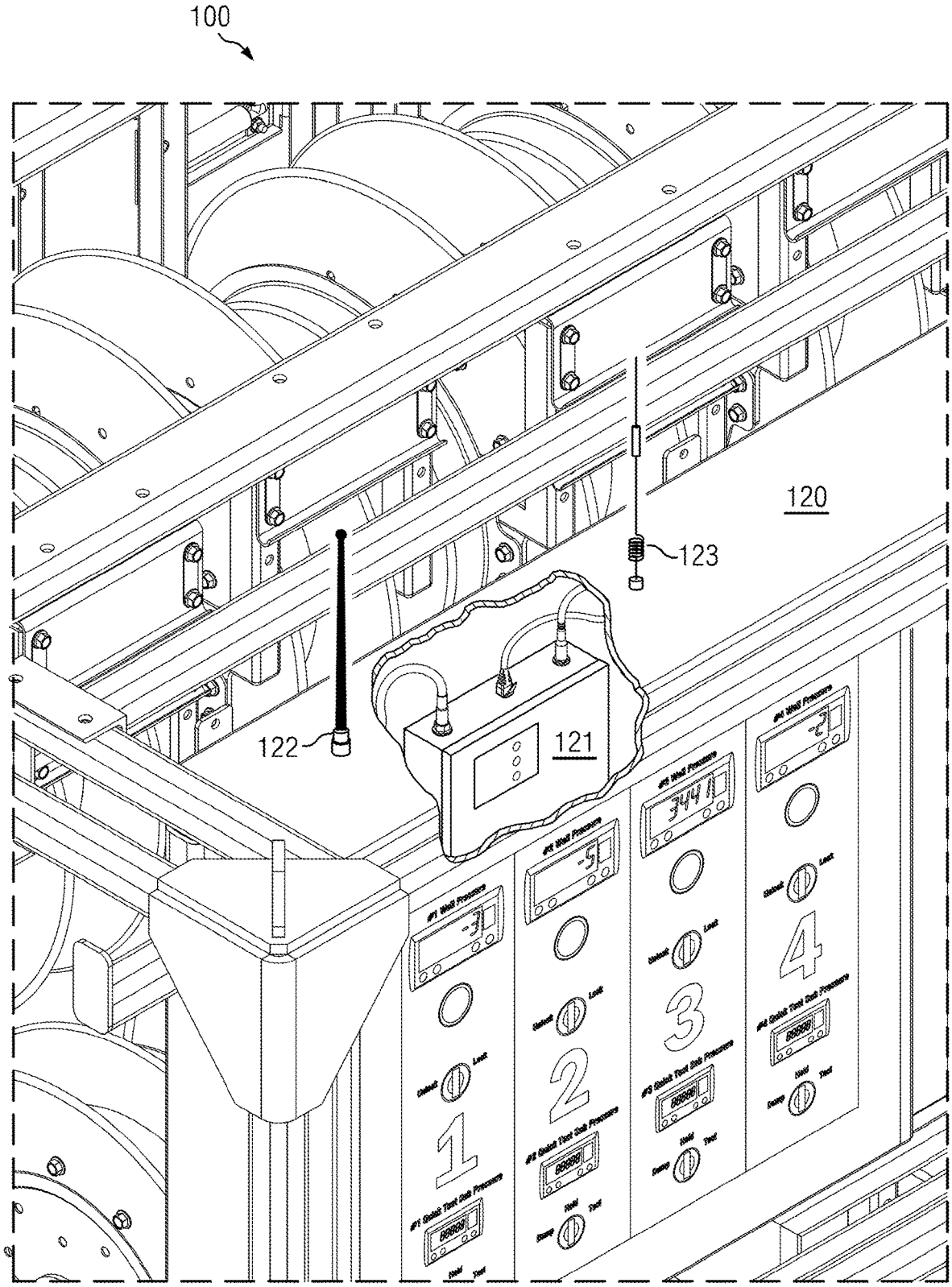
FIG. 1G is a fourth enlarged inset as shown on FIG. 1A.

FIG. 1G is a fourth enlarged inset as shown on FIG. 1A, and illustrates cellular/location broadcast module 121 inside control enclosure 120 on control unit 100. Referring momentarily back to description above with reference to FIG. 1E, currently preferred embodiments of control unit 100 allow an operator to activate and deactivate cellular/location broadcast module 121 via cellular broadcast switch 155. Generally, cellular/location broadcast module 121 is operatively connected to at least one broadcast antenna, wherein cellular/location broadcast module 121 is disposed to transmit information regarding control unit 100's status via the at least one broadcast antenna, wherein the at least one broadcast antenna includes at least one antenna selected from the group consisting of (a) cellular antenna 123 and (b) satellite antenna 122. As shown in more detail on FIG. 1G, cellular/location broadcast module 121 is equipped with satellite antenna 122 and cellular antenna 123. As described above, cellular antenna 123 enable cellular/location broadcast module 121 to broadcast information regarding control unit 100's status to, for example, an offsite computer or operations center. The offsite computer or operations center may monitor multiple concurrent well operations and well status potentially far away from control unit 100. Alternatively, the offsite computer or operations center may accumulate control unit status data for later analysis.

Cellular/location broadcast module 121 on FIG. 1G also provides satellite antenna 122. In currently preferred embodiments, an operator may activate cellular/location broadcast module 121 to send control unit 100's current location via GPS to an offsite control center, for example. Satellite antenna 122 enables transmission of control unit 100's current location via GPS. Satellite antenna 122 may also broadcast information regarding control unit 100's status to, for example, an offsite computer or operations center when cellular network coverage is poor (or nonexistent), or when cellular transmission is prohibited. Cellular data transmission is generally preferable over satellite transmission when cellular is available. Cellular data transfer rates are generally higher.

FIGS. 2A through 3D illustrate embodiments of fluid connection adapter 200A as received inside fluid connection housing assembly 300 generally in accordance with the '279 Application, except that such illustrated embodiments on FIGS. 2A through 3D also include actuation and sensor features from the instant application. The '279 Application is incorporated by reference into the instant application in its entirety. The reader interested in understanding detailed interoperation of fluid connection adapter 200A received into fluid connection housing assembly 300 as depicted on FIGS. 2A though 2D should refer to the '279 Application. The instant application assumes a general understanding of such interoperation. The instant application uses the same part names and part numbers as the '279 Application wherever practical when referring to items described in both the '279 Application and the instant application.

Figure 2B:
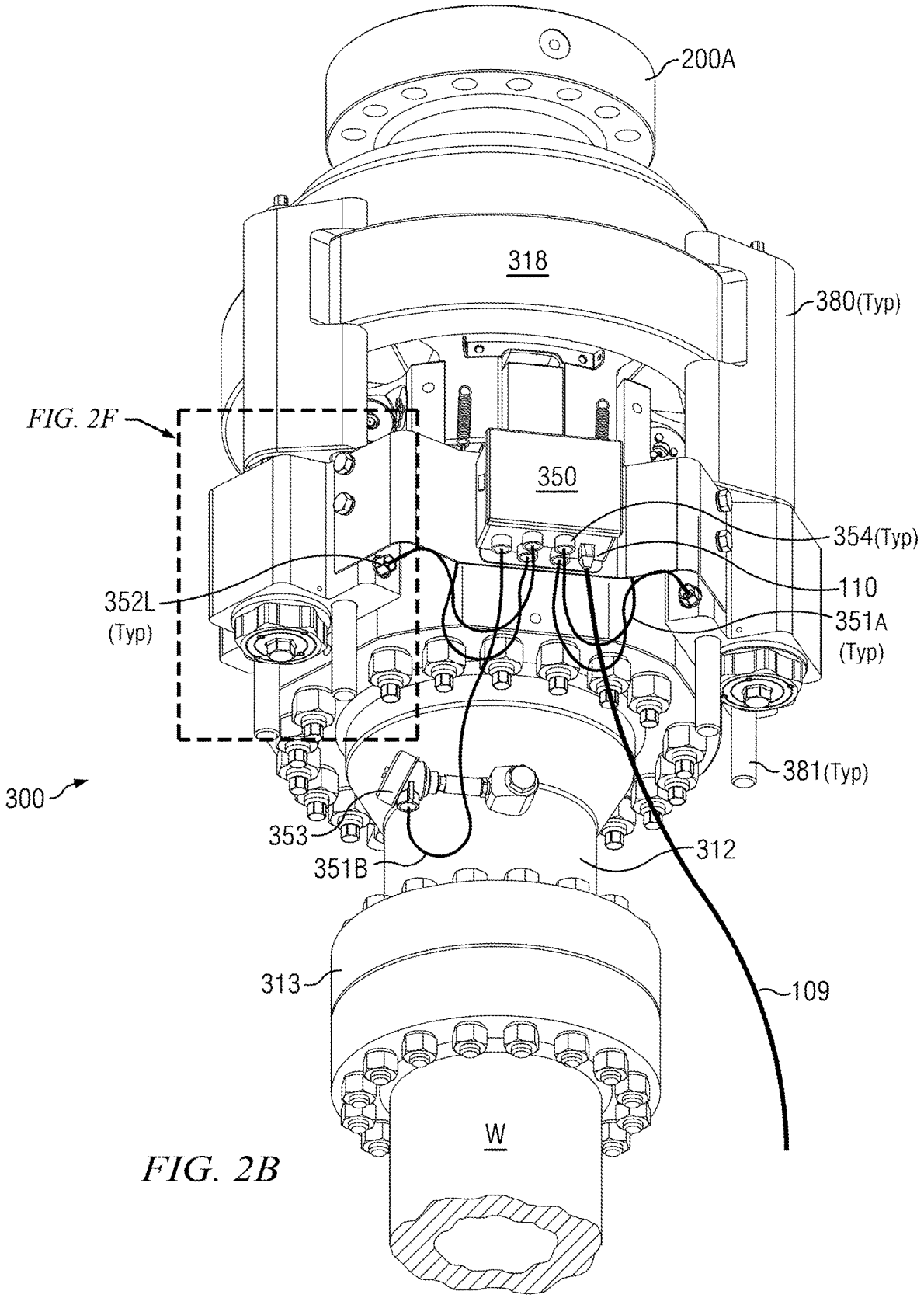

FIGS. 2A and 2B illustrate an embodiment of fluid connection housing assembly 300 generally disclosed in the '279 Application deployed with side sensor embodiments 352U, 352L from the instant application. Referring first to FIG. 2A, fluid connection housing assembly 300 is in fluid communication with wellhead W via flanged connection 313. Actuator assemblies 380 on FIG. 2A present actuator pistons 382 in an extended position such that locking ring 318 is in the fully "raised" or "extended" position. Fluid connection housing assembly on FIG. 2A is thus in an "open" or "unlocked" condition, such that fluid connection adapter 200A is free to disengage from fluid connection housing assembly 300.

Fluid connection housing assembly 300 on FIG. 2A further provides junction box 350. As also described above with reference to FIG. 1B, junction box 350 receives multi-core control cable 109 from control unit 100. Multi-core control cable 109 connects to junction box 350 via multi-pin connector 110. Junction box 350 enables the various individual cores of multi-core control cable 109 to address upper and lower side sensors 352U, 352L via sensor cables 351A. Grommets 354 seal the openings in junction box 350 for sensor cables 351A. Upper and lower side sensors 352U, 352L are described in more detail immediately below with reference to FIGS. 2E and 2F, but are generally configured to activate when locking ring 318 is fully raised and lowered respectively.

FIG. 2B is a similar illustration to FIG. 2A, except that actuator assemblies 380 on FIG. 2B present actuator pistons 382 in a retracted position such that locking ring 318 is in the fully "lowered" or "retracted" position. Fluid connection housing assembly on FIG. 2A is thus in a "closed" or "locked" condition, such that fluid connection adapter 200A is engaged and locked inside fluid connection housing assembly 300.

Figure 2C:
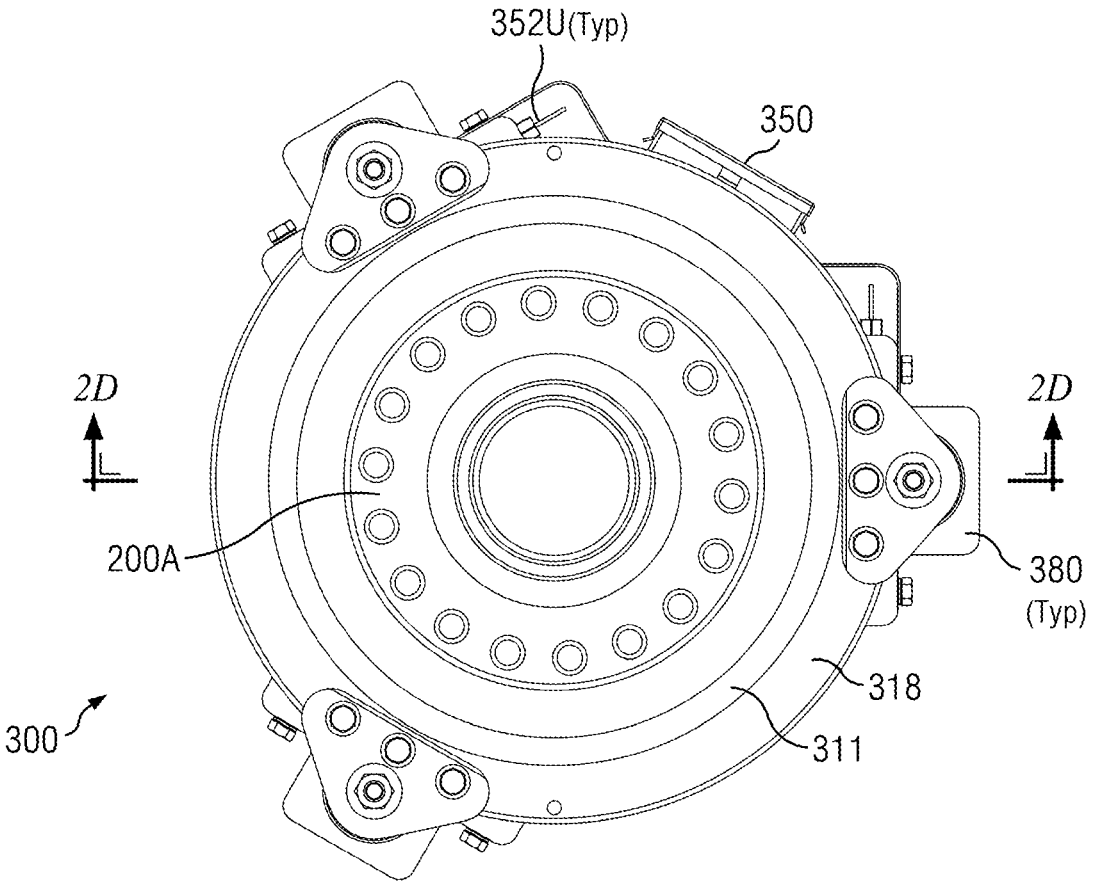
FIG. 2C is a top view of the embodiment depicted on FIG. 2B.
Figure 2D:
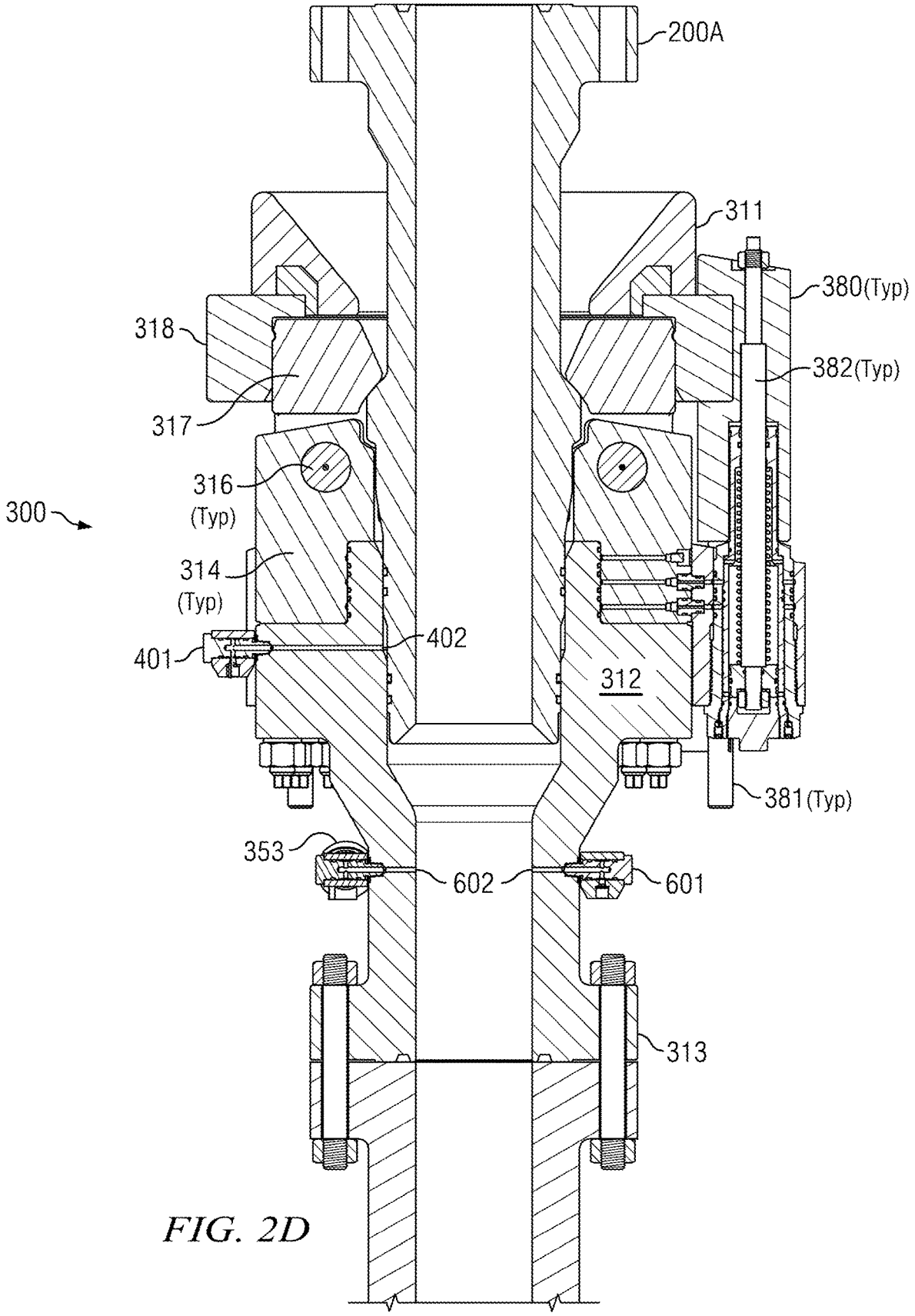
FIG. 2D is a section as shown on FIG. 2C.
Figure 2E:
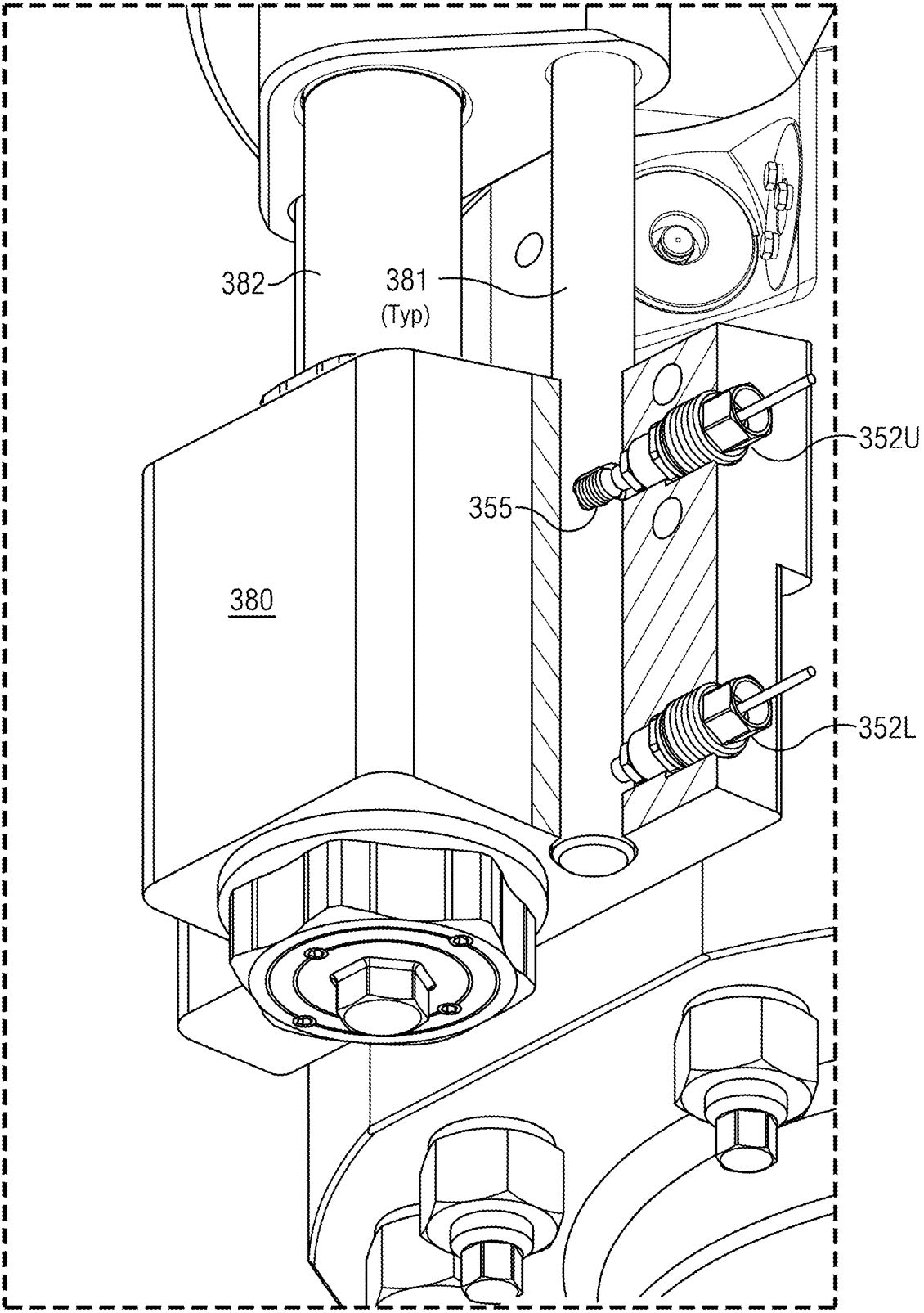
FIGS. 2E and 2F are enlarged insets as shown on FIGS. 2A and 2B respectively.
Figure 2F:
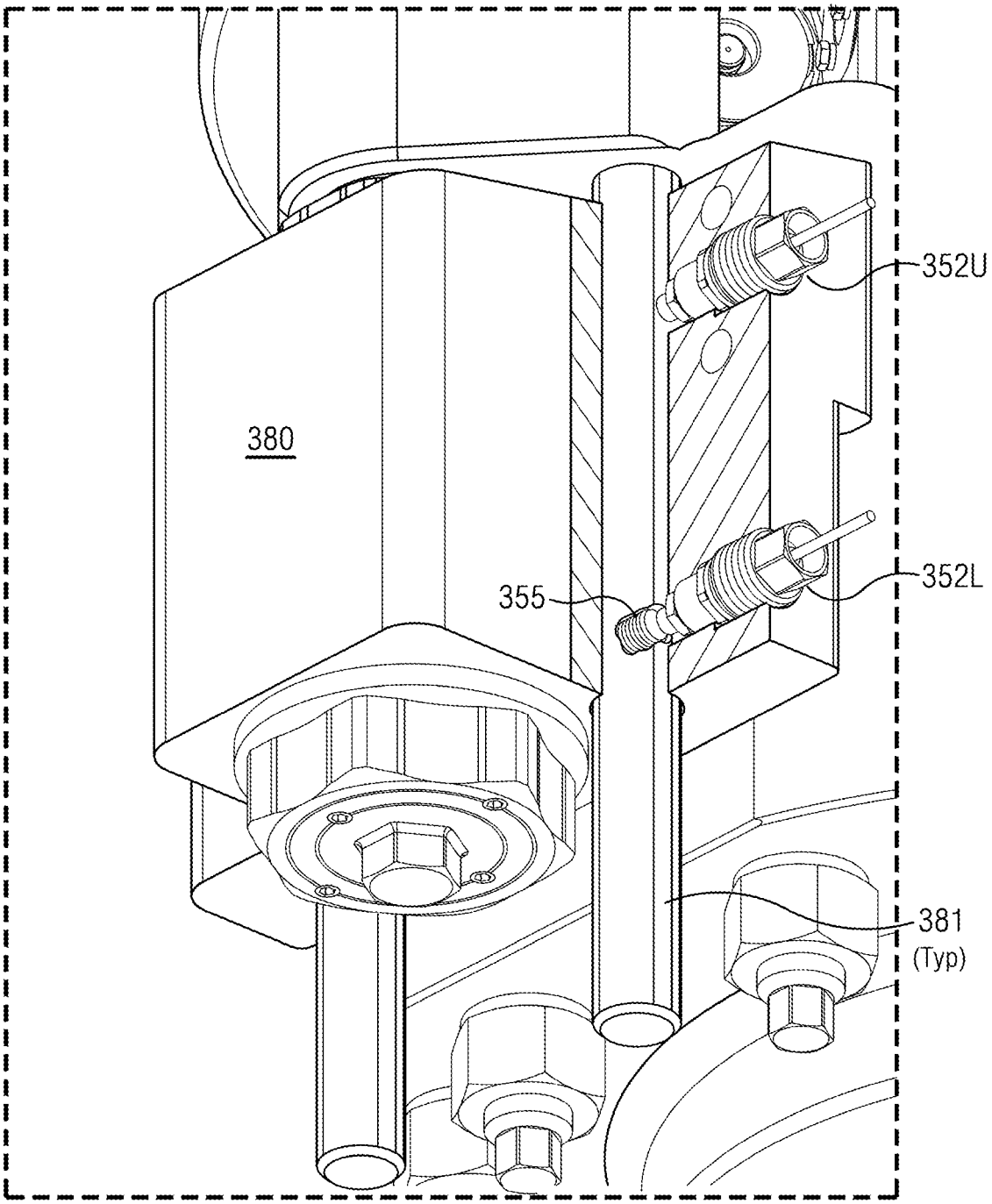

FIGS. 2E and 2F are enlarged insets as shown on FIGS. 2A and 2B respectively. FIG. 2E illustrates actuator assembly 380 on FIG. 2A cut away to reveal upper and lower side sensors 352U, 352L interacting with side sensor activator 355 on guide rod 381. It will be recalled from above that actuator assemblies 380 on FIG. 2A present actuator pistons 382 in an extended position such that locking ring 318 is in the fully "raised" or "extended" position. FIG. 2E shows that side sensor activator 355 is positioned on guide rod 381 so that upper side sensor 352U detects the presence of side sensor activator 355 when actuator piston 382 is in an extended position such that locking ring 318 is in a fully raised or extended position.

Similar to FIG. 2E, FIG. 2F illustrates actuator assembly 380 on FIG. 2B cut away to reveal upper and lower side sensors 352U, 352L interacting with side sensor activator 355 on guide rod 381. It will be recalled from above that actuator assemblies 380 on FIG. 2B present actuator pistons 382 in a retracted position such that locking ring 318 is in the fully "lowered" or "retracted" position. FIG. 2F shows that side sensor activator 355 is positioned on guide rod 381 so that lower side sensor 352L detects the presence of side sensor activator 355 when actuator piston 382 is in a retracted position such that locking ring 318 is in a fully lowered or retracted position. In currently preferred embodiments, upper and lower side sensors 352U, 352L are magnetic sensors. In such magnetic sensor embodiments, guide rods 381 on which side sensor activator 355 is deployed are preferably made from a non-ferrous material such as stainless steel, and side sensor activator 355 is a ferrous portion in the stainless steel guide rod 381 (such as a ferrous steel grub screw or rivet). The scope of this disclosure is not limited, however, to the type of sensor deployed for upper and lower side sensors 352U, 3521L or the manner in which the side sensors are activated.

FIGS. 2A and 2B each depict currently preferred embodiments of fluid connection housing assembly 300 providing two (2) guide rods 381 addressed by upper and lower side sensors 352U, 352L. The guide rods 381 addressed by upper and lower side sensors 352U, 352L are preferably positioned either side of junction box 350 to optimize the length of side sensor cables 351A. Two (2) guide rods 381 are configured to be addressed by upper and lower side sensors 352U, 352L in order to provide redundancy in case of sensor failure. It will be understood that such redundancy enables an operator at control unit 100 to perceive that a fault condition may have occurred when a side sensor 352U, 352L on one guide rod 381 activates and a corresponding side sensor on the other guide rod 381 does not. The scope of this disclosure, however, is not limited to any embodiments including specific guide rod and sensor redundancy.

It will be further recalled from above that in currently preferred magnetic sensor embodiments, guide rods 381 on which side sensor activator 355 is deployed are preferably made from a non-ferrous material such as stainless steel. In such magnetic sensor embodiments, guide rods 381 not addressed by upper and lower side sensors 352U, 352L may be made from a more conventional material, such as carbon steel.

FIGS. 2A and 2B each further show well pressure sensor 353 configured to sense the current pressure in wellhead adapter 312 on fluid connection housing assembly 300. FIGS. 2A and 2B further depict sensor cable 351B connecting junction box 350 to well pressure sensor 353. Junction box 350 allows multi-core control cable 109 from control unit 100 to address well pressure sensor 353 via sensor cable 351B. As noted above, well pressure sensor 353 is a pressure transducer in preferred embodiments, although the scope of this disclosure is not limited in this regard.

FIG. 2C is a top view of the embodiment of fluid connection housing assembly 300 depicted on FIG. 2B. FIG. 2D is a section as shown on FIG. 2C. FIG. 2D illustrates well pressure sensor 353 connected to needle valve 601 resident in transducer port 602 in wellhead adapter 312. In the embodiment of fluid connection housing assembly 300 illustrated on FIG. 2D, wellhead adapter 312 provides a second needle valve 601 in a second transducer port 602. In such embodiments, second needle valve 601 and second transducer port 602 may provide redundancy for well pressure sensor 353 in case of damage, for example, to the original valve or port 601, 602. Alternatively, second needle valve 601 and second transducer port 602 may be used to drain/equalize pressure within wellhead adapter 312 during service operations when, for example, fluid connection adapter 200 is being removed and fluid connection housing assembly 300 is being exposed to atmospheric pressure. Alternatively, second transducer port 602 may receive a local pressure gauge allowing well pressure inside wellhead adapter 312 to be monitored from nearby the wellhead. The scope of this disclosure is not limited to particular uses for transducer ports 602 or equipment deployed therein.

FIG. 2D further illustrates fluid connection housing assembly 300 providing quick test fitting 401 connected to quick test port 402. Control, testing and monitoring of pressurization and depressurization operations by control unit 100 through quick test fitting 401 is described in detail above with reference to FIGS. 1B and 1D.

Figure 3A:
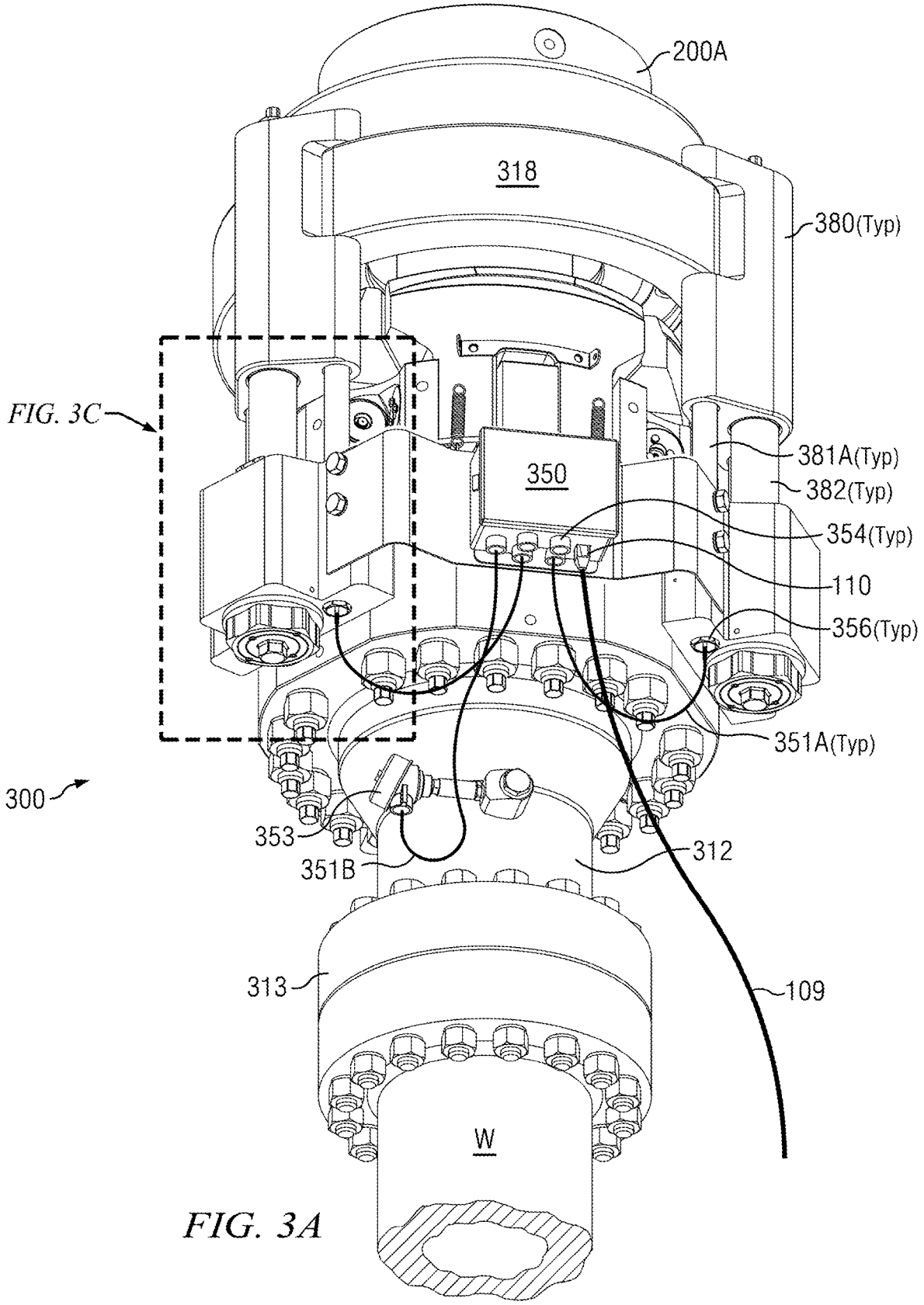
FIGS. 3A and 3B illustrate an embodiment of fluid connection housing assembly 300 generally disclosed in the '279 Application deployed with under sensor embodiments 356 from the instant application.
Figure 3B:
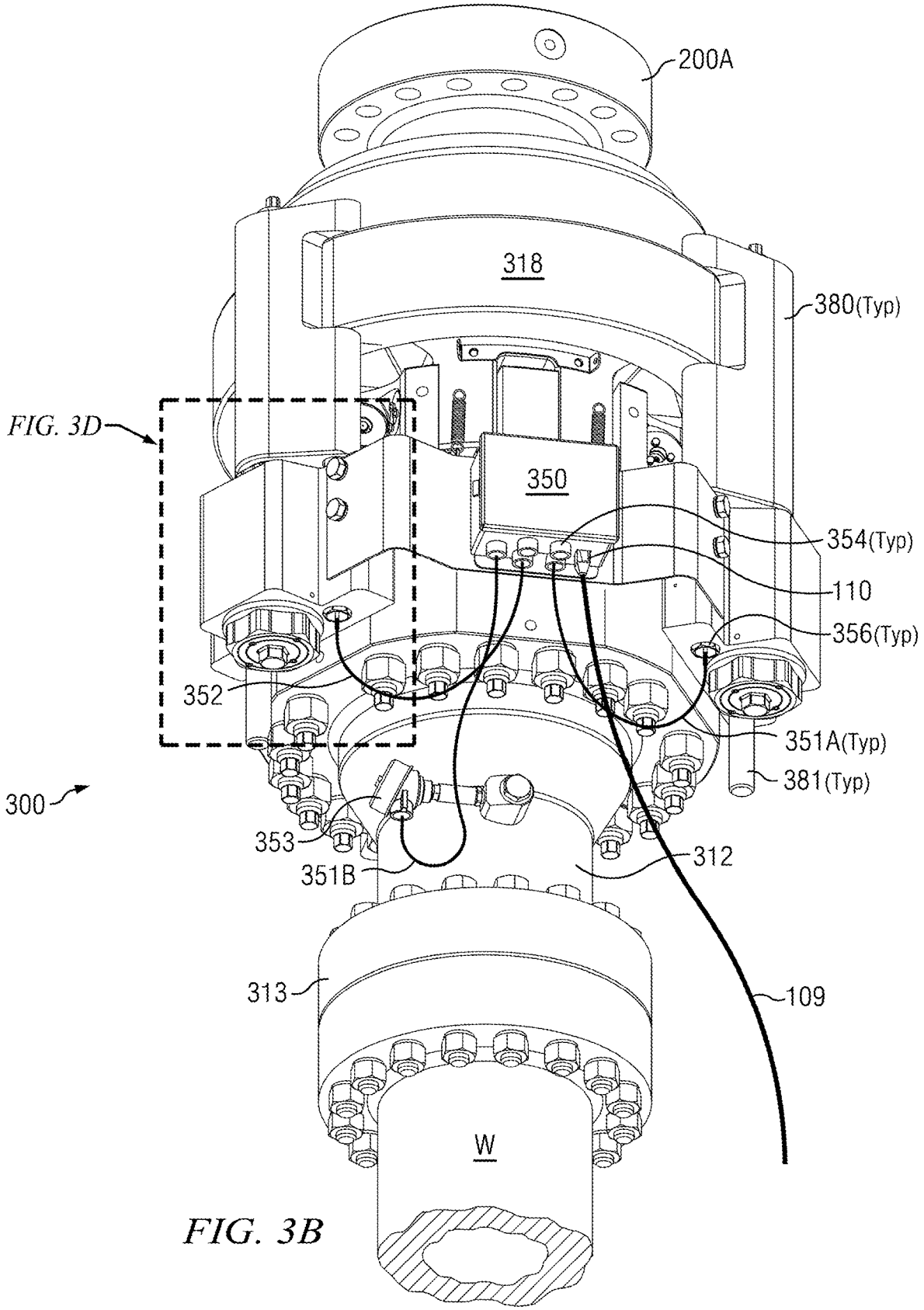

FIGS. 3A and 3B illustrate a further embodiment of fluid connection housing assembly 300 generally disclosed in the '279 Application deployed with under sensor embodiments 356 from the instant application. FIGS. 3A and 3B are similar illustrations to FIGS. 2A and 2B, except that actuator assemblies 380 on FIGS. 3A and 3B provide under sensors 356 instead of upper and lower side sensors 352U, 352L on FIGS. 2A and 2B.

Figure 3C:
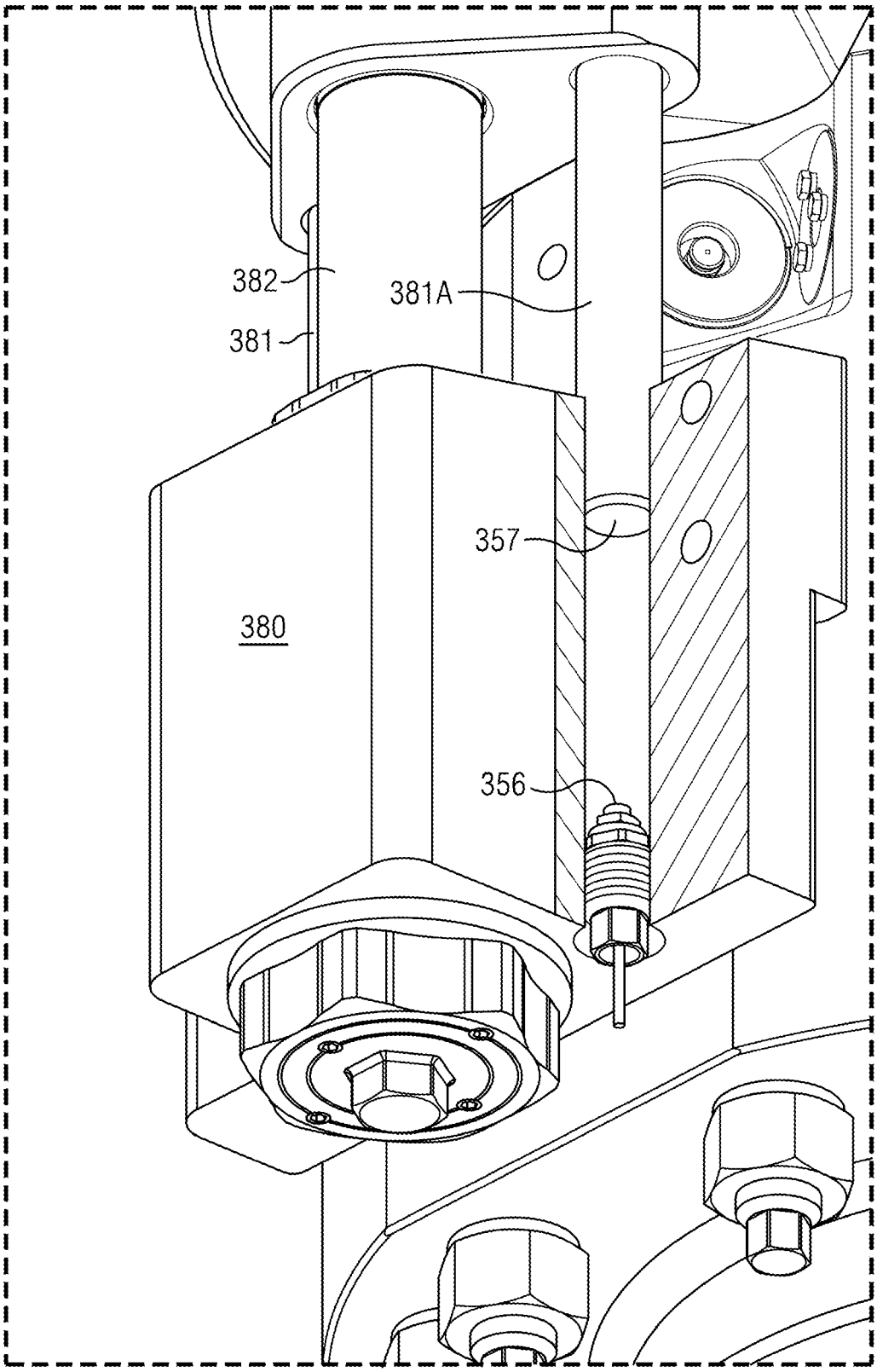
FIGS. 3C and 3D are enlarged insets as shown on FIGS. 3A and 3B respectively.
Figure 3D:
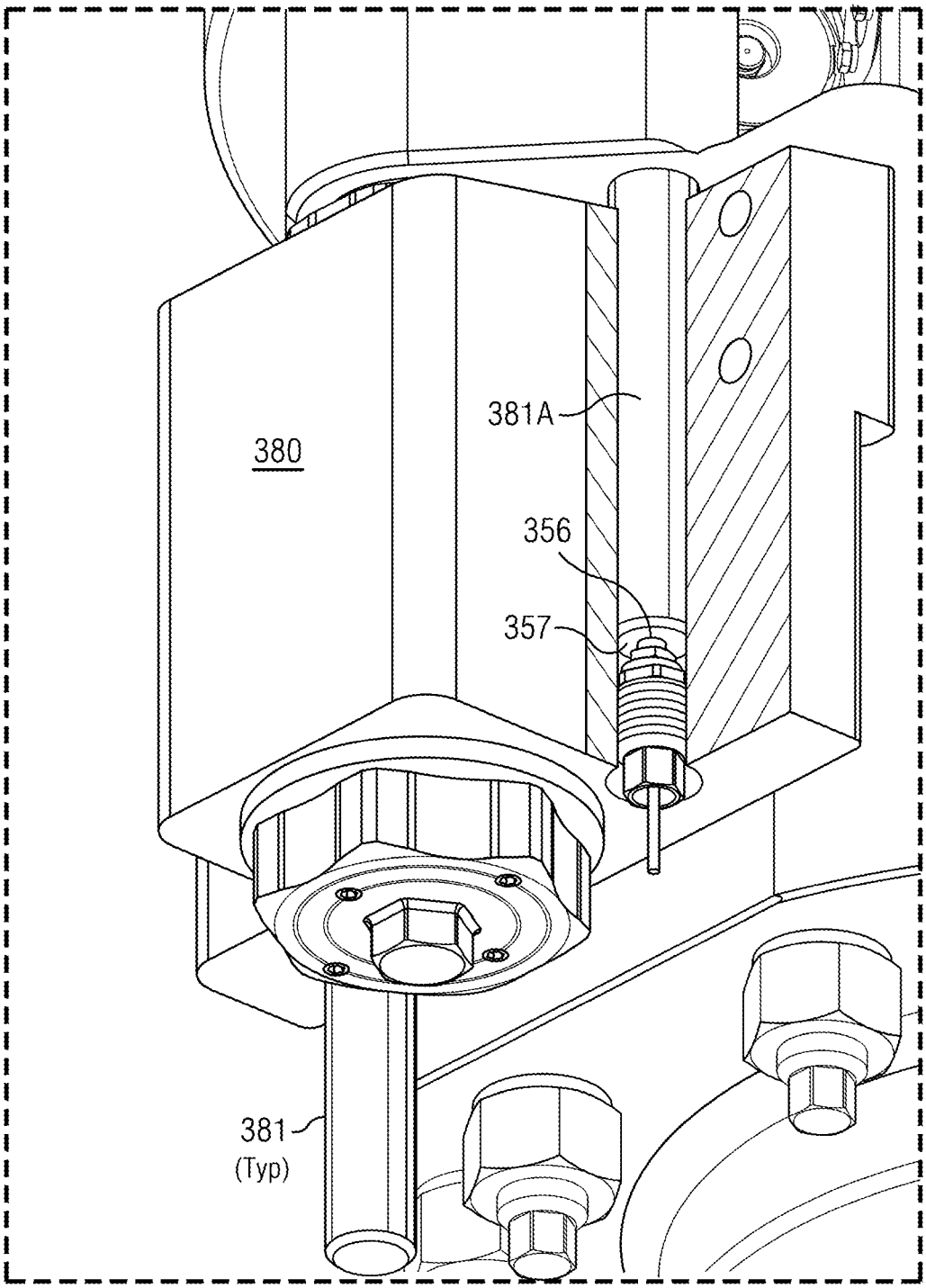

FIGS. 3C and 3D are enlarged insets as shown on FIGS. 3A and 3B respectively. FIG. 3D illustrates actuator assembly 380 on FIG. 3B cut away to reveal under sensor 356 interacting with under sensor activator 357 on short guide rod 381A. It will be understood that similar to FIG. 2B, actuator assemblies 380 on FIG. 3B present actuator pistons 382 in a retracted position such that locking ring 318 is in the fully "lowered" or "retracted" position. FIG. 3D shows that under sensor activator 357 is positioned on the lower end of short guide rod 381A so that under sensor 356 detects the presence of under sensor activator 357 when actuator piston 382 is in a retracted position. It will be further understood that the length of short guide rod 381A is selected so as to bring under sensor activator 357 within detection range of under sensor 356 when actuator pistons 382 are in a retracted position such that locking ring 318 is in the fully "lowered" or "retracted" position.

Similar to FIG. 3D, FIG. 3C illustrates actuator assembly 380 on FIG. 3A cut away to reveal under sensor 356 interacting with under sensor activator 357 on short guide rod 381A. It will be understood that similar to FIG. 2A, actuator assemblies 380 on FIG. 3A present actuator pistons 382 in an extended position such that locking ring 318 is in the fully "raised" or "extended" position. FIG. 3C shows that under sensor activator 357 is positioned on short guide rod 381A so that under sensor 356 is unable to detect the presence of under sensor activator 357 when actuator piston 382 is in an extended position such that locking ring 318 is in a fully raised or extended position. It will thus be appreciated that the embodiments illustrated on FIGS. 3A through 3D detect locking ring 318 in one of the following two states: either (1) in a fully lowered or retracted position, or (2) not in such a position. This is distinction to the embodiments illustrated on FIGS. 2A, 2B, 2E and 2F, which detect locking ring 318 in one of the following two states: either (1) in a fully lowered or retracted position, or (2) in a fully raised or extended position.

FIGS. 3A though 3D illustrate currently preferred embodiments illustrated in which under sensors 356 are magnetic sensors. In such magnetic sensor embodiments, short guide rods 381A on which under sensor activator 357 is deployed are preferably made from a non-ferrous material such as stainless steel, and under sensor activator 357 is a ferrous portion on the end of the stainless steel short guide rod 381A (such as a ferrous steel cap). Alternatively, short guide rods 381A may be all ferrous. The scope of this disclosure is not limited, however, to the type of sensor deployed for under sensor 356 or the manner in which the under sensors are activated. Further, "regular length' guide rods 381 on FIGS. 3A and 3B not addressed by under sensors 356 may be made from a more conventional material, such as carbon steel.

Similar to FIGS. 2A and 2B, FIGS. 3A and 3B each depict currently preferred embodiments of fluid connection housing assembly 300 providing two (2) short guide rods 381 addressed by under sensors 356. The short guide rods 381A addressed by under sensors 356 are preferably positioned either side of junction box 350 to optimize the length of side sensor cables 351A. Two (2) short guide rods 381A are configured to be addressed by under sensors 356 in order to provide redundancy in a similar manner, and for similar reasons, as for embodiments described above with reference to FIGS. 2A and 2B.

FIGS. 4A through 6G illustrate embodiments of adapter 250 as received inside pressure control assembly 200 generally in accordance with the '990 Application, except that such illustrated embodiments on FIGS. 4A through 6G also include actuation and sensor features from the instant application. The '990 Application is incorporated by reference into the instant application in its entirety. The reader interested in understanding detailed interoperation of adapter 250 received into pressure control assembly 200 as depicted on FIGS. 4A though 6G should refer to the '990 Application. The instant application assumes a general understanding of such interoperation. The instant application uses the same part names and part numbers as the '990 Application wherever practical when referring to items described in both the '990 Application and the instant application.

Figure 4A:
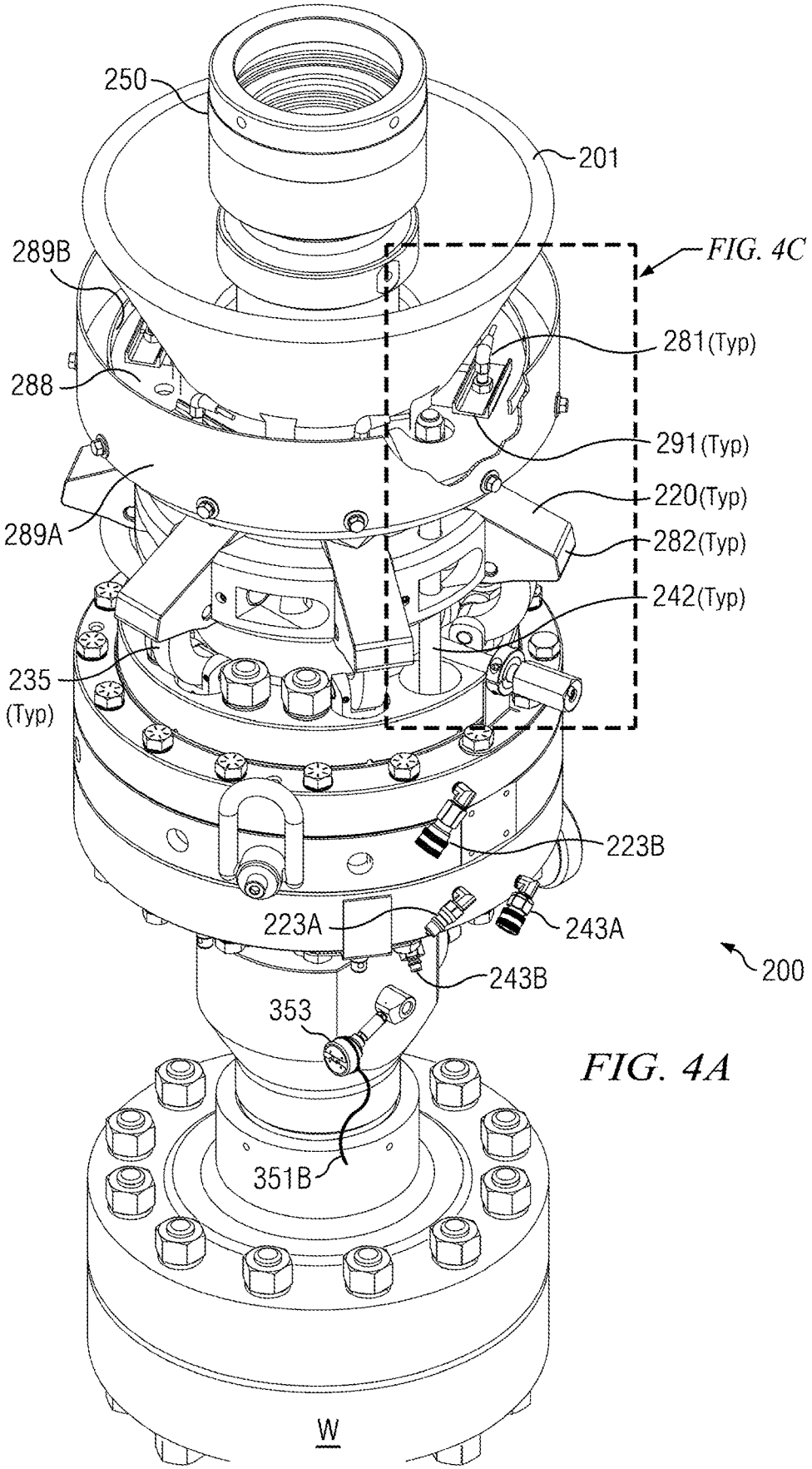
FIGS. 4A and 4B illustrate an embodiment of pressure control assembly 200 generally disclosed in the '990 Application deployed with magnetic cam sensor embodiments 281 from the instant application.
Figure 4B:
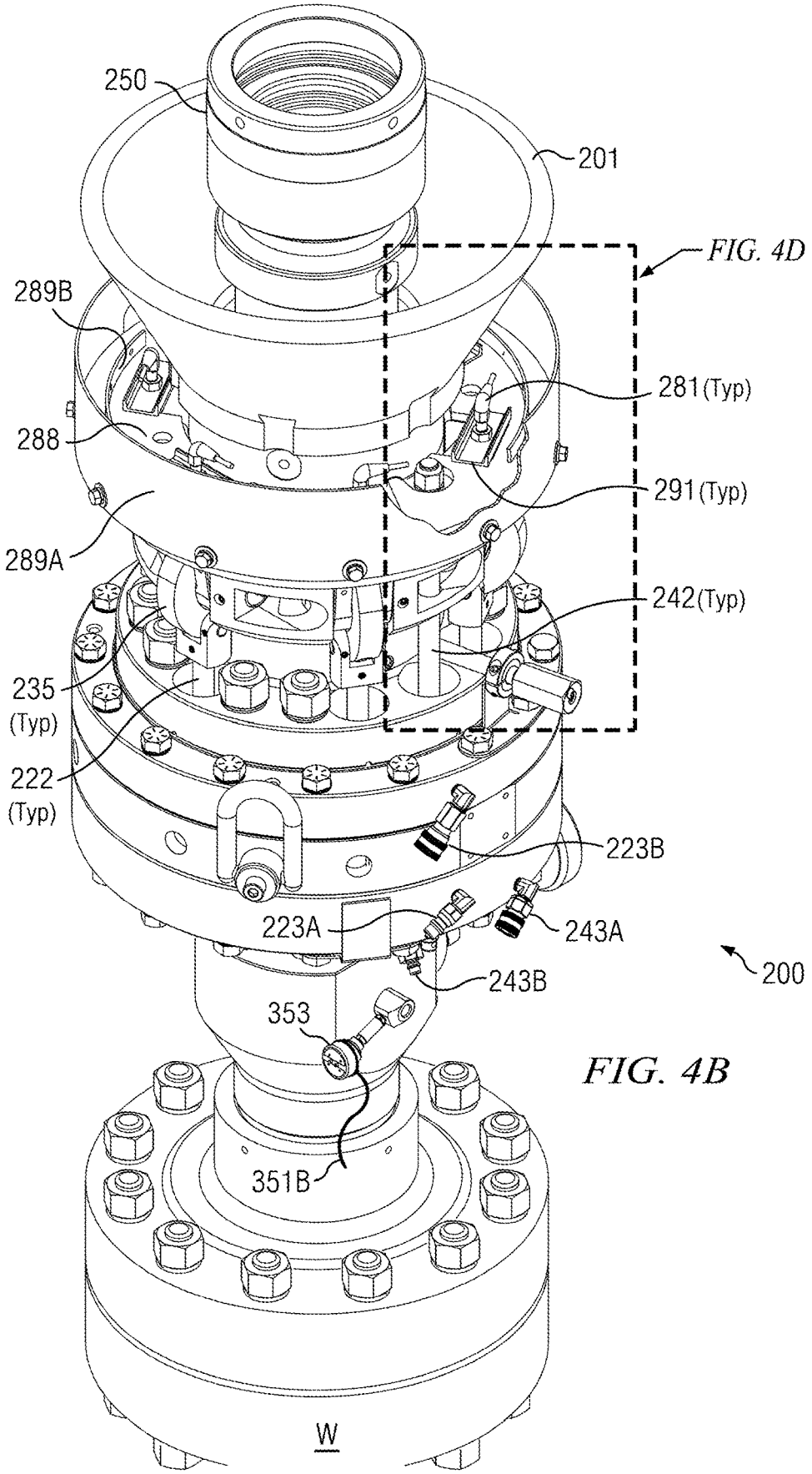

FIGS. 4A and 4B illustrate an embodiment of pressure control assembly 200 generally disclosed in the '990 Application deployed with magnetic cam sensor embodiments 281 from the instant application. Referring first to FIG. 4A, pressure control assembly 200 is in fluid communication with wellhead W. Cam lock pistons 222 (refer FIG. 4B) connect to cam locks 220 via link arms 235. Cam lock actuation ports 223A, 223B are configured to connect to hydraulic hoses in order to receive hydraulic fluid under pressure. Hydraulic fluid into cam lock actuation port 223A extends cam lock pistons. Hydraulic fluid into cam lock actuation port 223B retracts cam lock pistons. Locking ring pistons 242 connect to locking ring 240. Locking ring actuation ports 243A, 243B are also configured to connect to hydraulic hoses in order to receive hydraulic fluid under pressure. Hydraulic fluid into locking ring actuation port 243A extends locking ring pistons. Hydraulic fluid into locking ring actuation port 243B retracts locking ring pistons.

Cam locks 220 on FIG. 4A are down, meaning cam lock pistons 222 are retracted. Locking ring 240 on FIG. 4A is up, meaning locking ring pistons 242 are extended. When cam locks 220 are down and locking ring 240 is up on pressure control assembly 200 as on FIG. 4A, pressure control assembly 200 is in an "open" or "unlocked" condition, such that adapter 250 is free to disengage from pressure control assembly 200. FIG. 4A further illustrates cam activator surfaces 282 on cam locks 220. It will be seen on FIG. 4A that when cam locks 220 are down, cam activator surfaces 282 are remote from magnetic cam sensors 281.

Figure 4C:
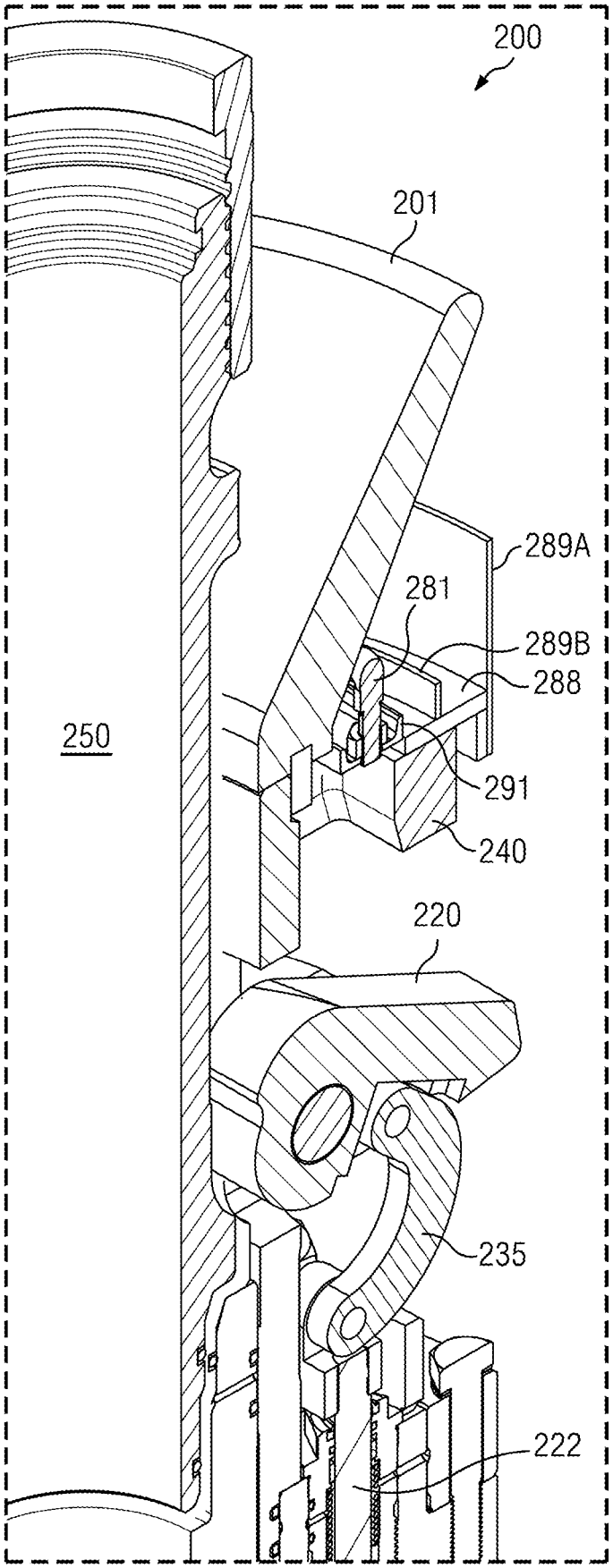
FIGS. 4C and 4D are enlarged insets as shown on FIGS. 4A and 4B respectively.

FIG. 4C is an enlarged inset as shown on FIG. 4A. FIGS. 4A and 4C should now be viewed together. FIGS. 4A and 4C illustrate magnetic cam sensors 281 positioned on locking ring 240. In embodiments depicted on FIGS. 4A and 4C, locking ring 240 includes crown 288 superposed on locking ring 240, and sensor guard rings 289A, 289B provided on an outer periphery of locking ring 240. Sensor positioning members 291 attach to crown 288 so as to hold magnetic cam sensors 281 in a predetermined fixed position with respect to locking ring 240.

FIG. 4B is a similar illustration to FIG. 4A, except that cam locks 220 on FIG. 4B are up, meaning cam lock pistons 222 are extended. Locking ring 240 on FIG. 4B is down, meaning locking ring pistons 242 are retracted. When cam locks 220 are up and locking ring 240 is down on pressure control assembly 200 as on FIG. 4B, pressure control assembly 200 is in a "closed and locked" condition, such that cam locks 220 have engaged adapter 250 inside pressure control assembly 200 and locking ring 240 is retaining cam locks 220.

Figure 4D:
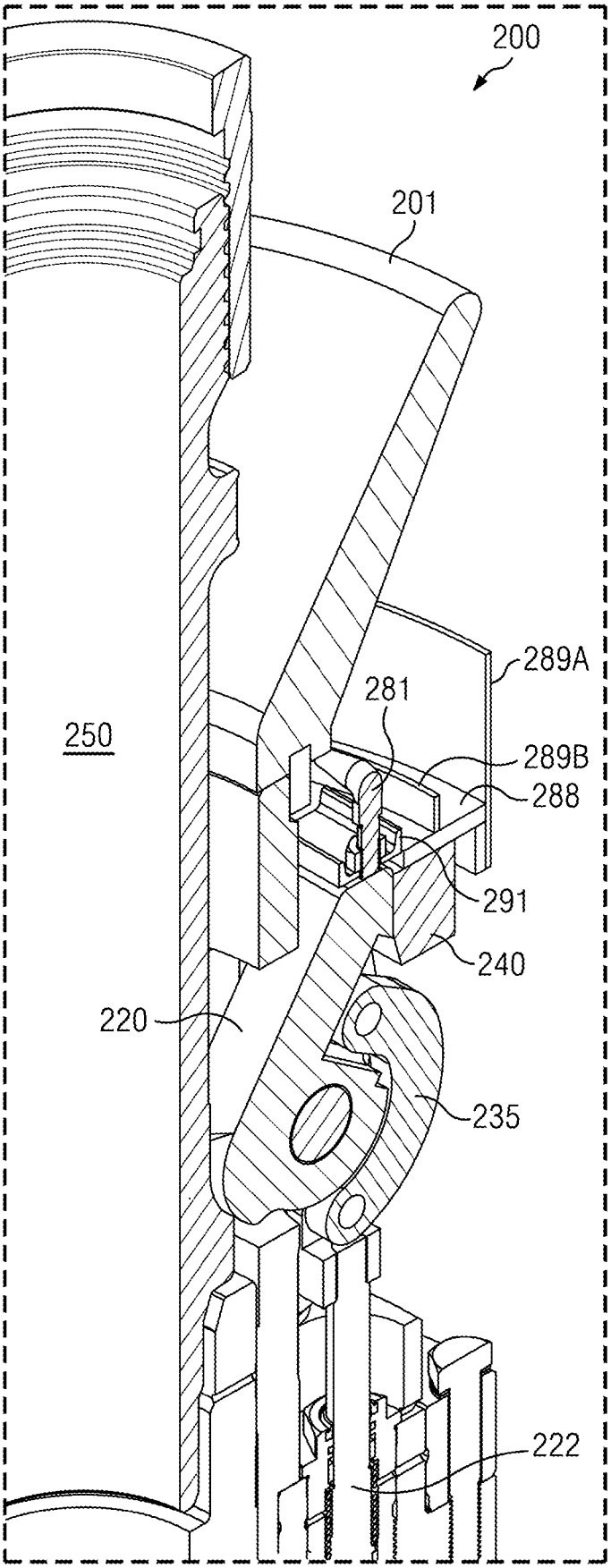

FIG. 4D is an enlarged inset as shown on FIG. 4B. FIG. 4D is a similar illustration to FIG. 4C, except that cam locks 220 are down on FIG. 4C and are up on FIG. 4D. Further, locking ring 240 is up on FIG. 4C and is down on FIG. 4D.

Figure 4E:
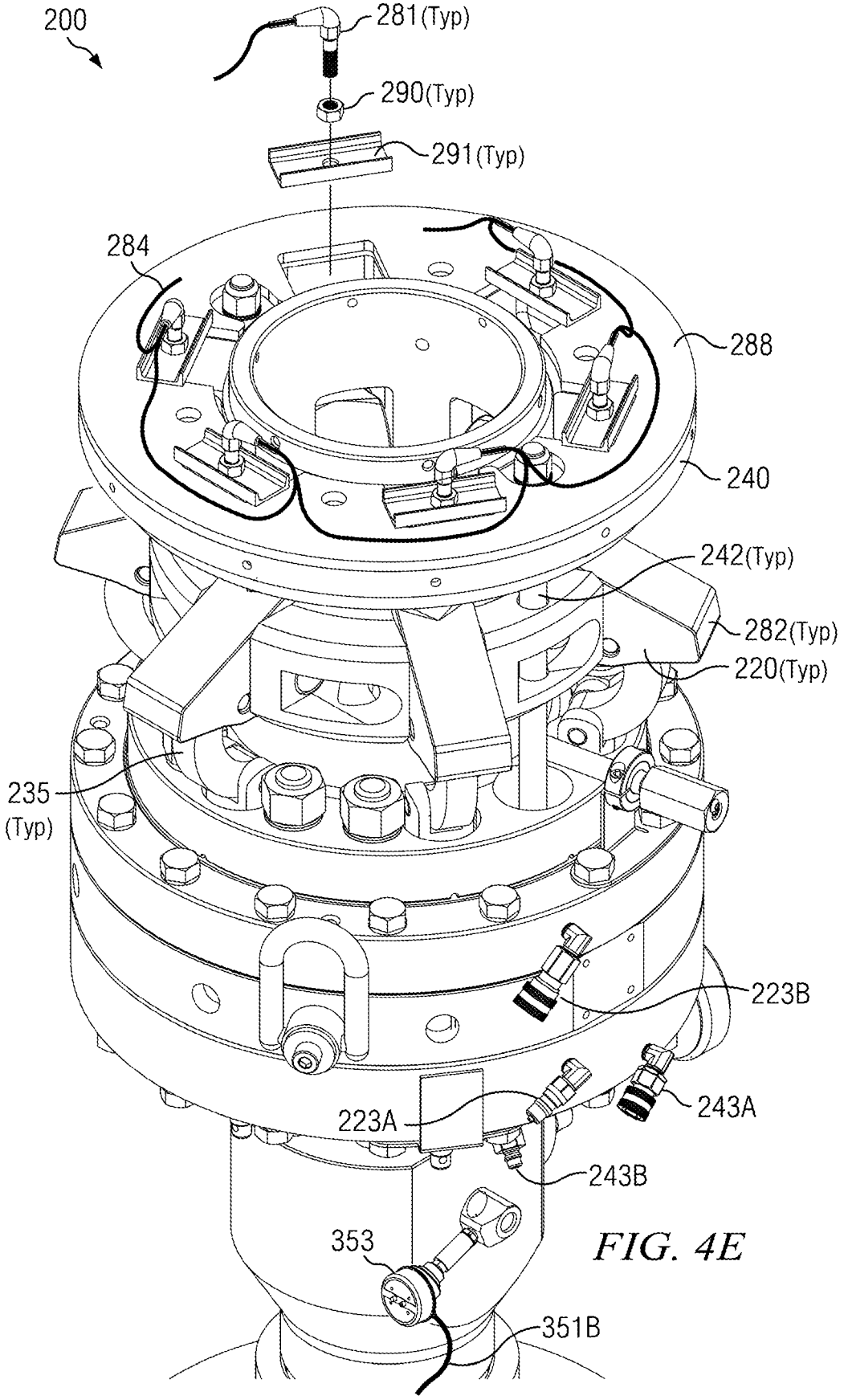
FIGS. 4E and 4F are enlargements of FIGS. 4A and 4B respectively, with assembly components removed to reveal magnetic cam sensor embodiments 281 more clearly.
Figure 4F:
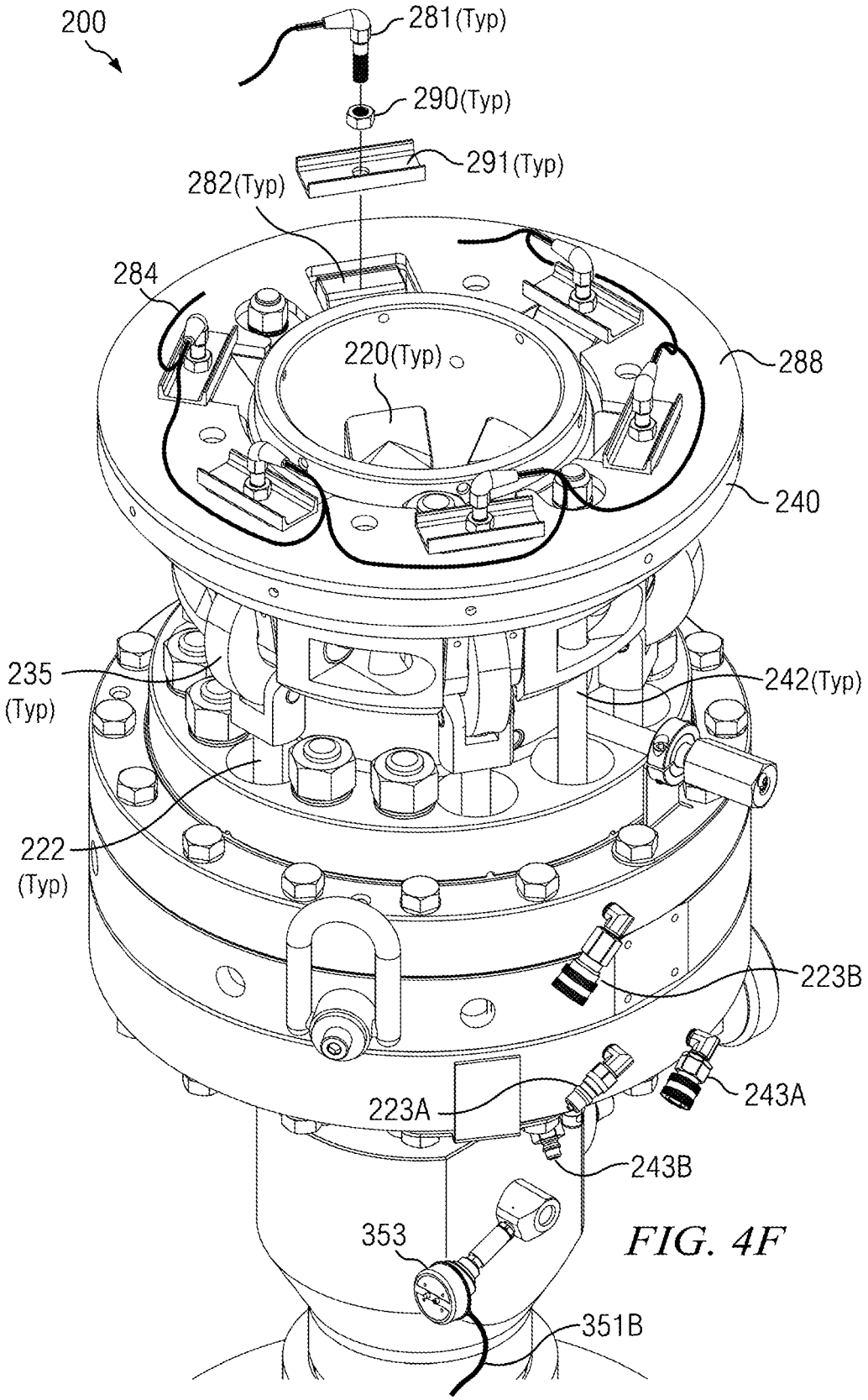

FIGS. 4E and 4F are enlargements of FIGS. 4A and 4B respectively, with assembly components removed for clarity.

FIG. 4E is a similar illustration to FIG. 4A, except with adapter 250, tulip 201 and sensor guard rings 289A, 289B removed to reveal magnetic cam sensors 281 more clearly. FIG. 4E shows pressure control assembly 200 is in an "open" or "unlocked" condition with cam locks 220 down and locking ring 240 up. FIG. 4E depicts jam nuts 290 and sensor positioning members 291 combining to allow magnetic cam sensors to be set at a predetermined fixed position with respect to locking ring 240. FIG. 4E also shows cam activator surfaces 282 on cam locks 220. Similar to FIG. 4A, it will be seen on FIG. 4E that when cam locks 220 are down, cam activator surfaces 282 are remote from magnetic cam sensors 281.

FIG. 4F is a similar illustration to 4E, except that cam locks 220 on FIG. 4F are up and locking ring 240 on FIG. 4F is down. FIG. 4F thus depicts pressure control assembly 200 in a "closed and locked" condition. FIG. 4F further illustrates that when cam locks 220 are up and locking ring 240 is down, magnetic cam sensors 281 detect the presence of cam activator surfaces 282. In embodiments of pressure control assembly 200 illustrated on FIGS. 4A through 4D, and 4E and 4F, therefore, magnetic cam sensors 281 may detect when pressure control assembly 200 is in a "closed and locked" condition. More specifically, magnetic cam sensors 281 may detect pressure control assembly 200 in one of the following two states: either (1) in a "closed and locked" condition with cam locks 220 up and locking ring 240 down, or (2) not in such a condition.

FIGS. 4E and 4F further illustrate currently preferred embodiments in which magnetic cam sensors 281 are electrically coupled together in series via sensor cable 284. In such embodiments, the failure of any one of magnetic cam sensors 281 to activate (i.e. detect the presence of a corresponding cam activator surface 282) will alert to a potential fault condition when cam locks 220 are hydraulically actuated to the "up" position and locking ring 240 is hydraulically actuated to the "down" position.

FIGS. 4A, 4B, 4E and 4F also depict well pressure sensor 353. Similar to description above with reference to FIG. 2A, well pressure sensor 353 on FIGS. 4A, 4B, 4E and 4F is configured to sense the current pressure in pressure control assembly 200. In preferred embodiments, well pressure sensor 353 is a pressure transducer, although the scope of this disclosure is not limited in this regard. FIGS. 4A, 4B, 4E and 4F also show sensor cable 351B addressing well pressure sensor 353.

Figure 4G:
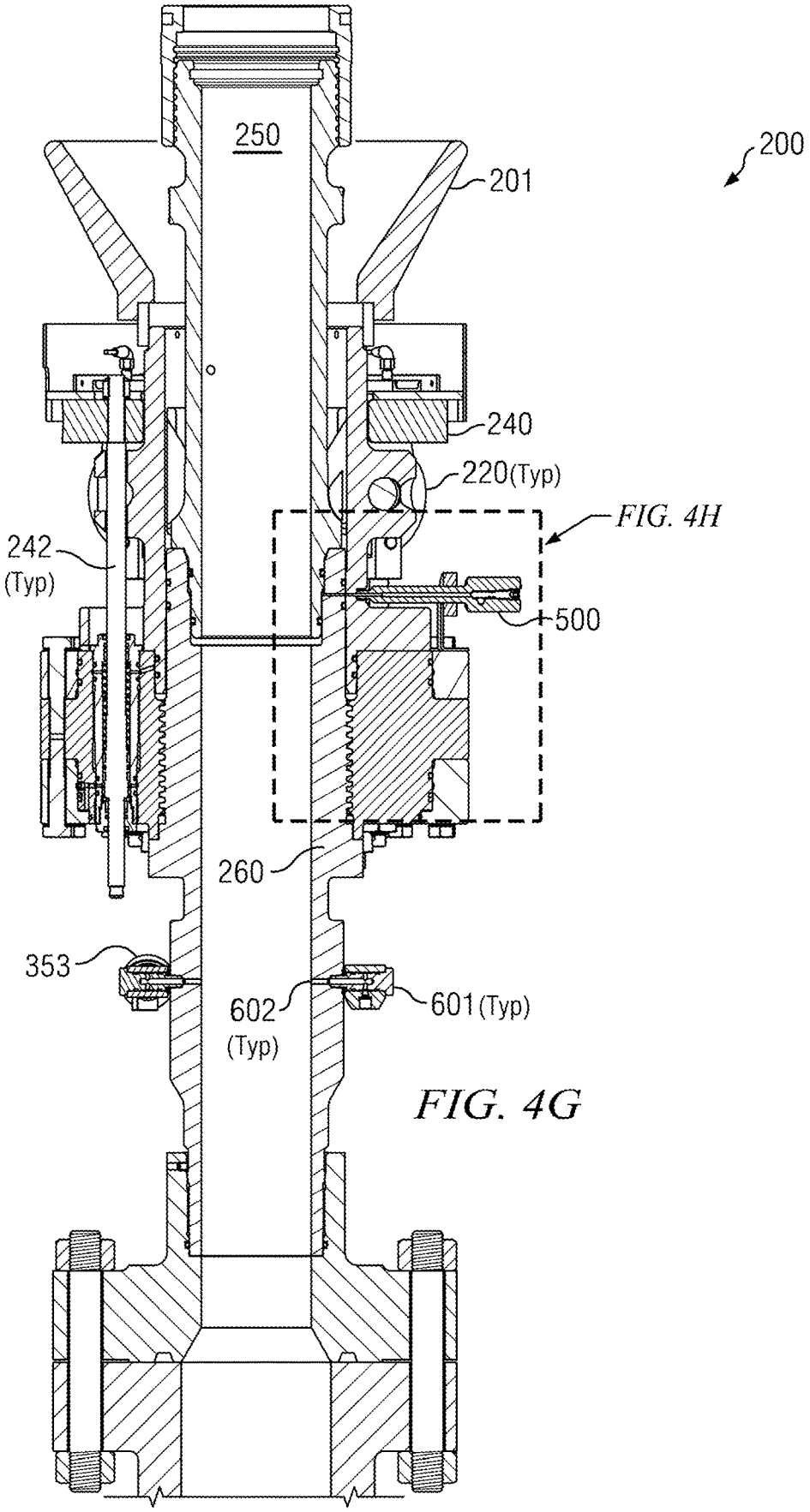
FIG. 4G is a vertical section through the embodiment of pressure control assembly 200 depicted on FIG. 4B.
Figure 4H:
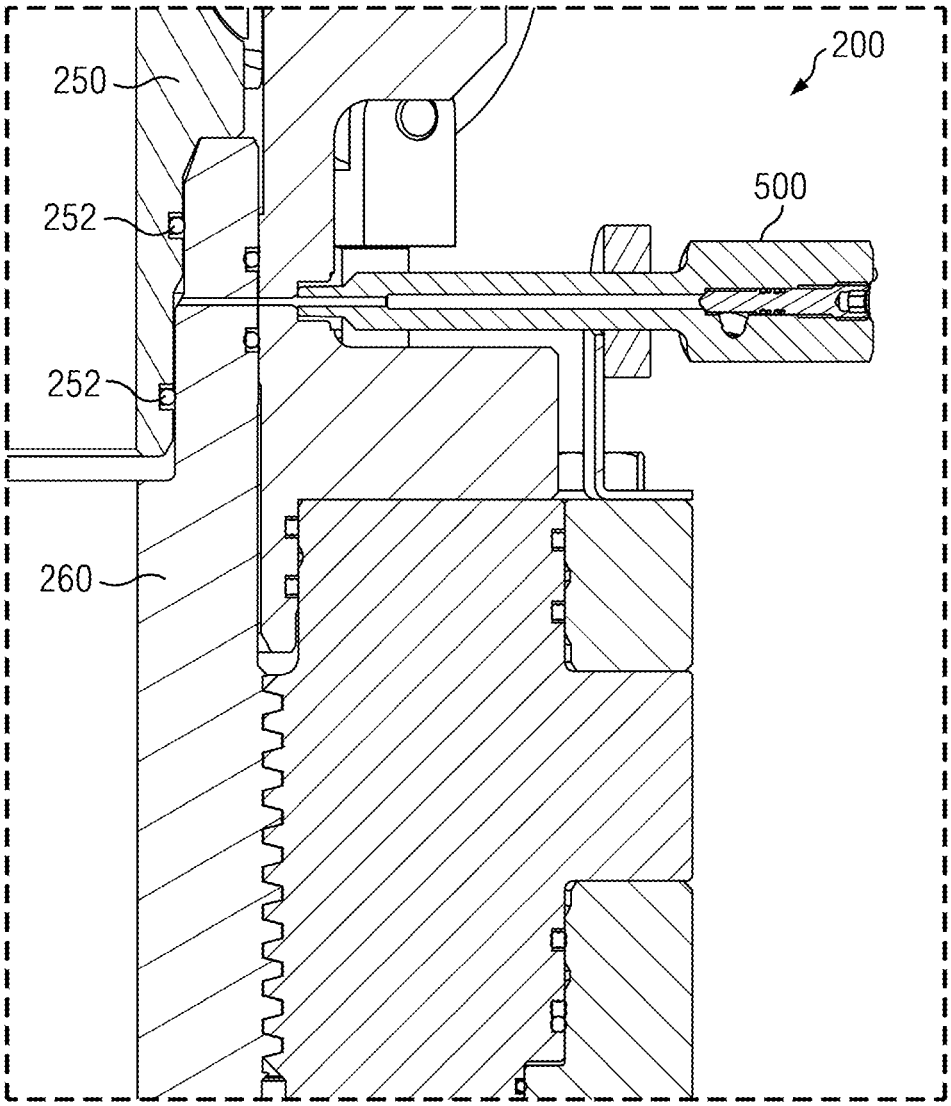
FIG. 4H is an enlarged inset as shown on FIG. 4G.

FIG. 4G is a vertical section through the embodiment of pressure control assembly 200 depicted on FIG. 4B. FIG. 4H is an enlarged inset as shown on FIG. 4G. FIG. 4G illustrates well pressure sensor 353 connected to needle valve 601 resident in transducer port 602 in receptacle 260. Similar to the embodiment of fluid connection housing assembly 300 illustrated on FIG. 2D, receptacle 206 on FIG. 4G provides a second needle valve 601 in a second transducer port 602 in receptacle 260. Second needle valve 601 and second transducer port 602 may provide redundancy for well pressure sensor 353 in case of damage, for example, to the original valve or port 601, 602. Alternatively, second needle valve 601 and second transducer port 602 may be used to drain/equalize pressure within receptacle 260 during service operations. Alternatively, second transducer port 602 may receive a local pressure gauge allowing well pressure inside receptacle 260 to be monitored from nearby the wellhead. The scope of this disclosure is not limited to particular uses for transducer ports 602 or equipment deployed therein.

FIG. 4H illustrates pressure control assembly 200 on FIG. 4G providing quick test port and fitting 500. Quick test port 500 accesses the space between o-rings 252 when adapter 250 is fully and operationally received into receptacle 260. Control, testing and monitoring of pressurization and depressurization operations through quick test port 500 on FIG. 4H are analogous to those described above with reference to FIGS. 1B, 1D and 2D for quick test fitting 401 on FIG. 2D.

Figure 5A:
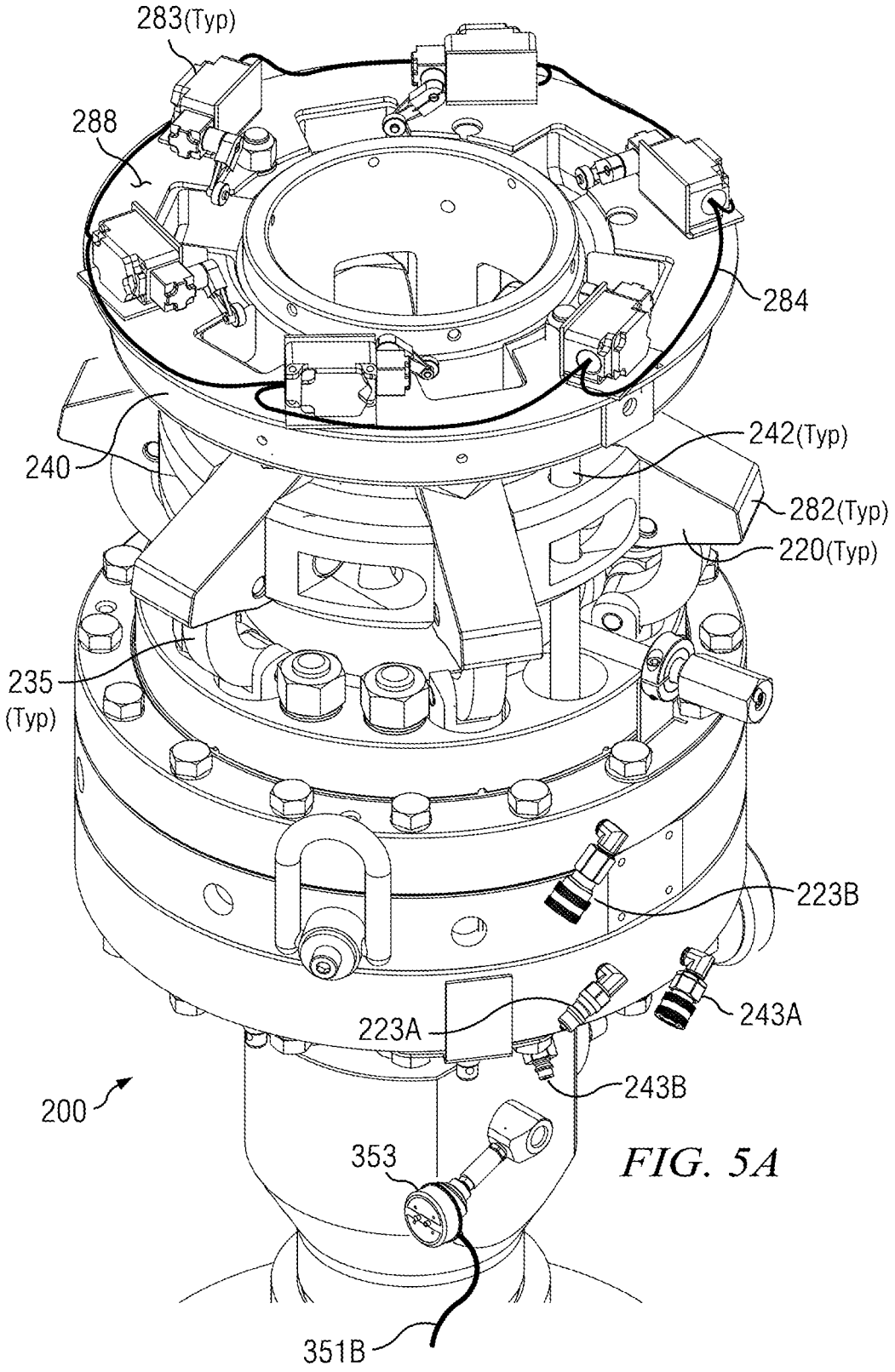
FIGS. 5A and 5B illustrate pressure control assembly 200 according to FIGS. 4E and 4F respectively, except that FIGS. 5A and 5B deploy contact cam sensor embodiments 283 instead of magnetic cam sensor embodiments 281 as depicted on FIGS. 4E and 4F.
Figure 5B:
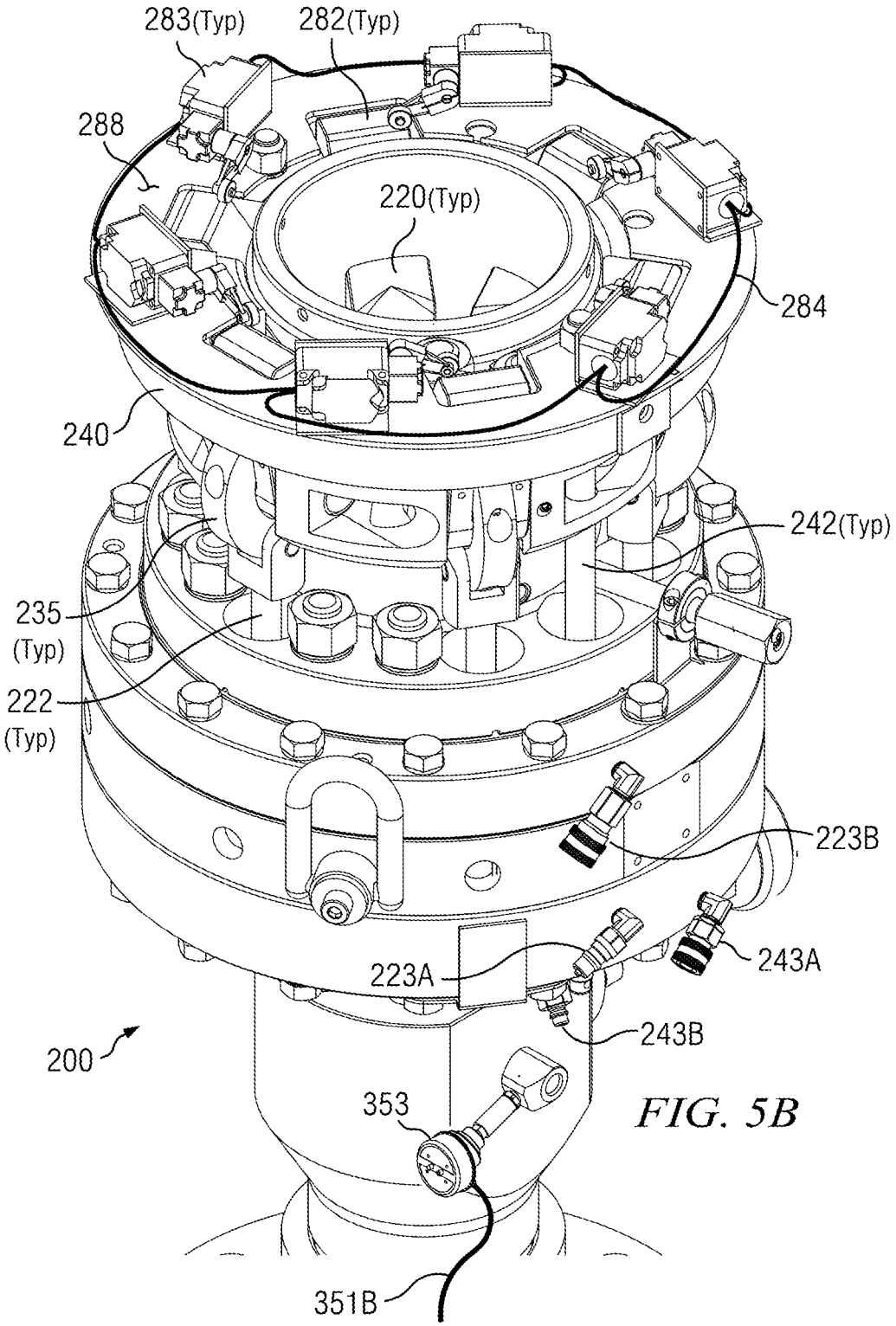

FIGS. 5A and 5B illustrate pressure control assembly 200 according to FIGS. 4E and 4F respectively, except that FIGS. 5A and 5B deploy contact cam sensor embodiments 283 instead of magnetic cam sensor embodiments 281 as depicted on FIGS. 4E and 4F. Similar to FIG. 4E, FIG. 5A shows pressure control assembly 200 in an "open" or "unlocked" condition with cam locks 220 down and locking ring 240 up. Similar to FIG. 4F, FIG. 5B shows pressure control assembly 200 in a "closed and locked" condition with cam locks 220 up and locking ring 240 down. Contact cam sensors 283 on FIGS. 5A and 5B are preferably mechanical assemblies whose spring-loaded limit switch design activates when biased rotor arms thereon are deflected. Contact cam sensors 283 are shown on FIG. 5A with their rotor arms in an undeflected state when cam locks 220 are down and ring 240 is up. Referring now to FIG. 5B, the presence of cam activator surfaces 282 when cam locks 220 are up and locking ring 240 is down deflects the rotor arms and activates contact cam sensors 283. Similar to magnetic cam sensors 281 illustrated on FIGS. 4E and 4F above, therefore, contact cam sensors 283 detect when pressure control assembly 200 is in a "closed and locked" condition. More specifically, contact cam sensors 283 may detect pressure control assembly 200 in one of the following two states: either (1) in a "closed and locked" condition with cam locks 220 up and locking ring 240 down, or (2) not in such a condition.

Similar to magnetic cam sensors 281 illustrated on FIGS. 4E and 4F above, FIGS. 5A and 5B further illustrate currently preferred embodiments in which contact cam sensors 283 are electrically coupled together in series via sensor cable 284. In such embodiments, the failure of any one of contact cam sensors 283 to activate (i.e. detect the presence of a corresponding cam activator surface 282) will alert to a potential fault condition when cam locks 220 are hydraulically actuated to the "up" position and locking ring 240 is hydraulically actuated to the "down" position.

Figure 6A:
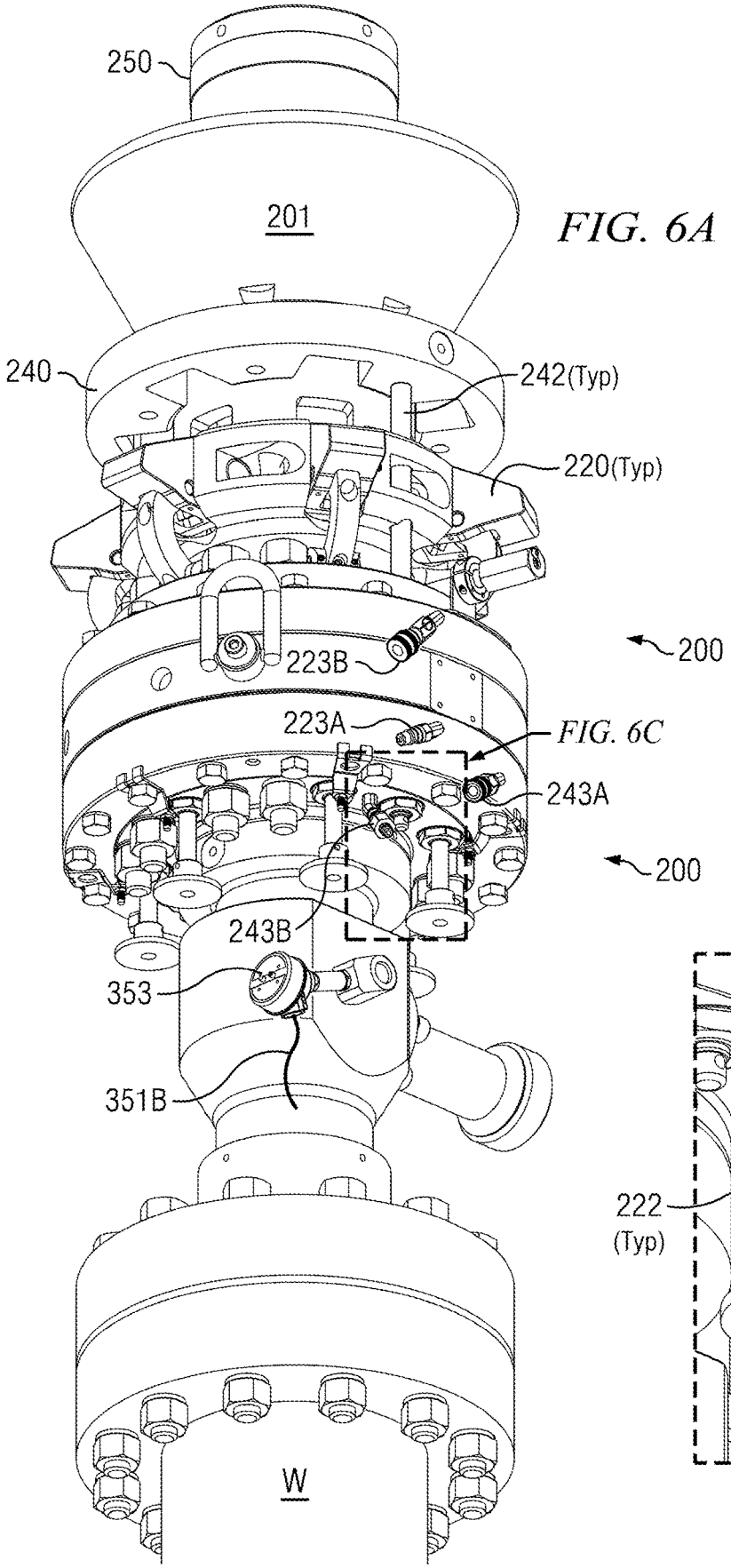
FIGS. 6A and 6B illustrate an embodiment of pressure control assembly 200 generally disclosed in the '990 Application deployed with cam rod puck and sensor embodiments 286, 285 from the '795 Application.
Figure 6C:
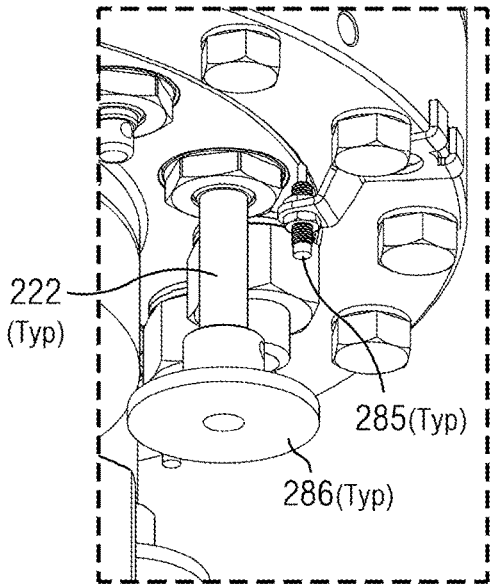
FIGS. 6C and 6D are enlarged insets as shown on FIGS. 6A and 6B respectively.
Figure 6B:
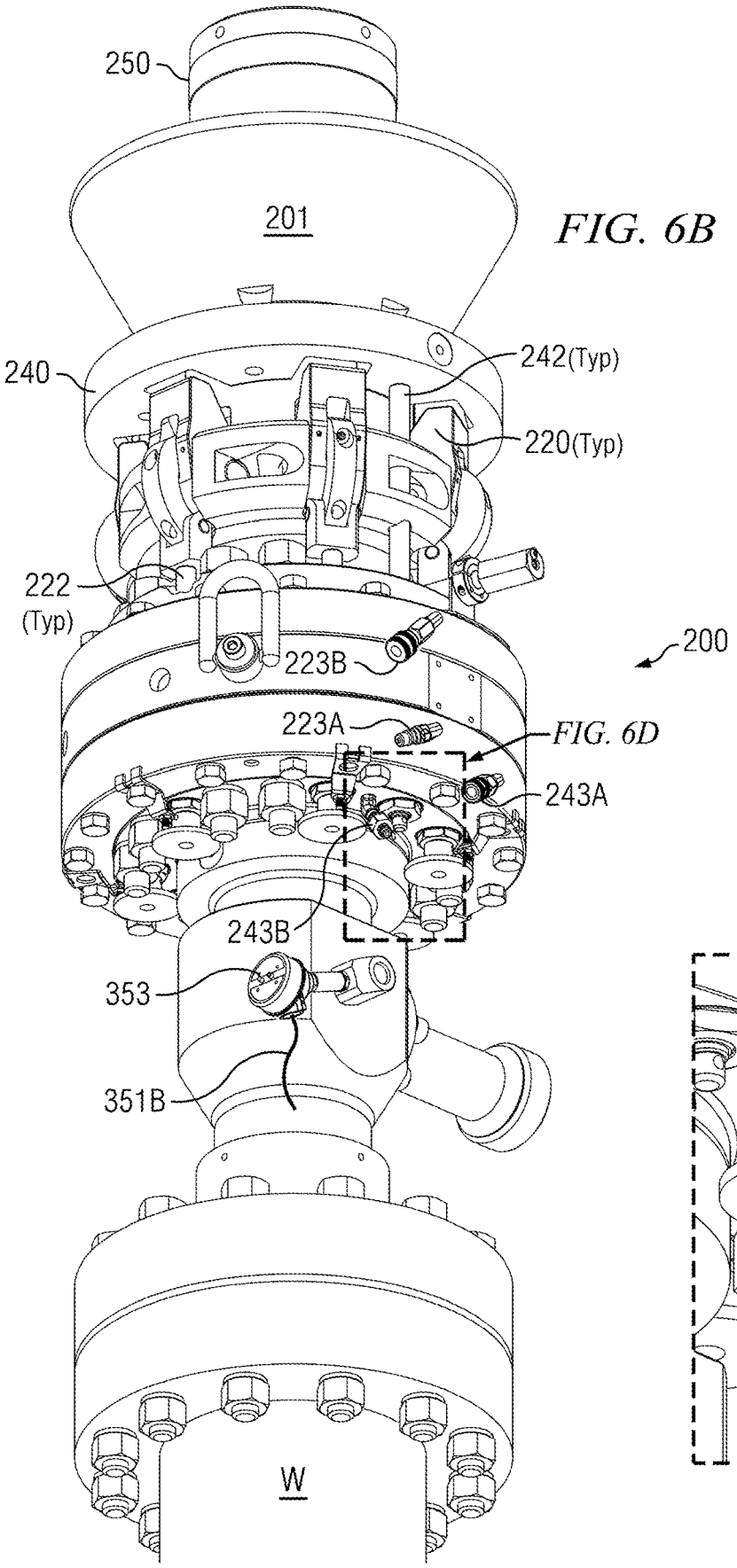
Figure 6D:
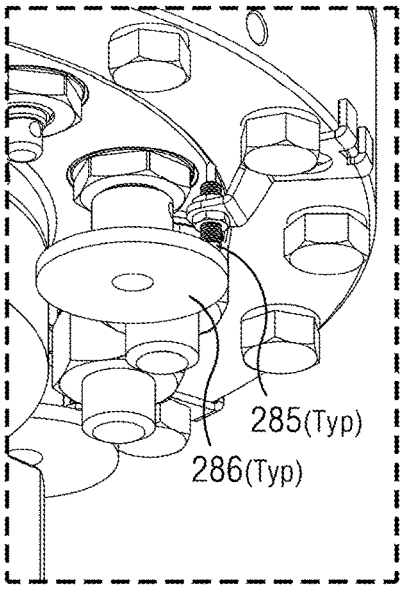

FIGS. 6A and 6B illustrate an embodiment of pressure control assembly 200 generally disclosed in the '990 Application deployed with cam rod puck and sensor embodiments 286, 285 from the '795 Application. FIGS. 6C and 6D are enlarged insets as shown on FIGS. 6A and 6B respectively. Looking at FIGS. 6A through 6D together, cam lock pistons 222 have cam rod pucks 286 attached to a lower end thereof. Puck sensor 285 is positioned on pressure control assembly 200 to activate when it detects the presence of cam rod puck 286. In illustrated embodiments, puck sensor 285 is a magnetic sensor, and cam rod puck 286 is ferrous. In other embodiments (not illustrated), puck sensor 285 may be a mechanical contact sensor, positioned on pressure control assembly 200 to activate when touched by cam rod puck 286. The scope of this disclosure is not limited to any particular design for puck sensor 285.

The pressure control assembly 200 illustrated on FIGS. 6A and 6C is in an "open" and "unlocked" condition with cam lock pistons 222 retracted and cam locks 220 down, and with locking ring pistons 242 extended and locking ring 240 up. Puck sensors 285 will not activate.

In contrast, the pressure control assembly 200 illustrated on FIGS. 6B and 6D is in an "closed but unlocked" condition with cam lock pistons 222 extended and cam locks 220 up, but with locking ring pistons 242 still extended and locking ring 240 still up. Puck sensors 285 will activate to indicate cam locks 220 are up. Puck sensors 285 with cam rod pucks 286 may thus detect when pressure control assembly 200 is in a "closed" condition with cam lock pistons 222 extended and cam locks 220 up, regardless of whether locking ring 240 is up or down. More specifically, puck sensors 285 with cam rod pucks 286 may detect pressure control assembly 200 in one of the following two states: either (1) in a "closed" condition with cam locks 220 up, or (2) not in such a condition.

Although not specifically illustrated on FIGS. 6A through 6D, puck sensors 285 with cam rod pucks 286 are preferably electrically coupled together in series. In such embodiments, the failure of any one of puck sensors 285 to activate (i.e. detect the presence of a corresponding cam rod puck 286) will alert to a potential fault condition when cam locks 220 are hydraulically actuated to the "up" position.

Figure 6E:
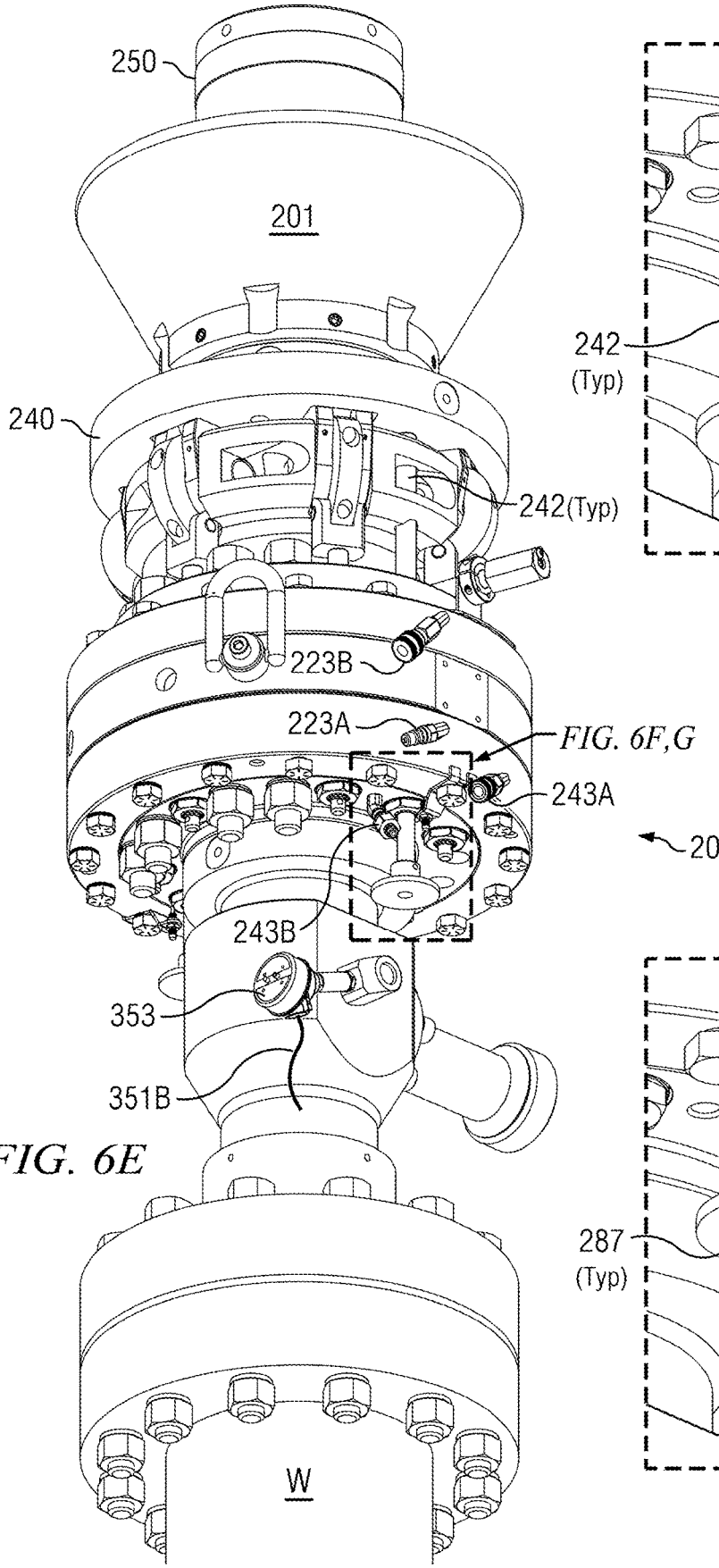
FIG. 6E illustrates a further embodiment of pressure control assembly 200 generally disclosed in the '990 Application deployed with ring rod puck and sensor embodiments 287, 285 from the '795 Application and from the instant application.
Figure 6F:
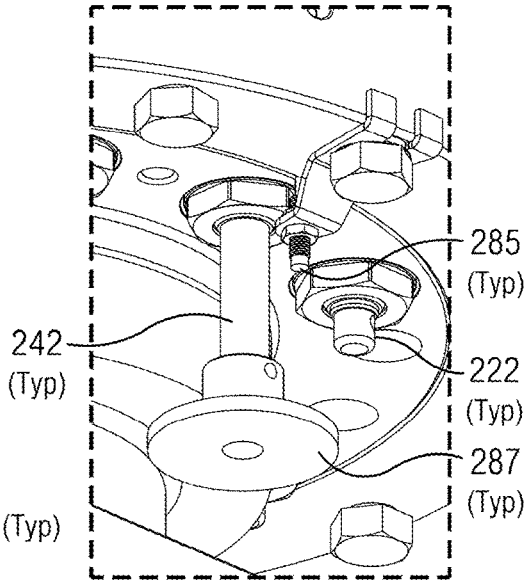
Figure 6G:
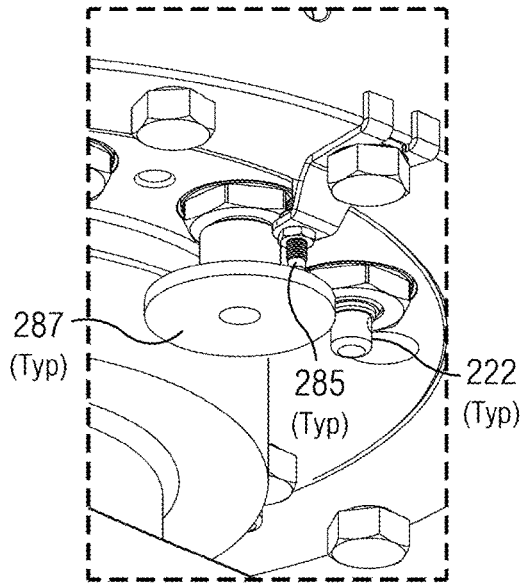

FIG. 6E illustrates a further embodiment of pressure control assembly 200 generally disclosed in the '990 Application deployed with ring rod puck and sensor embodiments 287, 285 from the '795 Application and from the instant application. FIGS. 6F and 6G are enlarged insets as shown on FIG. 6E, in which FIG. 6F depicts ring rod puck and sensor embodiments 287, 285 with ring 240 down, and in which FIG. 6G depicts ring rod puck and sensor embodiments 287, 285 with ring 240 up.

Looking at FIGS. 6E through 6G together, locking ring pistons 242 have ring rod pucks 287 attached to a lower end thereof. Puck sensor 285 is positioned on pressure control assembly 200 to activate when it detects the presence of ring rod puck 287. In illustrated embodiments, puck sensor 285 is a magnetic sensor, and ring rod puck 286 is ferrous. In other embodiments (not illustrated), puck sensor 285 may be a mechanical contact sensor, positioned on pressure control assembly 200 to activate when touched by ring rod puck 287. As noted above, the scope of this disclosure is not limited to any particular design for puck sensor 285.

The pressure control assembly 200 illustrated on FIGS. 6E and 6F is in a "closed and locked" condition with cam lock pistons 222 extended and cam locks 220 up, and with locking ring pistons 242 retracted and locking ring 240 down. Puck sensors 285 will not activate.

In contrast, the pressure control assembly 200 illustrated on FIG. 6G is in an "unlocked" condition with cam lock pistons 222 still extended and thus with cam locks 220 up, but now with locking ring pistons 242 also extended and thus locking ring 240 up. Puck sensors 285 will activate to indicate locking ring 240 is up. Puck sensors 285 with ring rod pucks 287 may thus detect when pressure control assembly 200 is in an "unlocked" condition with locking ring pistons 242 extended and locking ring 240 up, regardless of whether cam locks 220 are up or down. More specifically, puck sensors 285 with ring rod pucks 287 may detect pressure control assembly 200 in one of the following two states: either (1) in an "unlocked" condition with locking ring 240 up, or (2) not in such a condition.

Although not specifically illustrated on FIGS. 6E through 6G, puck sensors 285 with ring rod pucks 287 are preferably electrically coupled together in series. In such embodiments, the failure of any one of puck sensors 285 to activate (i.e. detect the presence of a corresponding ring rod puck 287) will alert to a potential fault condition when locking ring 240 is hydraulically actuated to the "up" position.

The embodiments of pressure control assembly 200 illustrated on FIGS. 4A through 6G depict one sensor deployed per cam lock 220 or locking ring piston 242, as applicable, whether the sensor is a magnetic cam sensor 281 on FIGS. 4A through 4F, a contact cam sensor 283 on FIGS. 5A and 5B, or a puck sensor on FIGS. 6A through 6G. It will nonetheless be understood that the scope of this disclosure is not limited such illustrated embodiments. Other embodiments (not illustrated) may provide fewer sensors than one deployed per cam lock 220 or locking ring piston 242, as applicable.

Reference is now made to control unit 100 on FIGS. 1A through 1G as described in detail above. It is considered to be within the understanding of one of ordinary skill to be able to adapt control unit 100 on FIGS. 1A through 1G, without undue experimentation, to provide a remoter operator with monitoring and control over embodiments of pressure control assembly 200 described above with reference to FIGS. 4A through 6G. Such monitoring and control over pressure control assembly 200 would be similar in scope and function to the monitoring and control provided by control unit 100 over embodiments of fluid control housing assembly 300 described above with reference to FIGS. 2A through 3D.

For example, hydraulic hoses 108A, 108B and 108C on control unit 100, and remote control thereover, may be adapted and increased/scaled up for control unit 100 to provide remote control over actuation of cam lock pistons 222 and locking ring pistons 242 on pressure control assembly 200. Further, processing logic, switches and displays provided in and on control enclosure 120 on control unit 100 may be adapted for monitoring and processing remote notifications of activation of magnetic cam sensors 281, contact cam sensors 283 and puck sensors 285 on pressure control assembly 200. All of these electro-hydraulic adaptations and modifications may be made without undue experimentation. The scope of this disclosure is not limited in these regards.

Similarly, control unit 100 may be reconfigured to monitor well pressure via well pressure monitor 353 on pressure control adapter 200 (refer FIG. 4A, for example) without undue experimentation. Further, control unit 100 may be reconfigured to provide remote control, testing and monitoring of pressurization and depressurization operations through quick test fitting 500 on pressure control adapter 200 (refer FIGS. 4G and 4H) without undue experimentation. The scope of this disclosure is also not limited in these regards.

This disclosure has described sensor embodiments with primary reference to magnetic sensors or contact/mechanical sensors having a spring-loaded limit switch design. The scope of this disclosure is not limited to types of sensor deployed. Other embodiments may deploy, for example and without limitation, combinations of sensor types including capacitive proximity sensors, rotary encoders, accelerometers, inclinometers, optical sensors such as a lamp or LED and photoresistor, and force-sensitive resistors such as strain gauges.

This disclosure has described embodiments of control unit 100 in association with embodiments of wellhead connections described in the '279 Application and the '990 Application. The scope of this disclosure is not limited, however, to specific wellhead connections with which to associate control unit 100. The scope of this disclosure includes associating embodiments of control unit 100 with a more general category of fluid connection devices. Examples of fluid connection devices falling into a more general category include fluid connection housing assembly 300 and pressure control assembly 200 as described herein (and in the '279 and '990 Applications), as well as other fluid connection devices. Similarly, the scope of this disclosure includes associating embodiments of control unit 100 with a more general category of actuators on fluid connection devices to lock and unlock the fluid connection devices. Examples of actuators falling into a more general category include actuator pistons 382 and cam lock pistons 222 as described herein (and in the '279 and '990 Applications) as well as other actuators, such as, for example, a hydraulic motor. Similarly, the scope of this disclosure includes associating embodiments of control unit 100 with a more general category of indicators disposed to alert differently according to sensed conditions at the fluid connection device. Examples of indicators falling into a more general category include indicator light 133 as described herein, as well as other indicators. Non-limiting examples of other indicators in the more general category include a screen alert, or a sound alert, or a mechanical indicator that moves within a range of positions according whether the fluid connection device is in the unlocked condition or the locked condition (or is in transition).

Further, embodiments of control unit 100 may also be configured to control and monitor status of equipment other than wellhead connectors.

Although the disclosed embodiments of control unit 100 have been described with reference to an exemplary application in hydraulic fracturing ("fracking"), alternative applications could include, for example, areas such as pressure control at a wellhead, deep core drilling, offshore drilling, methane drilling, open hole applications, wireline operations, coil tubing operations, mining operations, and various operations where connections are needed under a suspended or inaccessible load (i.e., underwater, hazardous area).

Exemplary Operation of Control Unit 100 with Embodiments of Fluid Connection Housing Assembly 300 Illustrated on FIGS. 2A Through 2G Reference is made to FIGS. 1A through 2G and associated description above to support the following description of an exemplary, non-limiting operation guide for control unit 100.

1. Rig Up

Connect hydraulic hoses 108A, 108B to fittings on fluid connection housing assembly (FCHA) 300 no. 1.

Connect hydraulic hose 108C to quick test fitting 401 on FCHA 300 no. 1.

Connect multi-pin connector 110 at one end of multi-core control cable 109 to bulkhead box 107 no. 1.

Connect multi-pin connector 110 at other end of multi-core control cable 109 to junction box 350 on FCHA 300 no. 1.

Repeat above steps for FCHA 300 nos. 2, 3 and 4.

(Equipment may be color coded for each FCHA 300, e.g. red for no. 1, white for no. 2, blue for no. 3 and yellow for no. 4).

2. Control Unit 100 Start Up

Turn the main power switch for control enclosure 120 to the "ON" position.

Interactive touch display (HMI) 140 will indicate it is booting up.

Insert key in key lock 153 and start motor 183. Increase engine speed to 2200 rpm as indicated by tachometer 151 on motor display 150.

Touch "well pressure" menu item 142 on menu bar 143 on HMI 140. Display region 143 will indicate well pressures. Verify that all well pressure sensors (transducers) 353 are reading correctly (0 psi). If they do not read 0 psi, touch "settings" menu item 142 on menu bar 143 on HMI 140 and perform a "coarse zero" function.

3. Remote Operation of FCHA 300

To raise locking ring 318 for, e.g., FCHA 300 no. 1, turn lock switch 134 for no. 1 to the "unlock" position.

Keep switch 134 turned to the "unlock" position until the indicator light 133 for no. 1 turns red. FCHA 300 no. 1 is now unlocked and safe to change out equipment at wellhead, perform visual inspection, etc.

To lower the locking ring 318 for FCHA 300 no. 1, turn lock switch 134 for no. 1 to the "lock" position.

Keep switch 134 turned to the "lock position until the indicator light 133 for no. 1 turns green. FCHA 300 no. 1 is now locked and ready for operational fluid flow.

Once the connection is made and locked, perform a quick test on the connection.

If indicator light 133 is steady yellow, locking ring 318 is in mid-stroke and FCHA 300 is not yet ready to receive operational pressure.

If indicator light 133 is flashing yellow, there is a sensor fault on locking ring 318. Fault should be repaired before proceeding.

4. Quick Test Operation.

Touch the "quick test sub" menu item 142 on menu bar 141 on HMI 140.

Set "QTS SET PRESSURE" on HMI display region 143 to desired pressure by using the slider bar or touching the display region 143. Note The quick test sub set pressure is programmed to build 500 psi above the input set pressure and then automatically stop. This is to allow the pressure to "settle in" around the desired pressure as a slight amount of bleed off will always be present when energizing hydraulic fluid to such high pressures.

Turn quick test operation switch 136 to the "test" position.

Keep switch 136 turned to "test" position until desired pressure is displayed on quick test pressure display 135 and/or the HMI display region 143.

Turn switch 136 to "hold" position and monitor for excessive pressure decay on quick test pressure display 135 and/or the HMI display region 143.

When test is complete, release pressure by turning quick test operation switch 136 to the "dump" position, and keeping switch 136 in "dump" position until quick test pressure display 135 and/or the HMI display region 143 indicates pressure is released.

5. Safety Features and Protocols.

a. When well pressure is present as indicated by the well pressure sensor 353 and well pressure display 132 in a locked FCHA 300, and if an operator attempts to raise locking ring 318, hydraulic pressure will not be delivered to FCHA 300. An alarm will sound and be logged in an alarm screen. Alarms cannot be deleted from the system's memory, only acknowledged by the operator. Also, when an alarm sounds, a message is triggered and sent through a cellular network to predetermined personnel via email or text message.

b. An alarm is also triggered when well pressure exceeds 15,000 psi and service personnel are alerted remotely. This allows service personnel to determine if the equipment needs to be removed and re-certified due to an overpressure event.

c. If the lock switch 134 is turned and not kept in a turned position until the locking ring 318 achieves full stroke, an alarm will sound, will show on HMI display region 143, and will be sent remotely to service personnel.

d. The programming in control unit 100 is equipped with logic to "zero" calibrate a transducer if a cable run becomes compromised or a transducer's internal resistance changes. This course zero correction provides a convenient way to ensure accurate measurements from this type of transducer. It also prevents a potential safety hazard of an operator zeroing the transducer value when well pressure is actually present and then trying to raise locking ring 318. The "coarse zero" calibration is accomplished with a password protected calibration that also causes an alarm to trigger and the override action is logged remotely.

e. Filter restriction pressure switches are installed on the main hydraulic fluid manifold. Alarms and pop up messages are presented on HMI display region 143 when these filters need to be changed to ensure maintenance is performed.

f. Alarms are also triggered when system hours reach predetermined values to alert the operator of when engine services need performed.

g. A solenoid function test is integrated into the HMI display region 143's diagnostic screen. This test can be used by the service technician to be able to force voltage to solenoids. This aids in troubleshooting speed and accuracy in the event repairs need to be made.

h. Control of the main system pressure, as seen on the HMI display region 143 under the "Settings" menu tem 142 on the menu bar 101 on HMI 140, can be made by controlling the proportional valve driver output. This function is password protected for service personnel use only.

i. HMI 140 can be securely remotely monitored to supervise operations and adjust the logic program.

j. Cellular transmission can be disabled on jobsites when cellular communication is not allowed, or where local cellular network coverage is insufficient. The cellular transmission signal can be disabled via cellular broadcast switch 155 or on the HMI display region 143 under the "System status" menu tem 142 on the menu bar 101 on HMI 140. Message reminders will pop up on the HMI display region 143 until the cellular connection is restored. Data will continue to be logged, stored and accumulated locally while cellular transmission is disabled, and will be transmitted remotely once the cellular connection is restored. In units providing a satellite broadcasting feature, data may be transmitted remotely via satellite instead cellular where cellular transmission is either not allowed or insufficient due to poor (or no) cellular network coverage. Satellite broadcast may also identify and transmit control unit 100's local position using GPS.

Although the material in this disclosure has been described in detail along with some of its technical advantages, it will be understood that various changes, substitutions and alternations may be made to the detailed embodiments without departing from the broader spirit and scope of such material as set forth in the following claims.

We claim:

1. A control unit, comprising:

a first hydraulic hose, the first hydraulic hose disposed to be connected to a fluid connection housing assembly (FCHA) such that pressurization of the first hydraulic hose retracts at least one actuator piston to lock the FCHA;

a second hydraulic hose, the second hydraulic hose disposed to be connected to the FCHA such that pressurization of the second hydraulic hose extends the at least one actuator piston to unlock the FCHA;

a lock switch, the lock switch disposed to selectively energize pressurization of either the first hydraulic hose or the second hydraulic hose; and an indicator light, the indicator light disposed to be addressed by first and second sensors on the FCHA such that the first sensor activates when the FCHA is in a locked condition and the second sensor activates when the FCHA is in an unlocked condition;

wherein the indicator light illuminates differently according to a sensed condition detected by the first and second sensors, wherein the sensed condition is from among at least two conditions selected from the group consisting of:

(a) the FCHA is in the unlocked condition;

(b) the FCHA is in the locked condition;

(c) the FCHA is in transition from (1) the locked condition to the unlocked condition, or (2) the unlocked condition to the locked condition; and (d) the FCHA is in a fault condition during transition from (1) the locked condition to the unlocked condition, or (2) the unlocked condition to the locked condition.

2. The control unit of claim 1, further comprising:

a well pressure display, the well pressure display disposed to be addressed by a well pressure sensor on the FCHA, wherein the well pressure display displays a current well pressure sensed by the well pressure sensor.

3. The control unit of claim 2, in which the control unit is disposed to prevent pressurization of the second hydraulic hose if the first and second sensors detect that the FCHA is in the locked condition and the well pressure sensor senses a current non-zero well pressure.

4. The control unit of claim 1, in which the control unit is disposed to issue at least one user-perceptible alert selected from the group consisting of:

(a) while the first and second sensors detect that the FCHA is in the locked condition, an alert that the FCHA is available to be pressurized;

(b) while the first and second sensors detect that the FCHA is in the unlocked condition, an alert that the FCHA is unavailable to be pressurized; and (c) while the first and second sensors detect that the FCHA is in transition from (1) the locked condition to the unlocked condition, or (2) the unlocked condition to the locked condition, an alert that the FCHA is in transition.

5. The control unit of claim 1, further comprising:

a third hydraulic hose, the third hydraulic hose disposed to be connected to a quick test fitting on the FCHA such that pressurization of the third hydraulic hose tests whether a pressure-tight connection has been established between sealing rings inside the FCHA;

a quick test pressure display, the quick test pressure display disposed to communicate current pressure in the third hydraulic hose; and a quick test operation switch, the quick test operation switch disposed to selectively energize a quick test function selected from the group consisting of:

(a) energizing pressurization of the third hydraulic hose;

(b) holding current pressure in the third hydraulic hose; and (c) energizing depressurization of the third hydraulic hose.

6. The control unit of claim 1, further comprising:

an interactive touch display, the interactive touch display disposed to communicate information regarding control unit status, wherein the information regarding control unit status includes user-perceptible alerts; and wherein the interactive touch display is further disposed to communicate user instructions given to the control unit via screen touch.

7. The control unit of claim 1, further comprising a cellular/location broadcast module operatively connected to at least one broadcast antenna, wherein the cellular/location broadcast module is disposed to transmit information regarding control unit status via the at least one broadcast antenna, wherein the at least one broadcast antenna includes at least one antenna selected from the group consisting of (a) a cellular antenna and (b) a satellite antenna.

8. The control unit of claim 7, in which the at least one antenna includes a satellite antenna, and wherein the cellular/location module is disposed to transmit a current location of the control unit via the satellite antenna.

9. A control unit, comprising:

a first hydraulic hose, the first hydraulic hose disposed to be connected to a fluid connection housing assembly (FCHA) such that pressurization of the first hydraulic hose retracts at least one actuator piston to lock the FCHA;

a second hydraulic hose, the second hydraulic hose disposed to be connected to the FCHA such that pressurization of the second hydraulic hose extends the at least one actuator piston to unlock the FCHA;

a lock switch, the lock switch disposed to selectively energize pressurization of either the first hydraulic hose or the second hydraulic hose; and an indicator light, the indicator light disposed to be addressed by first and second sensors on the FCHA such that the first sensor activates when the FCHA is in a locked condition and the second sensor activates when the FCHA is in an unlocked condition;

wherein the indicator light illuminates differently according to whether the first and second sensors detect that (a) the FCHA is in the unlocked condition, or (b) the FCHA is in the locked condition.

10. The control unit of claim 9, further comprising:

a well pressure display, the well pressure display disposed to be addressed by a well pressure sensor on the FCHA, wherein the well pressure display displays a current well pressure sensed by the well pressure sensor.

11. The control unit of claim 10, in which the control unit is disposed to prevent pressurization of the second hydraulic hose if the first and second sensors detect that the FCHA is in the locked condition and the well pressure sensor senses a current non-zero well pressure.

12. The control unit of claim 9, in which the control unit is disposed to issue at least one user-perceptible alert selected from the group consisting of:

(a) while the first and second sensors detect that the FCHA is in the locked condition, an alert that the FCHA is available to be pressurized; and (b) while the first and second sensors detect that the FCHA is in the unlocked condition, an alert that the FCHA is unavailable to be pressurized.

13. The control unit of claim 9, further comprising:

a third hydraulic hose, the third hydraulic hose disposed to be connected to a quick test fitting on the FCHA such that pressurization of the third hydraulic hose tests whether a pressure-tight connection has been established between sealing rings inside the FCHA;

a quick test pressure display, the quick test pressure display disposed to communicate current pressure in the third hydraulic hose; and a quick test operation switch, the quick test operation switch disposed to selectively energize a quick test function selected from the group consisting of:

(a) energizing pressurization of the third hydraulic hose;

(b) holding current pressure in the third hydraulic hose; and (c) energizing depressurization of the third hydraulic hose.

14. The control unit of claim 9, further comprising:

an interactive touch display, the interactive touch display disposed to communicate information regarding control unit status, wherein the information regarding control unit status includes user-perceptible alerts; and wherein the interactive touch display is further disposed to communicate user instructions given to the control unit via screen touch.

15. The control unit of claim 9, further comprising a cellular/location broadcast module operatively connected to at least one broadcast antenna, wherein the cellular/location broadcast module is disposed to transmit information regarding control unit status via the at least one broadcast antenna, wherein the at least one broadcast antenna includes at least one antenna selected from the group consisting of (a) a cellular antenna and (b) a satellite antenna.

16. The control unit of claim 15, in which the at least one antenna includes a satellite antenna, and wherein the cellular/location module is disposed to transmit a current location of the control unit via the satellite antenna.

17. A control unit, comprising:

a first hydraulic hose, the first hydraulic hose disposed to be connected to a fluid connection housing assembly (FCHA) such that pressurization of the first hydraulic hose retracts at least one actuator piston to lock the FCHA;

a second hydraulic hose, the second hydraulic hose disposed to be connected to the FCHA such that pressurization of the second hydraulic hose extends the at least one actuator piston to unlock the FCHA;

a lock switch, the lock switch disposed to selectively energize pressurization of either the first hydraulic hose or the second hydraulic hose;

an indicator light, the indicator light disposed to be addressed by first and second sensors on the FCHA such that the first sensor activates when the FCHA is in a locked condition and the second sensor activates when the FCHA is in an unlocked condition;

wherein the indicator light illuminates differently according to a sensed condition detected by the first and second sensors, wherein the sensed condition is from among at least two conditions selected from the group consisting of:

(a) the FCHA is in the unlocked condition;

(b) the FCHA is in the locked condition;

(c) the FCHA is in transition from (1) the locked condition to the unlocked condition, or (2) the unlocked condition to the locked condition; and (d) the FCHA is in a fault condition during transition from (1) the locked condition to the unlocked condition, or (2) the unlocked condition to the locked condition; and a well pressure display, the well pressure display disposed to be addressed by a well pressure sensor on the FCHA, wherein the well pressure display displays a current well pressure sensed by the well pressure sensor.

18. The control unit of claim 17, in which the control unit is disposed to issue at least one user-perceptible alert selected from the group consisting of:

(a) while the first and second sensors detect that the FCHA is in the locked condition, an alert that the FCHA is available to be pressurized;

(b) while the first and second sensors detect that the FCHA is in the unlocked condition, an alert that the FCHA is unavailable to be pressurized;

(c) while the well pressure sensor senses a current well pressure in excess of a predetermined maximum pressure value, an alert that the predetermined maximum pressure value has been exceeded; and (d) while the first and second sensors detect that the FCHA is in transition from (1) the locked condition to the unlocked condition, or (2) the unlocked condition to the locked condition, an alert that the FCHA is in transition.

19. The control unit of claim 17, in which the control unit is disposed to prevent pressurization of the second hydraulic hose if the first and second sensors detect that the FCHA is in the locked condition and the well pressure sensor senses a current non-zero well pressure.

20. The control unit of claim 17, further comprising:

a third hydraulic hose, the third hydraulic hose disposed to be connected to a quick test fitting on the FCHA such that pressurization of the third hydraulic hose tests whether a pressure-tight connection has been established between sealing rings inside the FCHA;

a quick test pressure display, the quick test pressure display disposed to communicate current pressure in the third hydraulic hose; and a quick test operation switch, the quick test operation switch disposed to selectively energize a quick test function selected from the group consisting of:

(a) energizing pressurization of the third hydraulic hose;

(b) holding current pressure in the third hydraulic hose; and (c) energizing depressurization of the third hydraulic hose.

21. The control unit of claim 17, further comprising:

an interactive touch display, the interactive touch display disposed to communicate information regarding control unit status; wherein the information regarding control unit status includes user-perceptible alerts; and wherein the interactive touch display is further disposed to communicate user instructions given to the control unit via screen touch.

22. The control unit of claim 17, further comprising a cellular/location broadcast module operatively connected to at least one broadcast antenna, wherein the cellular/location broadcast module is disposed to transmit information regarding control unit status via the at least one broadcast antenna, wherein the at least one broadcast antenna includes at least one antenna selected from the group consisting of (a) a cellular antenna and (b) a satellite antenna.

23. The control unit of claim 22, in which the at least one antenna includes a satellite antenna, and wherein the cellular/location module is disposed to transmit a current location of the control unit via the satellite antenna.

24. A control unit, comprising:

a fluid connection device including a fluid connection adapter and a fluid connection housing assembly, wherein a pressure seal forms when the fluid connector adapter is in locked connection to the fluid connection housing assembly;

a first hydraulic hose, the first hydraulic hose disposed to be connected to the fluid connection device such that pressurization of the first hydraulic hose causes the fluid connection device to move towards a locked condition;

a second hydraulic hose, the second hydraulic hose disposed to be connected to the fluid connection device such that pressurization of the second hydraulic hose causes the fluid connection device to move towards an unlocked condition;

a third hydraulic hose, the third hydraulic hose disposed to be connected to a quick test fitting on the fluid connection device such that pressurization of the third hydraulic hose tests whether a pressure-tight connection has been established between sealing rings inside the fluid connection device;

wherein the control unit is disposed to energize pressurization from among the first hydraulic hose, the second hydraulic hose and the third hydraulic hose;

a quick test pressure display, the quick test pressure display disposed to communicate current pressure in the third hydraulic hose;

a quick test operation switch, the quick test operation switch disposed to selectively energize a quick test function selected from the group consisting of:

(a) energizing pressurization of the third hydraulic hose;

(b) holding current pressure in the third hydraulic hose; and (c) energizing depressurization of the third hydraulic hose;

at least one sensor configured to sense from among positional statuses of the fluid connection device and to generate corresponding sensor data; and wherein, responsive to at least some of the sensor data, an indicator alerts differently, according to whether the fluid connection device is in the locked condition or the unlocked condition.

25. The control unit of claim 24, further comprising a cellular/location broadcast module operatively connected to at least one broadcast antenna, wherein the cellular/location broadcast module is disposed to transmit information regarding control unit status via the at least one broadcast antenna.

* * * * *